US007065311B2

(12) United States Patent
Okabe

(10) Patent No.: US 7,065,311 B2
(45) Date of Patent: Jun. 20, 2006

(54) IMAGE FORMING APPARATUS

(75) Inventor: Yasushi Okabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 21 days.

(21) Appl. No.: 10/803,990

(22) Filed: Mar. 19, 2004

(65) Prior Publication Data

US 2004/0190934 A1 Sep. 30, 2004

(30) Foreign Application Priority Data

Mar. 31, 2003 (JP) ..... 2003-093509

(51) Int. Cl.
*G03G 15/00* (2006.01)
*G03G 21/00* (2006.01)

(52) U.S. Cl. ..... 399/111; 399/110; 399/121; 399/124

(58) Field of Classification Search ..... 399/107, 399/110, 111, 119–121, 124–125
See application file for complete search history.

(56) References Cited

U.S. PATENT DOCUMENTS 5,041,872 A * 8/1991 Nukaya et al. ..... 399/107
5,907,745 A * 5/1999 Azuma et al. ..... 399/92
5,983,062 A * 11/1999 Sameshima ..... 399/302
6,041,203 A 3/2000 Suzuki et al.
6,208,828 B1 * 3/2001 Awai et al. ..... 399/361
6,330,410 B1 12/2001 Okabe et al.
6,411,789 B1 6/2002 Okabe et al.
6,546,217 B1 4/2003 Okabe et al.
6,665,047 B1 * 12/2003 Kimura et al. ..... 399/110
6,738,590 B1 * 5/2004 Okimura et al. ..... 399/111
6,876,826 B1 * 4/2005 Noda et al. ..... 399/90
6,895,199 B1 * 5/2005 Sato et al. ..... 399/111
2003/0118370 A1 6/2003 Okabe et al.
2004/0208670 A1 * 10/2004 Abe ..... 399/110

FOREIGN PATENT DOCUMENTS

JP A 7-306603 11/1995
JP A 2000-250378 9/2000
JP A 2001-347722 12/2001
JP B2 3337978 8/2002

* cited by examiner

*Primary Examiner*—Yaritza Guadalupe
(74) *Attorney, Agent, or Firm*—Oliff & Berridge, PLC

(57) ABSTRACT

A cassette with cover is made up of a holding portion that contains sheets and a cover portion that serves as a cosmetic plate at the front of a laser printer and covers an opening of a storing portion for a process cartridge. The holding portion is supported at a bottom of a main body such as to move in a front-to-back direction, and the cover portion is separated from the main body along with the cassette portion. Thus, the opening of the storing portion for the process cartridge is opened or closed with the movement of the cover portion.

54 Claims, 52 Drawing Sheets

IMAGE FORMING APPARATUS

BACKGROUND OF THE INVENTION

1. Field of Invention

The invention relates to an image forming apparatus including a recording medium storing member.

2. Description of Related Art

There exists, in laser printers and copiers, a photosensitive member that is charged at an image forming unit where an electrostatic latent image is formed onto the photosensitive member through the exposure of a light beam from a laser or a light emitting diode (LED). The latent image is (a) developed using a developing agent such as toner, (b) transferred from the photosensitive member to a recording medium such as paper, and (c) heated and transferred entirely to the recording medium by a fixing device. In this way, images are formed on the recording medium.

Such an image forming apparatus includes a process unit that accommodates parts in a single unit for image formation and a developing cartridge that contains a developing agent. The process unit and the developing cartridge are detachably attached to the image forming apparatus in order to easily handle and maintain the image forming apparatus. A paper cassette for storing recording sheets on which images are to be formed is also attached to the image forming apparatus.

The paper cassette and the process unit are removed from or inserted into the laser printer independently because they are stored in different places. However, in view of user convenience, it is preferable that the removal and insertion of the paper cassette and the process unit are performed from the front of the laser printer. In Japanese Laid-Open Patent Publication No. 2000-250378, a paper cassette is provided at a lower part of the main body and attached from the front of the main body. A process unit is removed from or inserted into the main body when the front cover provided at the front of the main body is rotated downward to widely open the inside.

However, when a paper jam occurs, both the paper cassette and the process unit should be removed to clear the paper jam. As the paper cassette and the front cover are structurally different from each other, when the front cover is open, the paper cassette may not open due to interference created by the front cover. Thus, the paper cassette and the front cover can not remain open at the same time, and it is thus difficult to remove the paper jam. Furthermore, if a device is used that allows the front cover and the paper cassette to remain open, different operations are required to open them, which thus impairs user convenience.

SUMMARY OF THE INVENTION

The invention thus provides, among other things, an image forming apparatus where a cover portion that blocks an opening for a storing portion of an exchange unit is provided in a recording medium storing member such that the storing portion is opened or closed in accordance with the attachment and removal of the recording medium storing member.

The invention, according to an exemplary aspect of the invention, includes a main body with a first opening and a second opening, an accommodating portion formed at the main body, wherein the first opening is in communication with the accommodating portion, an exchange unit that is detachably attached to the accommodating portion through the first opening, a cassette accommodating portion formed at the main body, wherein the second opening is in communication with the cassette accommodating portion, and a cassette that is accommodated at the cassette accommodating portion and is movable relative to the main body between a first position and a second position, wherein the cassette further comprises a holding portion that holds a recording medium therein, and a cover portion that conceals the first opening when the cassette is at the first position.

The invention, according to another exemplary aspect of the invention, includes a main body with a first opening and a second opening, a process cartridge that is detachably attached to the main body and that passes through the first opening, and a cassette that is movable between a first position and a second position relative to the second opening of the main body, wherein an outer wall of the cassette conceals the first opening when the cassette is at the first position.

BRIEF DESCRIPTION OF THE DRAWINGS

An embodiment of the invention will be described in detail with reference to the following figures wherein.

DETAILED DESCRIPTION OF PREFERRED EMBODIMENTS

A first embodiment of an image forming apparatus in which the invention is embodied will be described with reference to the accompanying drawings. First, an entire structure of a laser printer 1, which is an example of the image forming apparatus of the first embodiment, will be described with reference to FIGS. 1 to 5. In the following drawings, −Z direction represents the front side of the laser printer 1, −X direction representing the left side, +X direction representing the right side, +Z direction representing the rear side, +Y direction representing the top side, and −Y direction representing the bottom side.

Figure 1:
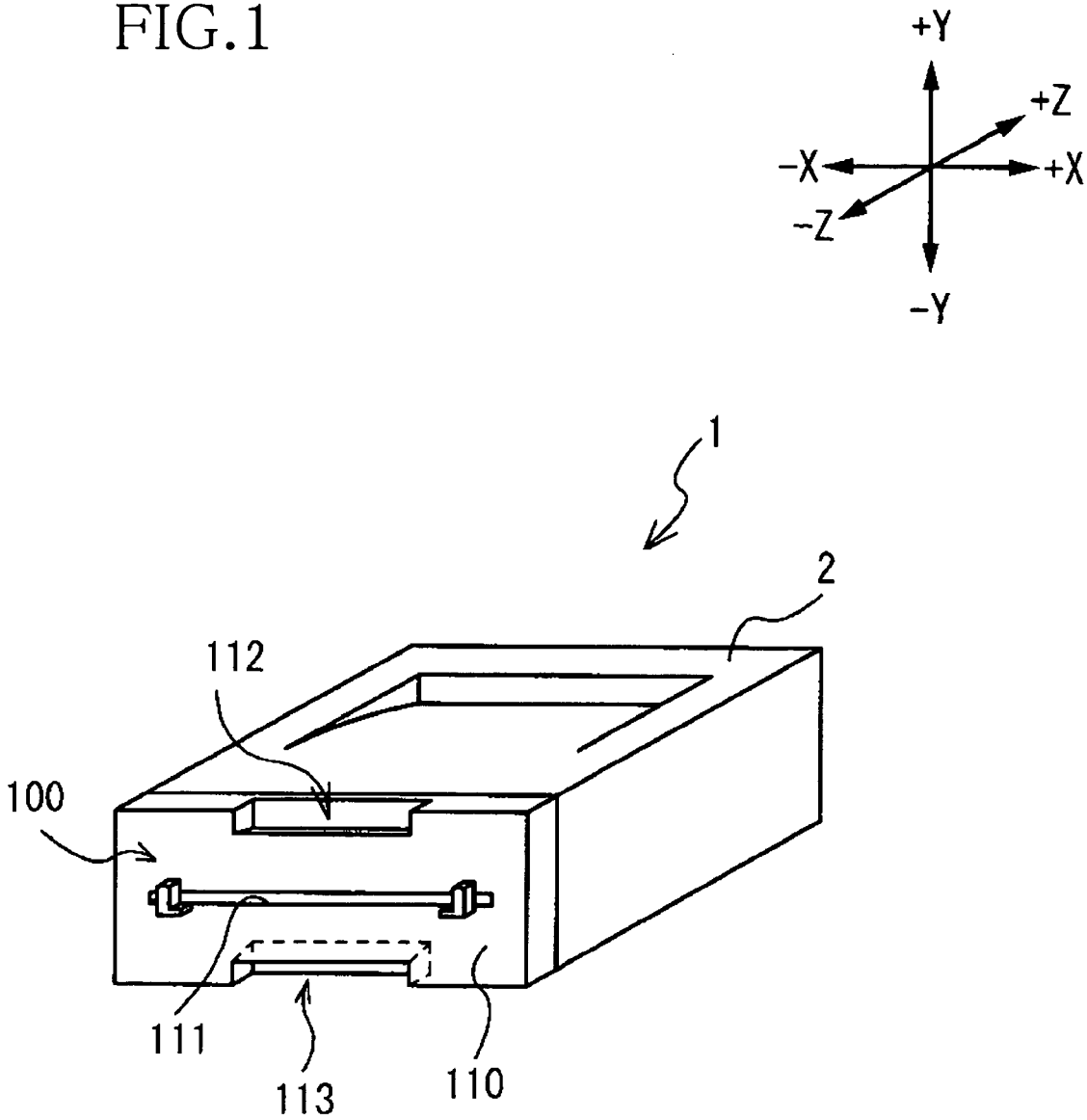
FIG. 1 is a perspective view showing an appearance of a laser printer 1 according to the invention.

As shown in FIG. 1, the laser printer 1 of the first embodiment has substantially a rectangular solid shape. A cover portion 110 is provided at the front of a main body 2 of the laser printer 1. The cover portion 110 covers an opening for a storing portion 55 (FIG. 2) designed to store a process cartridge 17 detachably. The cover portion 110 is substantially a rectangular plate member covering entirely the front of the laser printer 1 in a front view, and is provided with holding portions 112, 113 at upper and lower central edge portions thereof, which are employed for opening and closing the cover portion 110. The cover portion 110 also includes a slit opening 111, which is a long narrow opening formed side to side for inserting a single sheet 3 for manual feed printing, in substantially a central position in a top-to-bottom direction of the cover portion 110.

Figure 2:
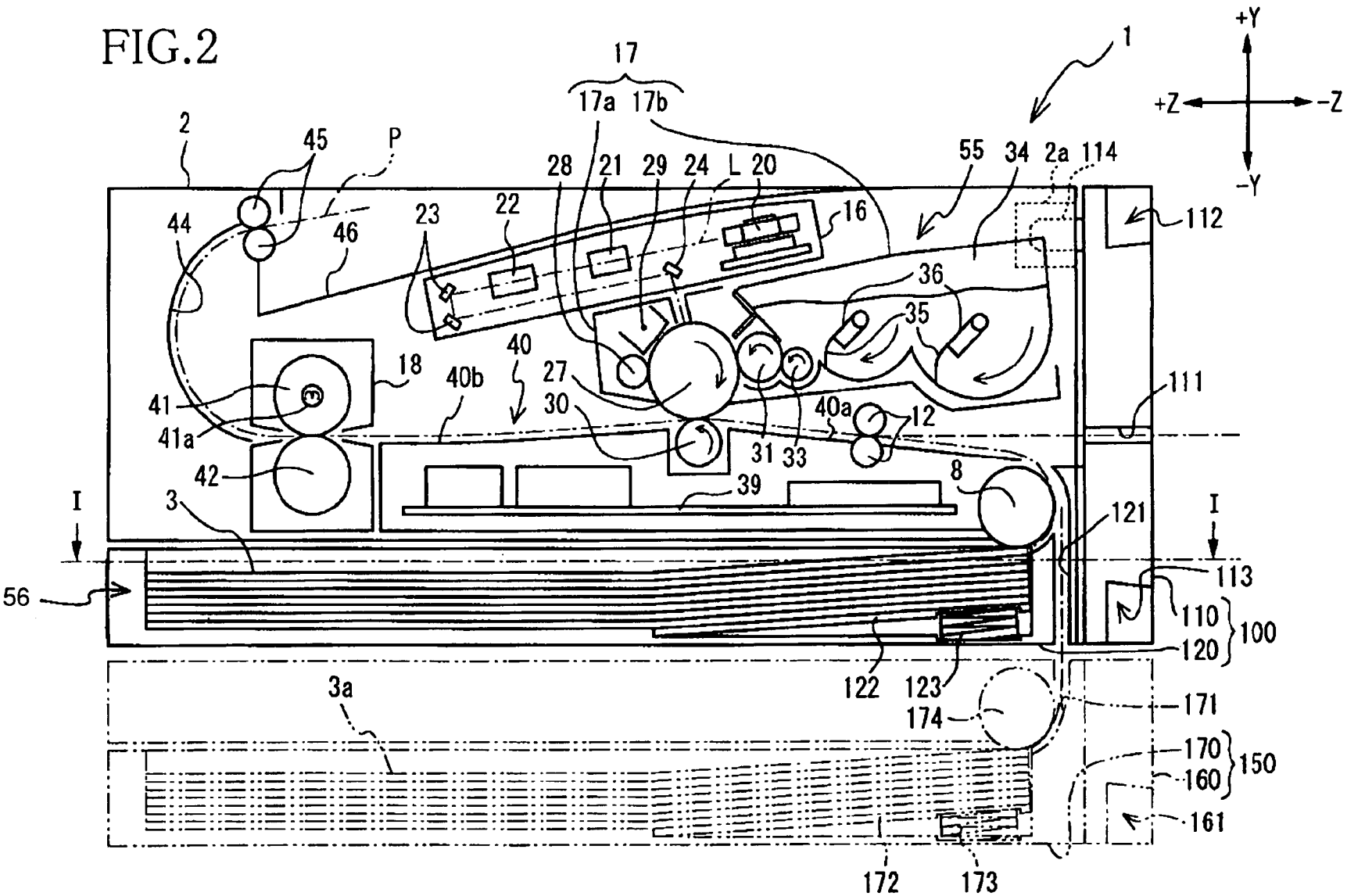
FIG. 2 is a sectional view of a general structure of the laser printer 1 according to the invention.

As shown in FIG. 2, a box-shaped cassette portion 120 for storing sheets 3 is detachably attached to a bottom portion 56 of the main body 2. The cassette portion 120 is detachable from the front side of the main body 2. The cassette portion 120 includes a sheet holding portion that holds sheets 3 stacked therein. The sheet holding portion is provided with a presser plate 122 that presses the sheets 3 against a paper feed roller 8 provided at a bottom portion inside the main body 2. The presser plate 122 is pivotally supported at a bottom of the cassette portion 120 at its end remote from the paper feed roller 8 such that the presser plate is vertically movable at its end closest to the paper feed roller 8. The presser plate 122 is urged toward the paper feed roller 8 from its reverse, or bottom, side by a spring 123.

The cover portion 110 is fixed to the front of the cassette portion 120, such that its surface faces perpendicular to the bottom of the cassette portion 120. The cassette portion 120 and the cover portion 110 constitute a cassette with cover 100. The cover portion 110 is brought in or out of contact with the main body 2 in accordance with a front to rear motion of the cassette 120. The cover portion 110 opens and closes the opening to the storing portion 55 and functions as a cosmetic plate of the front of the laser printer 1 when the cassette with cover 100 are attached.

A passage opening 121 is provided between the cover portion 110 and the sheet holding portion in the cassette portion 120, which opens through the cassette portion 120 in a top-to-bottom direction (in the Y direction in FIG. 2). The passage opening 121 is a slit passage extending in a width direction of the cassette portion 120 (in the X direction in FIG. 1), and forms a part of a sheet conveying path such as to convey a sheet 3*a* stored in a lower cassette 150 into the main body 2 when an image is formed on the sheet 3*a*.

The holding portions 112, 113 are provided and recessed at the upper end (toward the +Y direction) and the lower end (toward the −Y direction) of the cover portion 110 respectively, such as to allow a user to place fingers or take a grip to slide the cassette with cover 100 toward the front side (−Z direction). A shutter plate 114 is provided at the rear side (+Z direction) of the holding portion 112, and a known photo sensor 2*a*, that detects whether light is blocked by the shutter plate 114, is provided at the main body 2. When the cassette with cover 100 is attached to the main body 2, the cover portion 110 closes the storing portion 55, and the shutter plate 114 blocks light emitted from the photo sensor 2*a* so that light is not received by a light receiving portion (not shown). When the cassette with cover 100 is not attached to the main body 2, the blockage of light is released. Using signals from the photo sensor 2*a*, an opening and closing status of the cover portion 110 is detected. Further, the attachment and removal status of the cassette portion 120, which is integrally with the cover portion 110, is also detected by the photo sensor 2*a*.

The slit opening 111, provided at substantially the center with respect to the height of the cover portion 110, opens such that a sheet 3*b* (FIG. 6) to be printed is manually inserted through the slit opening 111 when manual feed printing is performed with the leading edge of the sheet 3*b* led to a nip portion between resist rollers 12. The slit opening 111 also forms a part of the sheet conveying path P.

Figure 3:
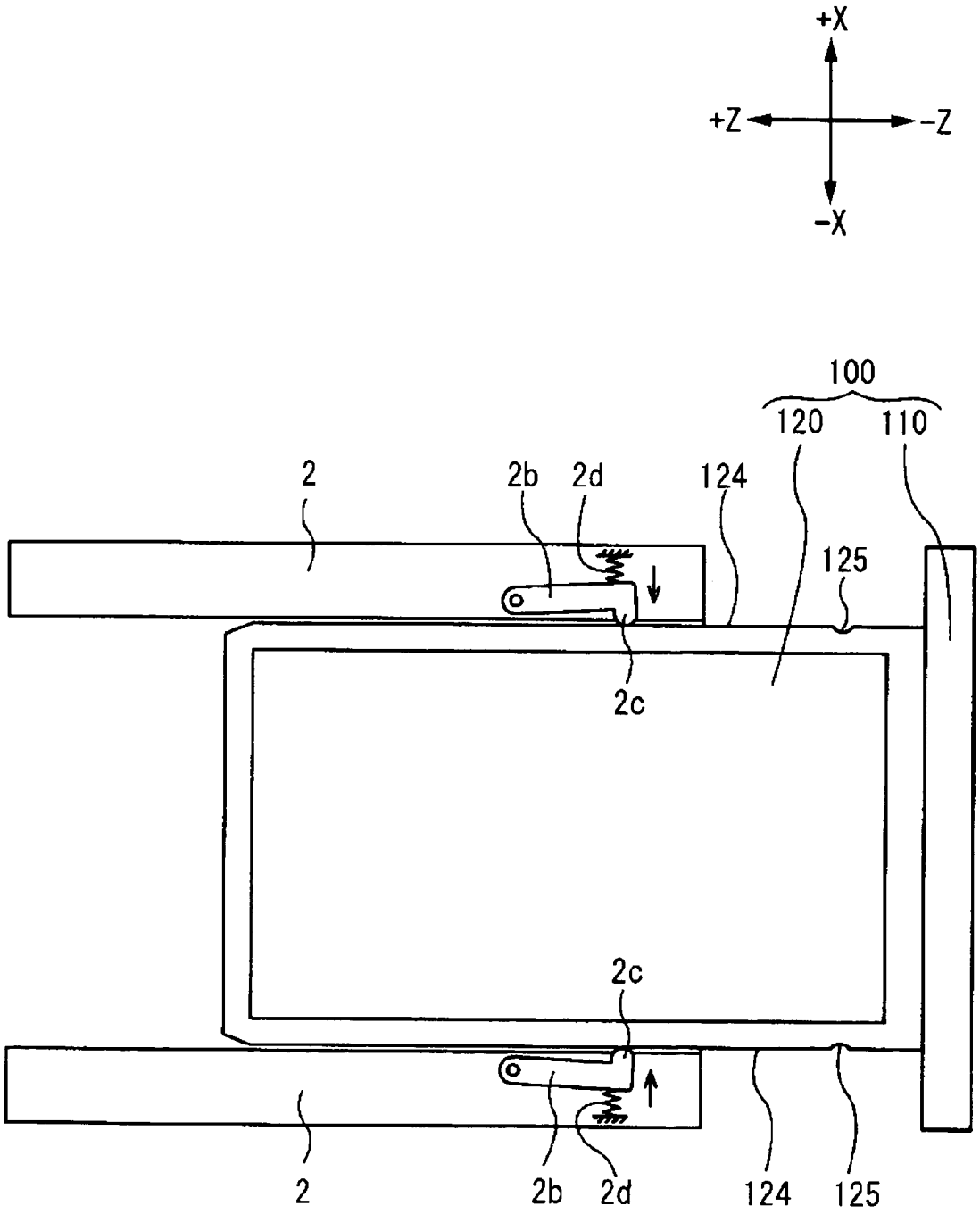
FIG. 3 is a sectional view of a cassette with a cover 100 pulled open, taken along a dash dot line I—I in FIG. 2, viewed in the direction of appended arrows.

As shown in FIG. 3, the cassette with cover 100 is capable of sliding in and out of the main body 2 in the Z direction such that both side surfaces 124 of the cassette portion 120 (with respect to the X direction) are slidably supported by inner side walls on both sides of the main body 2. The inner side walls on both sides of the main body 2 are provided with stoppers 2*b* for positioning and temporarily fixing the cassette with cover 100 when the cassette with cover 100 is attached. The stoppers 2*b* are rod-like members supported such as to oscillate in the X-axis direction at insides of both sides of the main body 2. The stoppers 2*b* are provided with projections 2*c* at their free ends, such that the projections 2*c* face each other. The stoppers 2*b* are urged by springs 2*d* from the backside of each of the projections 2*c* such that the projections 2*c* project from openings provided at the inner walls of both sides of the main body 2.

Figure 4:
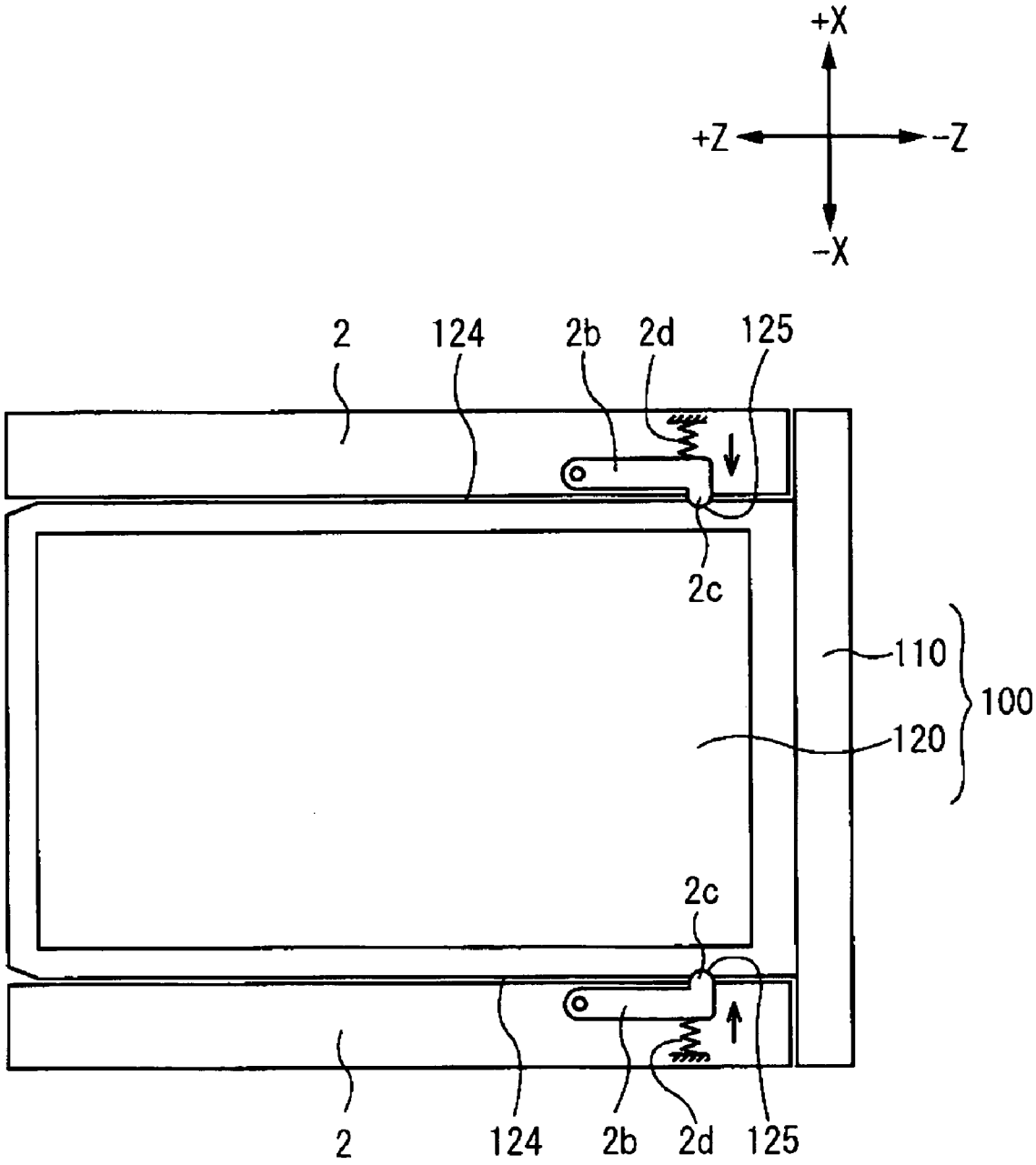
FIG. 4 is a sectional view being taken along a dash dot line I—I in FIG. 2, viewed in the direction of appended arrows.

Recessed portions 125 are provided close to the cover portion 110 at both the side surfaces 124 of the cassette portion 120. As shown in FIG. 4, when the cassette with cover 100 is stored in the main body 2, the projections 2*c* of the stoppers 2*b* are engaged with the corresponding recessed portions 125, so that the cassette with cover 100 is positioned and temporarily fixed. The projections 2*c* are shaped spherically at their respective ends, and the recessed portions 125 are shaped like a bowl. Thus, the cassette with cover 100 can be pulled when a X-axis force, in each recessed portion 125, that is applied to the corresponding stopper 2*b* is greater than an urging force of each spring 2*d* (in other words, a cassette holding force).

As shown in FIG. 2, a circuit board 39 mounting a control circuit board and a power circuit board for electrical control of the laser printer 1 is disposed above the cassette 120 in the main body 2. A chute 40 that guides the conveyance of the sheets 3 covers an upper part of the circuit board 39. A top surface of the chute 40 forms a part of a conveying path 40*a* that is upstream from a transfer roller 30 provided at substantially a center of a conveying path 40*b* that is downstream from the transfer roller 30. The chute 40 also forms a part of the sheet conveying path P such that the sheet 3 supplied from the cassette portion 120 by the paper feed roller 8 is led to a fixing unit 18. The resist rollers 12 are provided in the conveying path 40*a* where a timing to feed the sheets 3 to be printed is adjusted.

An image forming part is made up of a scanner unit 16, a process cartridge 17, and the fixing unit 18. The scanner unit 16 is disposed directly under a discharge paper tray 46 in the main body 2, and has a laser emitting portion (not shown) that emits a laser beam, a rotatable polygon mirror 20 that scans the laser beam emitted from the laser emitting portion in a main scanning direction, an fθ lens 21 that stabilizes a scanning speed of the laser beam scanned by the polygon mirror 20, a cylindrical lens 22 that corrects for optical face tangle error in a sub scanning direction when the laser beam is irradiated on a photosensitive drum 27 for image formation, and reflecting mirrors 23, 24 that reflect the laser beam and change its optical path. The scanner unit 16 is designed such that the laser beam emitted from the laser emitting portion based on print data passes through or reflects from the optical elements, that is, the polygon mirror 20, the fθ lens 21, the cylindrical lens 22, and the reflecting mirrors 23, 24 in order as indicated by a broken line in FIG. 2. The laser beam is thus directed to a surface of the photosensitive drum 27 in the process cartridge 17.

73 The process cartridge 17 in the image forming part is made up of a drum cartridge 17*a* and a developing cartridge 17*b*, which is detachable from the drum cartridge 17*a*, and stored in the storing portion 55 provided between the scanner unit 16 and the chute 40. The drum cartridge 17*a* includes the photosensitive drum 27, a scorotron charger 29, and a cleaning roller 28. The developing cartridge 17*b* includes a developing roller 31, a supply roller 33, and a toner hopper 34.

The photosensitive drum 27 in the drum cartridge 17*a* is disposed such as to rotate in contact with the developing roller 31 in a direction of an arrow (clockwise) in FIG. 2. The photosensitive drum 27 is a positively charged photosensitive member formed by coating a conductive base material with a positively charged photosensitive member, in which a charge generating material is dispersed in a charge transport layer. When the photosensitive drum 27 is irradiated with a laser beam, an electrical charge is generated in the charge generating material due to beam absorption, the electrical charge is transported to the surface of the photosensitive drum 27 and the conductive base material in the charge transport layer, and a surface potential charged on the scorotron charger 29 is cancelled. Thereby, the difference of potential is yielded between a potential of a part irradiated with the laser beam and a potential of a part not irradiated with the laser beam. The laser beam is directed based on print data such that an electrostatic latent image is formed.

The scorotron charger 29 is disposed above and away from the photosensitive drum 27 so as to face the photosensitive drum 27 at a predetermined distance. The scorotron charger 29 produces corona discharge from an electrical discharge wire made of tungsten, for example. When printing is performed, a bias is applied to the scorotron charger 29 to positively charge the surface of the photosensitive drum 27 uniformly.

Figure 5:
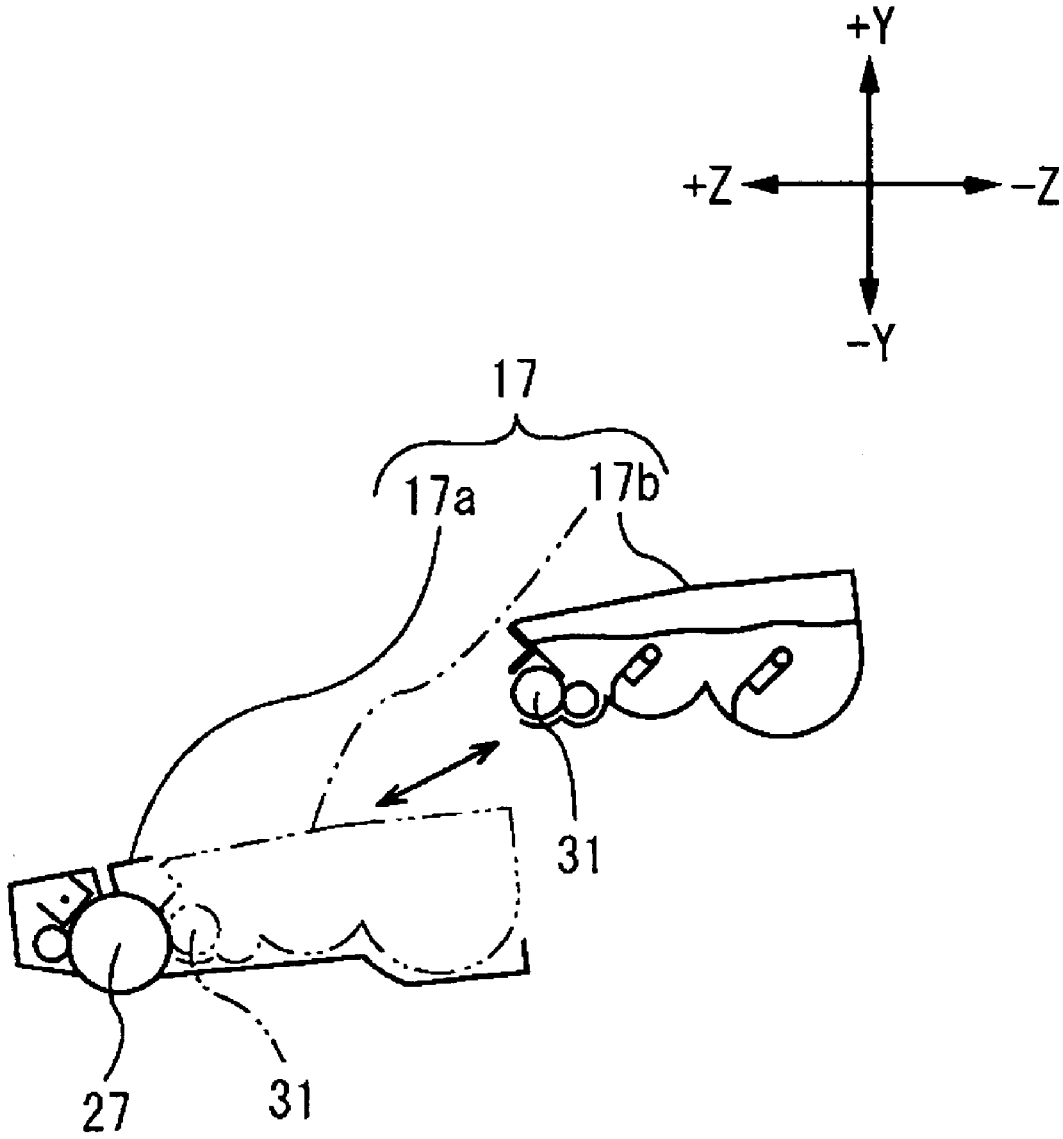
FIG. 5 is a sectional view showing attachment and detachment of a drum cartridge 17*a* and a developing cartridge 17*b;*

When the developing cartridge 17*b* is attached to the drum cartridge 17*a* as shown in FIG. 5, the developing cartridge 17*b* is fitted and fixed to the bottom surface of the drum cartridge 17*a* with the photosensitive drum 27 in the drum cartridge 17*a* disposed facing the developing roller 31 in the developing drum 17*b*. As shown in FIG. 2, they are disposed in the image forming part of the process cartridge 17 such that the photosensitive drum 27 faces the transfer roller 30. In this state, the developing roller 31 is disposed downstream from the scorotron charger 29 with respect to the rotational direction (clockwise in the figure) of the photosensitive drum 27, and is placed rotatably in a direction of an arrow (counterclockwise in the figure). The developing roller 31 is formed by covering a metallic roller shaft with an electrically conductive rubber material, and receives a developing bias when printing is performed.

The supply roller 33 is rotatably disposed at a side of the developing roller 31 opposite the photosensitive drum 27 and makes contact with the developing roller 31 so as to press-deform against the developing roller 31. The supply roller 33 is made up of a metallic roller shaft and a roller formed from a conductive foam, and the metallic roller shaft is covered with the roller. The supply roller 33 is designed to charge toner to be supplied to the developing roller 31 by friction. For this reason, the supply roller 33 is disposed such as to rotate in the arrow direction (counterclockwise in FIG. 2), which is the same direction as that of the developing roller 31.

A toner hopper 34 is disposed at a side of the supply roller 33, and contains developing agent to be supplied to the developing roller 31 via the supply roller 33. In this embodiment, positively charged nonmagnetic single-component toner is used as the developing agent. The toner is a polymerized toner obtained through copolymerization of styrene-based monomers such as styrene, and acryl-based monomers, such as acrylic acid, alkyl (C1–C4) acrylate, and alkyl (C1–C4) methacrylate, using a known polymerization method, such as suspension polymerization. The particle shape of such a polymerized toner is spherical with its particle size approximately 6–10 μm. A coloring agent, such as carbon black, and wax is added to the polymerized toner. An external additive, such as silica, is also added to the polymerized toner to improve flowability.

The toner hopper 34 is divided into two compartments inside, which are each provided with agitators 36. Each agitator 36 is a roughly netted plate-like member extending in the axial direction, and rotates about a shaft on one end in a clockwise direction as shown in FIG. 2, such that a film member 35 attached to the other end of the agitator 36 slides on the inner wall of the toner hopper 34 to agitate toner stored in the toner hopper 34.

The cleaning roller 28 is disposed at a side of the photosensitive drum 27 and upstream from the charger 29 with respect to the rotational direction of the photosensitive drum 27. During printing, through the application of a cleaning bias, the cleaning roller 28 electrically attracts toner remaining on the surface of the photosensitive drum 27, which is not transferred to a sheet 3, and causes the toner to electostatically adhere to the surface of the cleaning roller 28. When printing is not performed, through the application of a reverse cleaning bias that generates a potential difference in a direction where toner is attracted from the cleaning roller 28 to the photosensitive drum 27, the cleaning roller 28 causes the toner to adhere to the surface of the photosensitive drum 27. Toner returned from the cleaning roller 28 to the photosensitive drum 28 is collected by the developing roller 31.

The transfer roller 30 is disposed downstream from the developing roller 31 with respect to the rotational direction of the photosensitive drum 27 and under the photosensitive drum 27. The transfer roller 30 is supported rotatably in the direction of the arrow (counterclockwise) in the main body 2 such as to fit in a recessed portion on the top surface of the chute 40. The transfer roller 30 is formed by covering a metallic roller shaft with a roller made from an ion-conductive rubber material, and structured such as to receive a transfer bias when printing is performed. The transfer bias is a bias to be applied to the transfer roller 30 such that the potential difference is generated in a direction that toner electrostatically adhered to the surface of the photosensitive drum 27 is electrically attracted to the surface of the transfer roller 30.

The fixing unit 18 includes a fixing roller 41 disposed diagonally downstream from the process cartridge 17 and a pressure roller 42 that presses the fixing roller 41. The fixing roller 41 is a roller formed by coating a hollow aluminum tube with fluorine resin and burning, and has a halogen lamp 41 a for heating inside the roller. The pressure roller 42 is a roller formed by covering a metallic shaft with a roller made of a low-hardness silicon rubber and covering the roller with a tube formed of fluorine resin. The pressure roller 42 is pressed against the fixing roller 41 as a shaft of the pressure roller 42 is urged upward by a spring (not shown). In the fixing unit 18, toner transferred onto a sheet 3 in the process cartridge 17 melts and becomes fixed onto the sheet 3 due to the applied heat, while the sheet 3 passes through the nip portion between the fixing roller 41 and the pressure roller 42, and the sheet 3 is conveyed to a paper discharge path 44.

The paper discharge path 44 is provided at a rear part in the main body 2 (to the left in FIG. 2) in a half arc upward along a rear face of the main body 2 such as to lead the sheet 3 ejected from the fixing unit 18 provided at a rear lower part in the main body 2 to the discharge paper tray 46 provided at an upper part in the main body 2. Ejection rollers 45 are provided at a downstream end of the paper discharge path 44, which eject the sheet 3 toward the discharge paper tray 46.

A lower cassette 150 is detachably attached to the laser printer 1 below the cassette with cover 100, and holds sheets 3*a* different from the sheets 3. The lower cassette 150 is made up of a cassette portion 170 that holds the sheets 3*a* stacked therein, and a front face plate 160 that is a cosmetic plate located at the front of the laser printer 1. The cassette portion 170 is supported such that side surfaces on both sides of the cassette portion 170 (toward a front to back direction with respect to the figure) are slidable along supporting walls (not shown) that are connected extending downwardly from both sides of the main body 2. The cassette portion 170 can be moved backward and forward such as to enable attaching and removing of the cassette portion 170 from the front of the main body 2.

A paper feed roller 174 is provided at a front end portion of the cassette portion 170 of the lower cassette 150. As with the cassette with cover 100, the cassette portion 170 is provided with a presser plate 172 and a spring 173 that applies an urging force to the presser plate 172 from its back. Thus, the sheets 3*a* stacked are pressed against the paper feed roller 174. To lead the sheets 3*a* to a passage 121 in the cassette with cover 100, a supply path 171 is provided along a circumference of the paper feed roller 174. The supply path 171 and the passage 121 form a part of the sheet conveying path P, where the sheets 3*a* are led to the resist rollers 12. At a lower end of the front face plate 160, a holding portion 161 is provided such as to allow a user to take a grip for the attachment and removal of the lower cassette 150, as with the cassette with cover 100.

Figure 6:
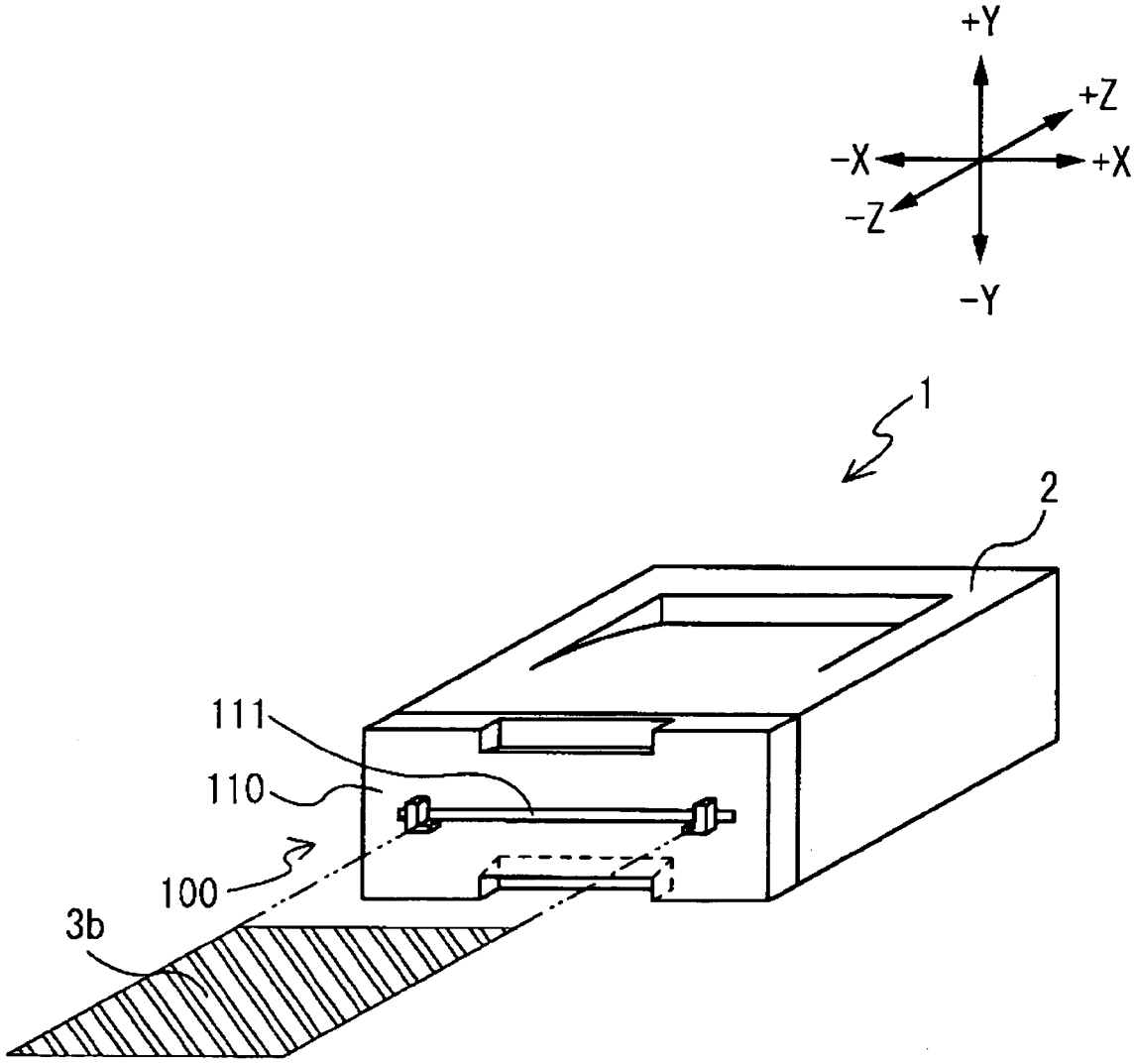
FIG. 6 is a perspective view of the laser printer 1 for manual feed printing.

With reference to FIGS. 2 and 6, operation of the laser printer 1 during printing will be briefly described. FIG. 6 is a perspective view of the laser printer 1 for manual feed printing. When printing is started based on the reception of print data from a host computer (not shown), the sheet 3 is fed toward the resist rollers 12 by friction with the rotating paper feed roller 8.

In the scanner unit 16, a laser beam is generated at the laser emitting portion (not shown) in accordance with a laser driving signal generated based on print data, and emitted to the polygon mirror 20. The polygon mirror 20 scans the incident laser beam in the main scanning direction (perpendicular to a direction that the sheets 3 are conveyed), and directs it to the fθ lens 21. The fθ lens 21 converts the laser beam scanned at a constant angular speed into a laser beam to be scanned at a uniform velocity. Then, the laser beam is converged at the cylindrical lens 22, and directed on the surface of the photosensitive drum 27 via the reflecting mirrors 23, 24 to form an image.

The photosensitive drum 27 is charged by the scorotron charger 29 such that the surface potential becomes approximately 1000V, for example. The photosensitive drum 27 rotating in the direction of the arrow (clockwise in FIG. 2) is irradiated with the laser beam. The laser beam is emitted in the main scanning direction such that it is incident to a portion to form an image and it is not incident to a portion that does not form an image. In the portion irradiated with the laser beam (an exposed portion), the surface potential drops to 200V for example. By rotating the photosensitive drum 27, the laser beam is also emitted in the sub scanning direction (the direction that the sheets 3 are conveyed), an image invisible electrically, that is a latent image, is formed on the surface of the photosensitive drum 27 between the exposed portion and the portion not irradiated with the laser beam (an unexposed portion).

Toner in the toner hopper 34 is supplied to the supply roller 33 by rotating the agitators 36, and to the developing roller 31 by rotating of the supply roller 33. At this time, toner is positively charged between the supply roller 33 and the developing roller 31 by friction, formed into a thin layer of a predetermined thickness, and carried on the developing roller 31. A positive developing bias of approximately 400V is applied to the developing roller 31. By rotating the developing roller 31, toner carried on the developing roller 31 and positively charged is brought in contact with the photosensitive drum 27, and is transferred to an electrostatic latent image formed on the surface of the photosensitive drum 27. That is, the potential of the developing roller 31 is lower than the potential of the unexposed portion (+1000V) and higher than the potential of the exposed portion (+200V), so that toner is selectively transferred to the exposed portion where the potential is low. Thus, a visible image is formed on the surface of the photosensitive drum 27 as a developing agent image by toner.

The resist rollers 12 resist the sheet 3, and feed the sheet 3 with a timing that a leading edge of the visible image formed on the surface of the photosensitive drum 27 rotating is in alignment with the leading edge of the sheet 3. When the sheet 3 passes between the photosensitive drum 27 and the transfer roller 30, a negative constant current is applied to the transfer roller 30 such that the potential of the transfer roller 30 is reduced to −1000V, for example, lower than the potential of the exposed portion (+200V). Thereby, the visible image formed on the surface of the photosensitive drum 27 is transferred to the sheet 3.

The sheet 3 to which toner has been transferred is fed toward the fixing unit 18. The fixing unit 18 applies a heat of approximately 200° C. by the fixing roller 41 and a pressure by the pressure roller 42 to the sheet 3, so that toner melts on the sheet 3 to form an external image. The fixing roller 41 and the pressure roller 42 are grounded via respective diodes, and set such that the surface potential of the pressure roller 42 is lower than the surface potential of the fixing roller 41. Thus, positively charged toner placed on the sheet 3 on the side facing the fixing roller 41 is electrically attracted to the pressure roller 42 by the pressure roller 42 via the sheet 3, thereby preventing distortion of the image that may occur when toner is attracted to the fixing roller 41 during fixing.

The sheet 3 on which toner was melted and fixed through the fixing unit 18 is conveyed along the ejection path 44, and ejected to the discharge paper tray 46 by the ejection rollers 45 with a printed face facing downward. Similarly, the following sheet 3 to be printed is stacked on the discharge paper tray 46 with a printed face facing downward. Thus, the user can obtain the printed sheets 3 arranged in the order printed.

For manual feed printing, as shown in FIG. 6, the sheet 3*a* is inserted into the slit opening 111 of the cover portion 100. When the sheet 3*a* is inserted until resistance is felt, the leading edge of the sheet 3*a* reaches the nip portion between the resist rollers 12 shown in FIG. 2. If printing is performed as described above in this state, the user can obtain the sheets 3*b* printed.

Figure 7:
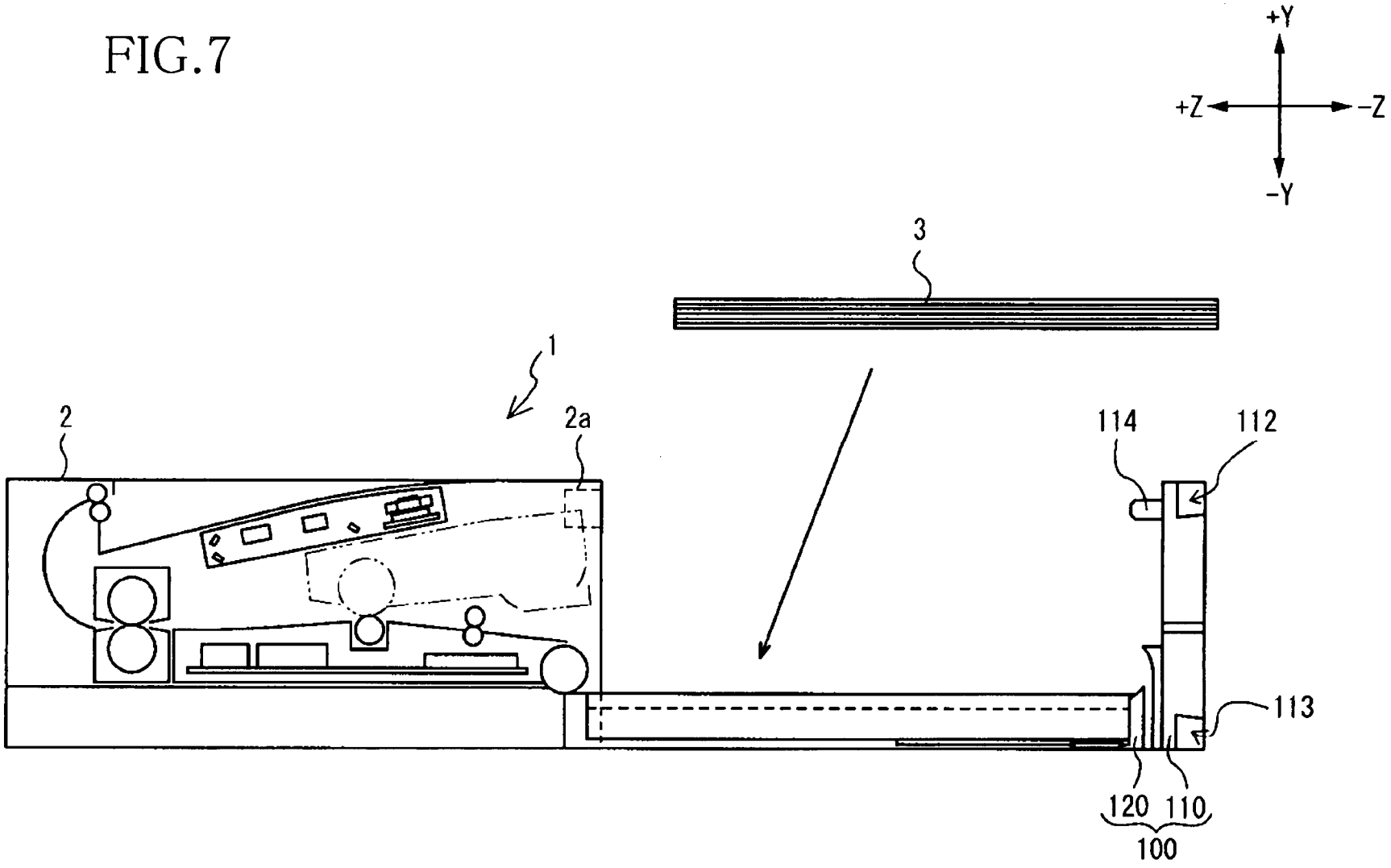
FIG. 7 is a sectional view showing the cassette with a cover 100 pulled open for the replenishment of sheets 3.
Figure 8:
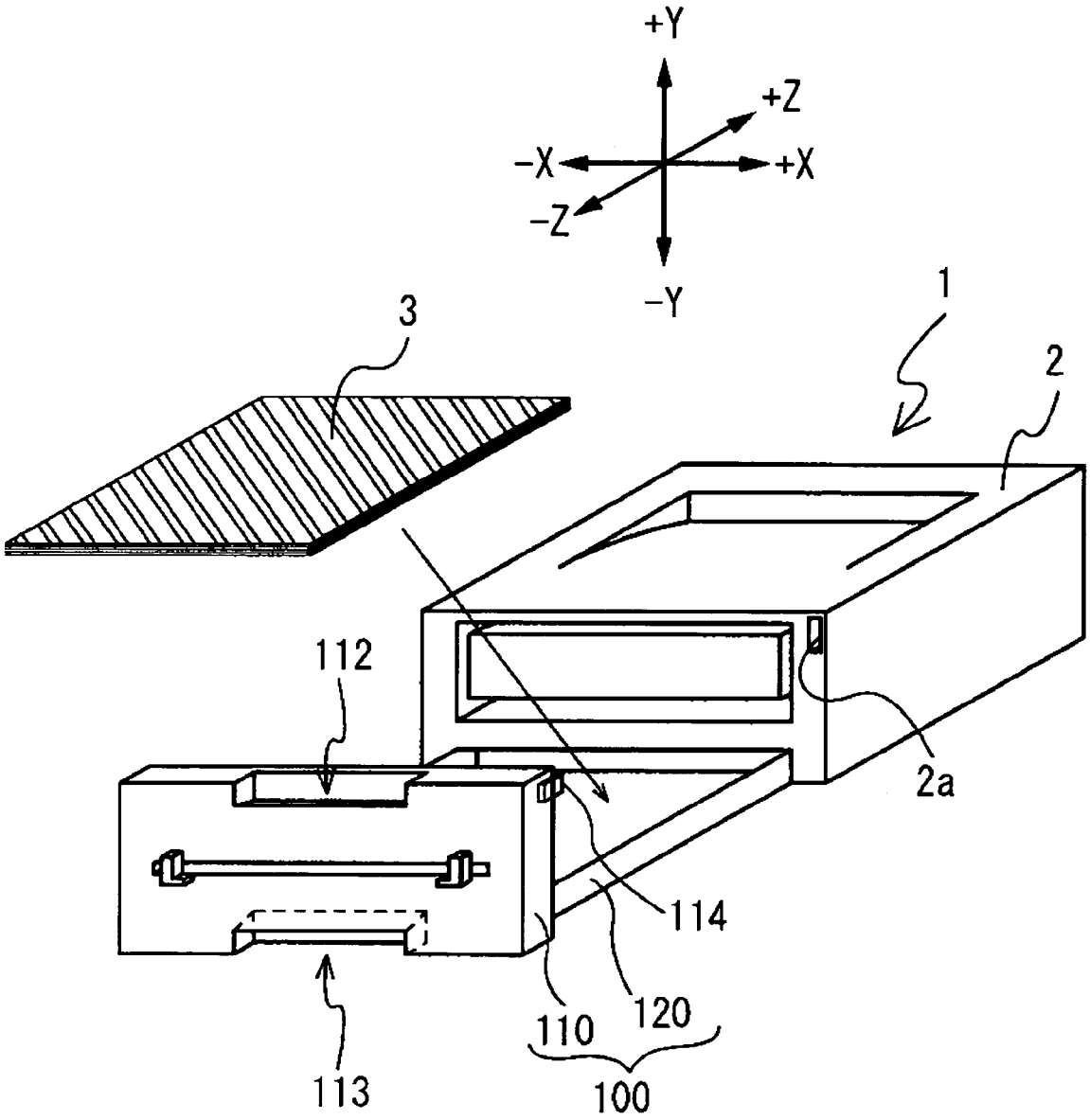
FIG. 8 is a perspective view showing the cassette with a cover 100 pulled open for the replenishment of sheets 3.
Figure 9:
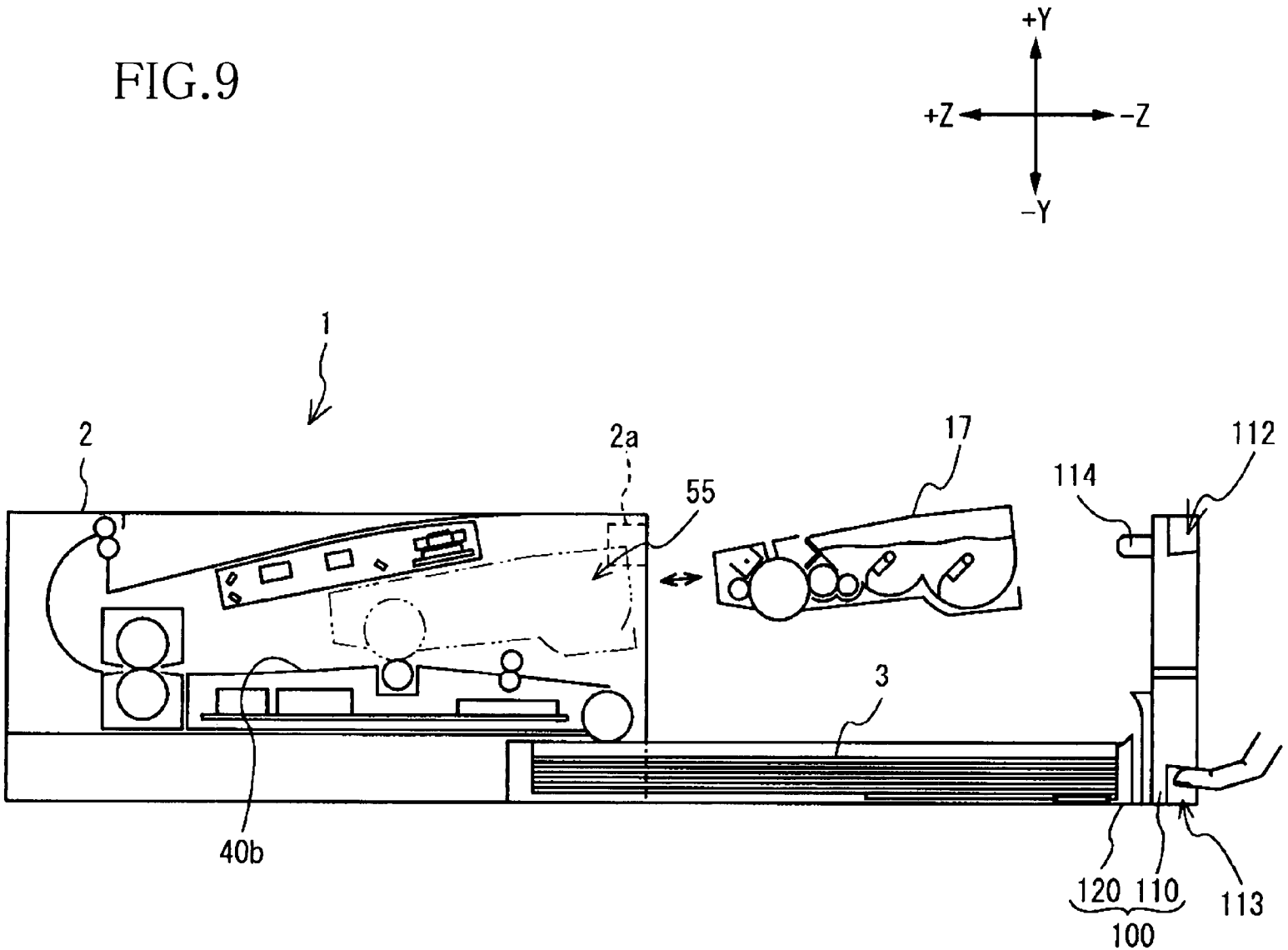
FIG. 9 is a sectional view showing the cassette with a cover 100 pulled open for the attachment of a process cartridge 17.
Figure 10:
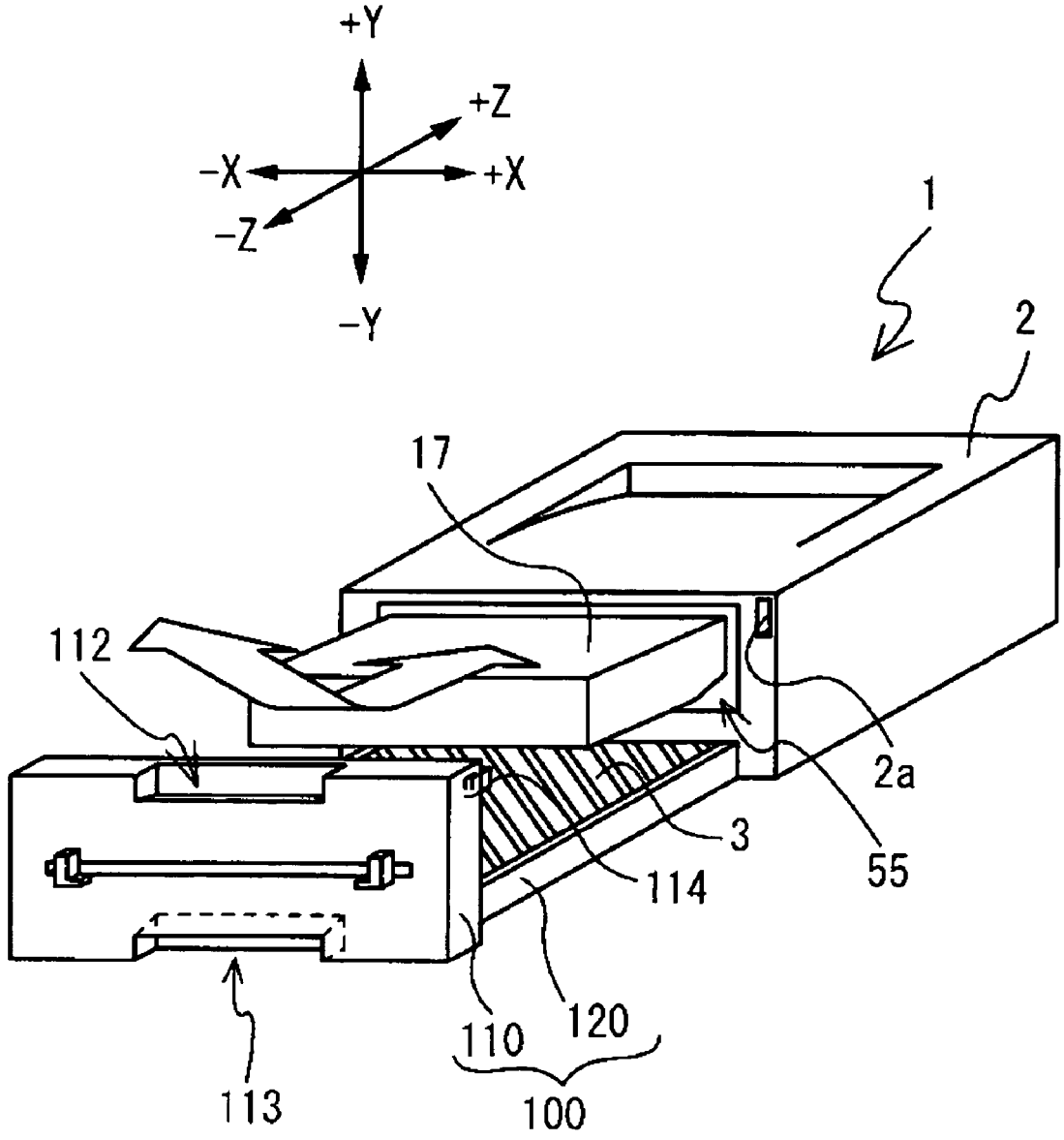
FIG. 10 a perspective view showing the cassette with a cover 100 pulled open for the attachment of the process cartridge 17.

With reference to FIGS. 7 to 10, replenishment of sheets 3 and insertion and removal of the process cartridge 17 in the laser printer 1 will be described. FIG. 7 is a sectional view of the laser printer 1 where the cassette with cover 100 is pulled out from the main body 2 for the replenishment of sheets 3. FIG. 8 is a perspective view of the laser printer 1 where the cassette with cover 100 is pulled out from the main body 2 for the replenishment of sheets 3. FIG. 9 is a sectional view of the laser printer 1 where the cassette with cover 100 is pulled out from the main body 2 for insertion and removal of the process cartridge 17. FIG. 10 is a perspective view of the laser printer 1 where the cassette with cover 100 is pulled out from the main body 2 for insertion and removal of the process cartridge 17.

As shown in FIGS. 7 and 8, when sheets 3 are put in the cassette portion 120, the cassette with cover 100 is pulled out from the main body 2 to expose the cassette portion 120. As described above, the cassette portion 120 is supported on the inner walls on both sides of the main body 2, and the cassette with cover 100 can be pulled out when the user adds sufficient power against a cassette holding power of the stoppers 2*b* (FIG. 3) in the −Z direction. The user may take a grip on either of the holding portions 112, 113 to pull the cassette with cover 100. The cassette portion 120 is exposed, thereby sheets 3 are placed. When the cassette with cover 100 is pulled out, the light receiving portion of the photo sensor 2*a* receives light, which has been blocked by the shutter plate 114, and the cassette with cover 100 in the open position is detected. When the cassette with cover 100 is moved in the +Z direction until the cassette portion 120 is temporarily locked such that the stoppers 2*a* are fitted in the recessed portions 125, the shutter plate 114 of the cover portion 110 interrupts the light of the photo sensor 2*a* of the main body 2, and the cassette with cover 100 in the closed position is detected.

When the insertion and removal of the process cartridge 17 is performed as shown in FIGS. 9 and 10, the cassette with cover 100 is pulled out as with the case when sheets 3 are replenished. As described above, the user takes a grip on either of the holding portions 112, 113 to pull the cassette with cover 100, such that the cassette portion 120 is exposed. When the cover portion 110 combined with the cassette portion 120 is separated from the main body 2, the opening for the storing portion 55 is open. The photo sensor 2*a* detects that the opening for the storing portion 55 is open. When the cassette with cover 100 is pulled out such as to provide a distance greater than the size of the process cartridge 17 between the cover portion 110 and the main body 2, the insertion and removal of the process cartridge 17 can be performed. As described above, when the cassette with cover 100 is attached to the main body 2, the photo sensor 2*a* detects that the opening for the storing portion 55 is closed.

Figure 11:
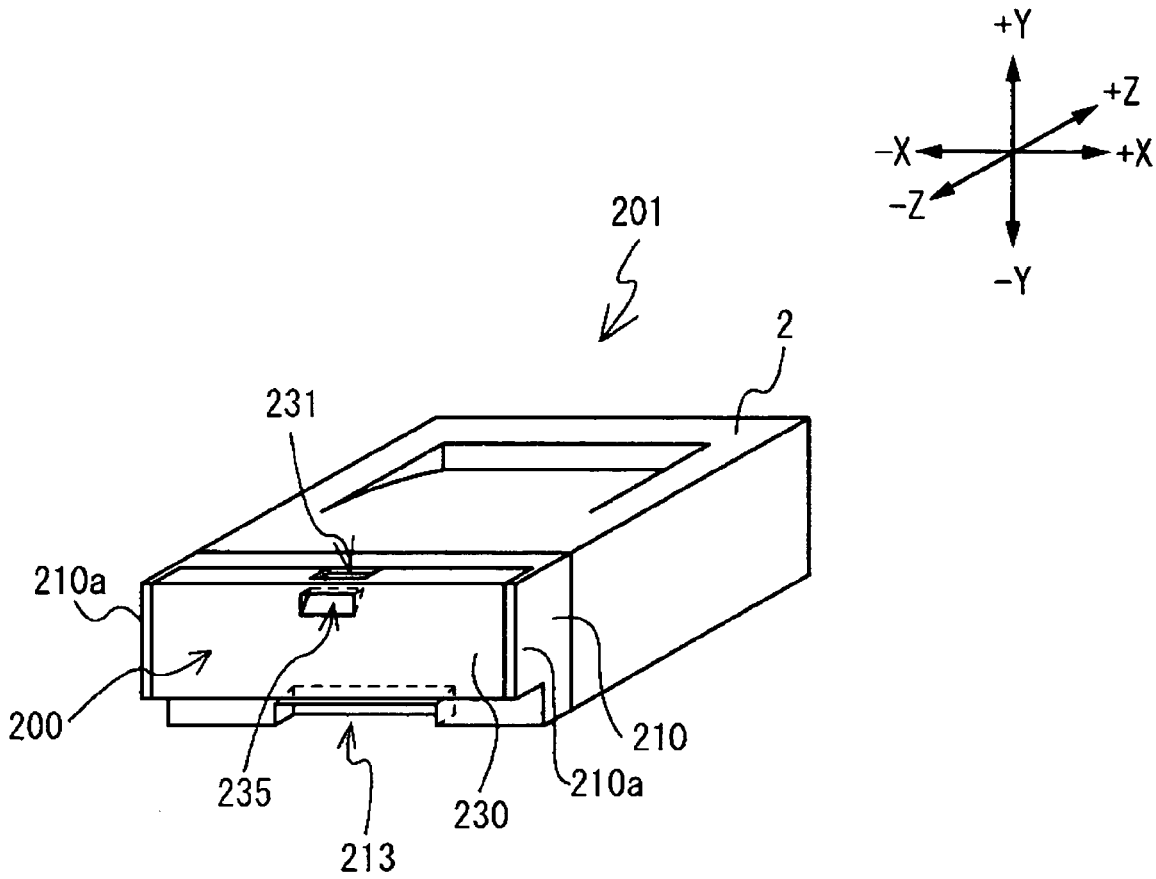
FIG. 11 is a perspective view showing an appearance of a laser printer 201 according to of the invention.
Figure 12:
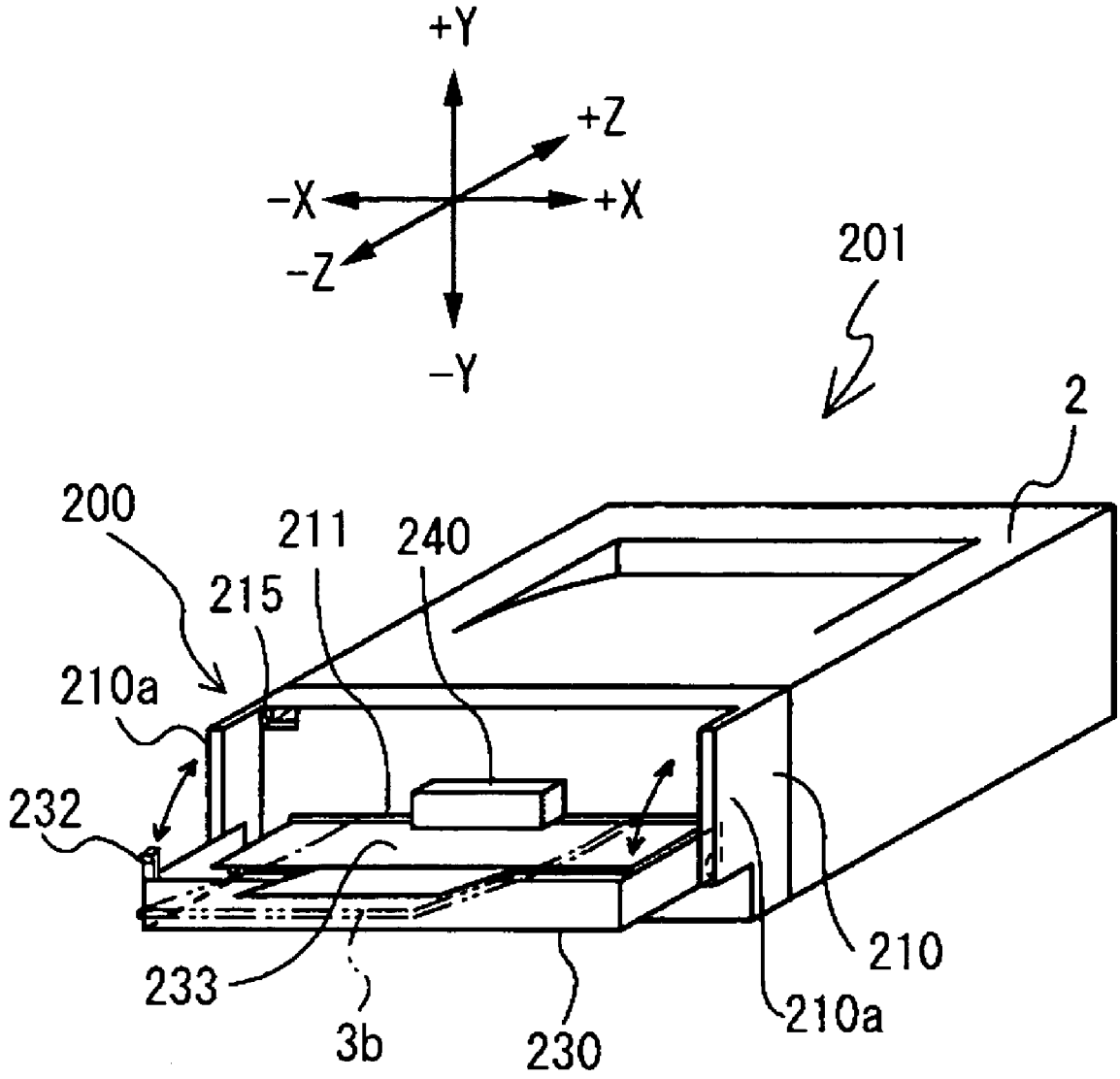
FIG. 12 is a perspective view showing a tray 230 of the laser printer 201 opened.
Figure 13:
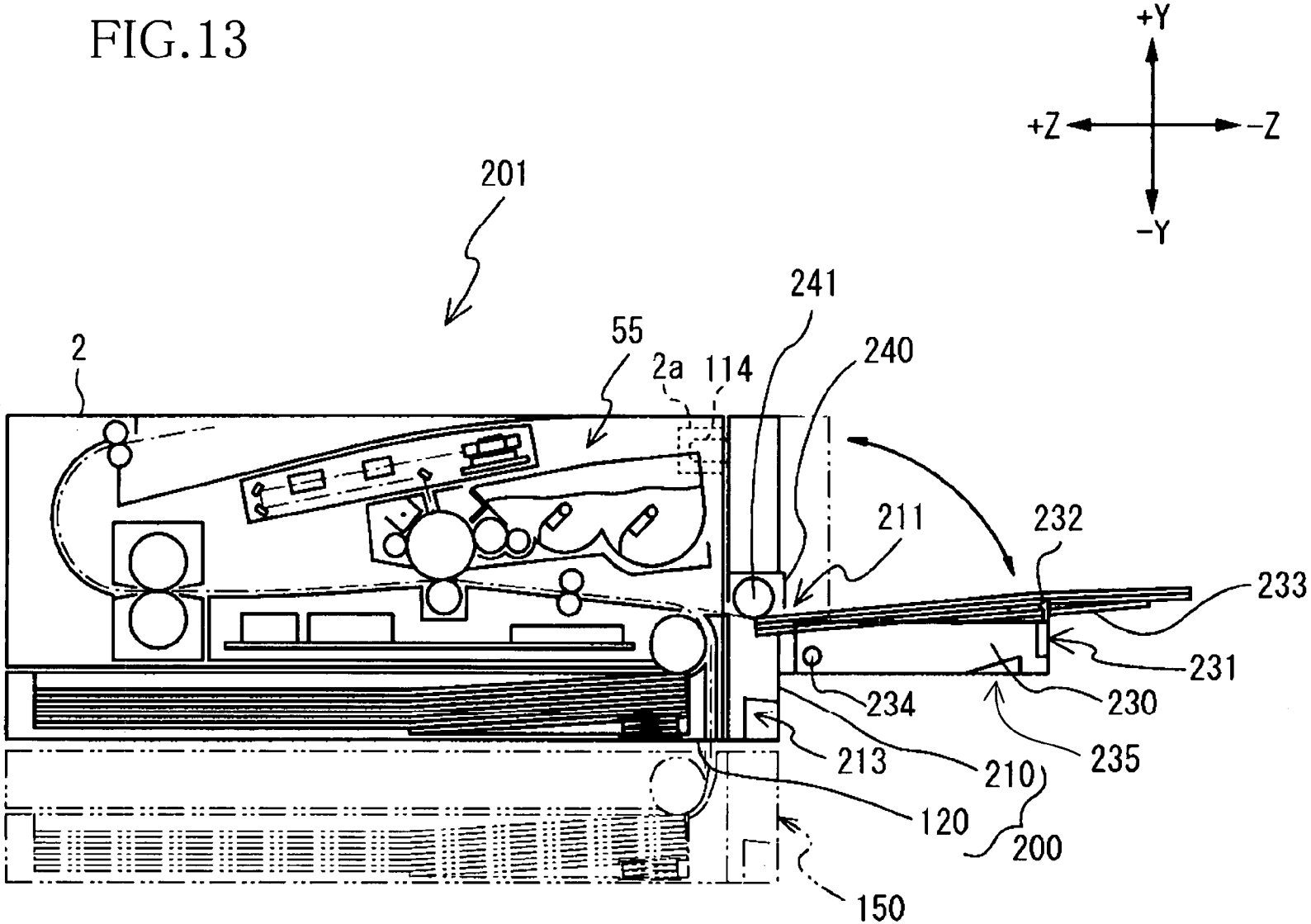
FIG. 13 is a sectional view of a general structure of the laser printer 201 according to the invention.
Figure 14:
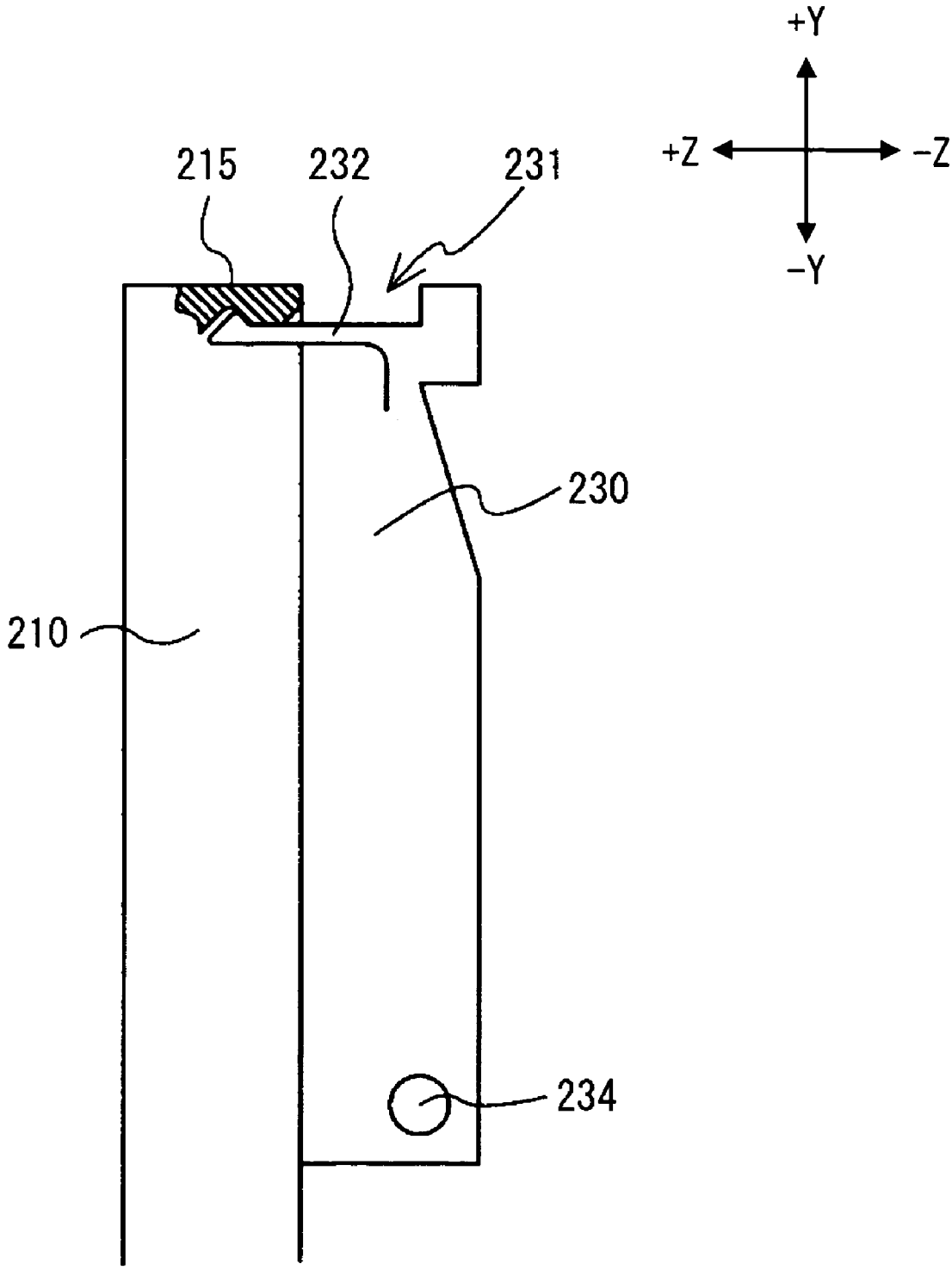
FIG. 14 is a sectional view showing a structure of a locking mechanism of the tray 230.
Figure 15:
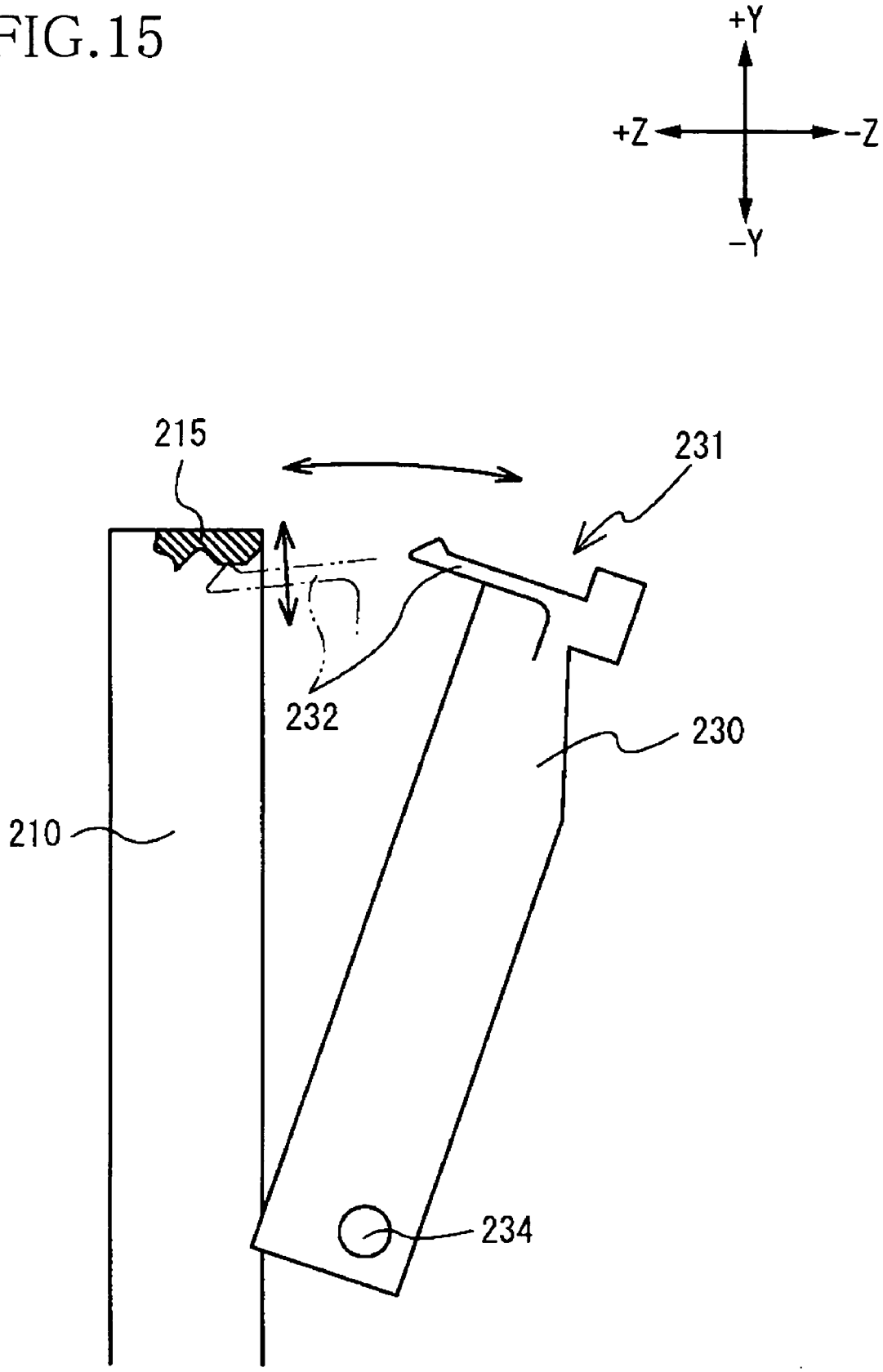
FIG. 15 is a sectional view showing the structure of the locking mechanism of the tray 230.

A second embodiment of an image forming apparatus in which the invention is embodied will be described will be described. First, an entire structure of a laser printer 201, which is an example of the image forming apparatus of the second embodiment, will be described with reference to FIGS. 11 to 15. FIG. 11 is a perspective view showing an appearance of the laser printer 201 according to the second embodiment. FIG. 12 is a perspective view of the laser printer 201 where a tray 230 is in the open position. FIG. 13 is a sectional view showing a schematic structure of the laser printer 201. FIG. 14 is a sectional view of a locking mechanism of the tray 230. FIG. 15 is a sectional view of a locking mechanism of the tray 230.

As shown in FIG. 11, the laser printer 201 includes a cover portion 210, which is similar to the cover portion 110 of the laser printer 1, an openable tray 230, and a paper feed unit 240 (FIG. 12). When viewed from the front, a holding portion 213, employed for the opening and closing of the cover portion 210, is provided at a central lower end portion of the cover portion 210. Sidewalls on both sides of the cover portion 210 (in the X-axis direction) are provided as tray holding portions 210*a* each extending frontward except for the lower part. The tray 230 in the closed state is held between the tray holding portions 210 such that its front (XY plane) is substantially parallel to the front of the cover portion 210. A holding portion 235 (described later) is provided at a central upper end portion of the front surface of the tray 230. A holding portion 231 is provided in a central portion of the top surface of the tray 230 in alignment with the top surface of the laser printer 201 close to the holding portion 235. The holding portion 231 is designed to allow a user to take a grip to open the tray 230, which rotates about a shaft 234 (FIG. 13), downward.

As shown in FIG. 12, when the tray 230 is in the open position, a slit opening 211 provided in the cover portion 210 is exposed. A tray 233 is provided inside the tray 230. The tray 233 is an extendable tray to place sheets 3*b* for single-sheet manual feed thereon. The paper feed unit 240 is provided at a central portion above the slit opening 211. A lock tab 232 protrudes inwardly at an upper left corner of the tray 230, and engages in a lock tab engagement portion 215 provided around an upper left corner of the cover portion 210, when the tray 230 is closed. The lock tab 232 and the lock tab engagement portion 215 in engagement with each other are constituted as a locking mechanism (FIGS. 14 and 15).

As shown in FIG. 13, as is the case with the cover portion 110, the cover portion 210 is fixed to the front of the cassette portion 120. The cassette portion 120 and the cover portion 210 constitute a cassette with cover 200. The cover portion 210 is brought in or out of contact with the main body 2 in accordance with the movement of the cassette 120 in the front to back direction (in the Z-axis direction), thereby opening and closing the opening to the storing portion 55, as with the first embodiment.

The shaft 234 to be engaged in a shaft hole (not shown) of the tray 230, protrudes from the tray holding portion 210*a* on each side of the cover portion 210 at a position close to the lower end portion. The tray 230 is pivoted about the shaft 234 such as to open and close the slit opening 211. When the tray 230 is in the open position, the tray 233 can be extended in the −Z direction. At this time, an end portion of the tray 233 facing toward the +Z direction is connected to the slit opening 211 and the sheets 3*b* placed on the tray 233 are ready to be inserted into the slit opening 211.

The paper feed unit 240 is provided above the slit opening 211 and structured such as to drive a paper feed roller 241, during printing, to feed the sheets 3*b* placed on the tray 233 into the slit opening 211. The force to drive the paper feed roller 241 is transmitted from the main body 2. A mechanism for transmitting a driving force will be described later.

When the tray 230 is closed, it is maintained in the close state by the locking mechanism. As shown in FIG. 14, when the openable tray 230, which is pivoted about the shaft 234, is closed, the lock tab 232 engages in the lock tab engagement portion 215 provided in the cover portion 210. As shown in FIG. 15, when opening or closing the tray 230, the user takes a grip on the holding portion 231 and moves in the −Z direction. At this time, the lock tab 232, being flexible, is deformed along the shape of the lock tab engagement portion 215, and the restoring force of the deformed lock tab 232 becomes stressed, so that the tray 230 is maintained in the closed position in engagement with the lock tab engagement portion 215, as shown in FIG. 14.

When the tray 230 is opened, a component of force in the Z-axis direction that is required to maintain the lock tab 232 in the current state shown in FIG. 13 is set smaller than a component of force in the Z-axis direction of the cassette holding power against the cassette with cover 200, which is positioned and temporarily fixed in the main body 2 by the cassette portion 120. In other words, the cassette with cover 200 will not be opened nor closed by the opening and closing of the tray 230. Although the lock tab 232 is a flexible projection, an urging member such as a spring may be used instead, as with the case of temporarily fixing the cassette portion 120.

Other mechanisms and printing operation in the laser printer 201 are similar to those in the laser printer 1, and the lower cassette 150 can be attached to the bottom of the laser printer 201.

Figure 16:
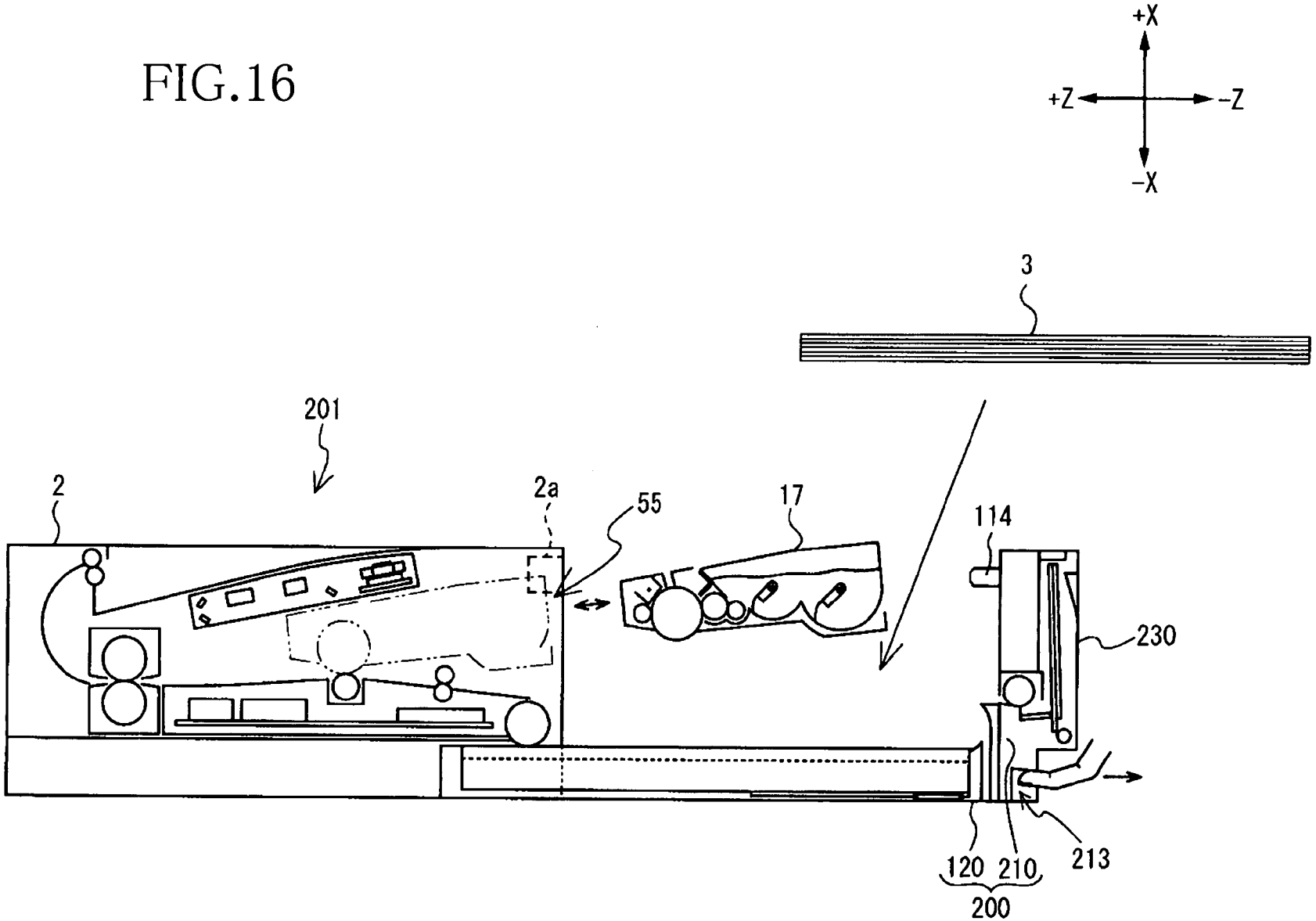
FIG. 16 is a sectional view showing a cassette with a cover 200 pulled open.
Figure 17:
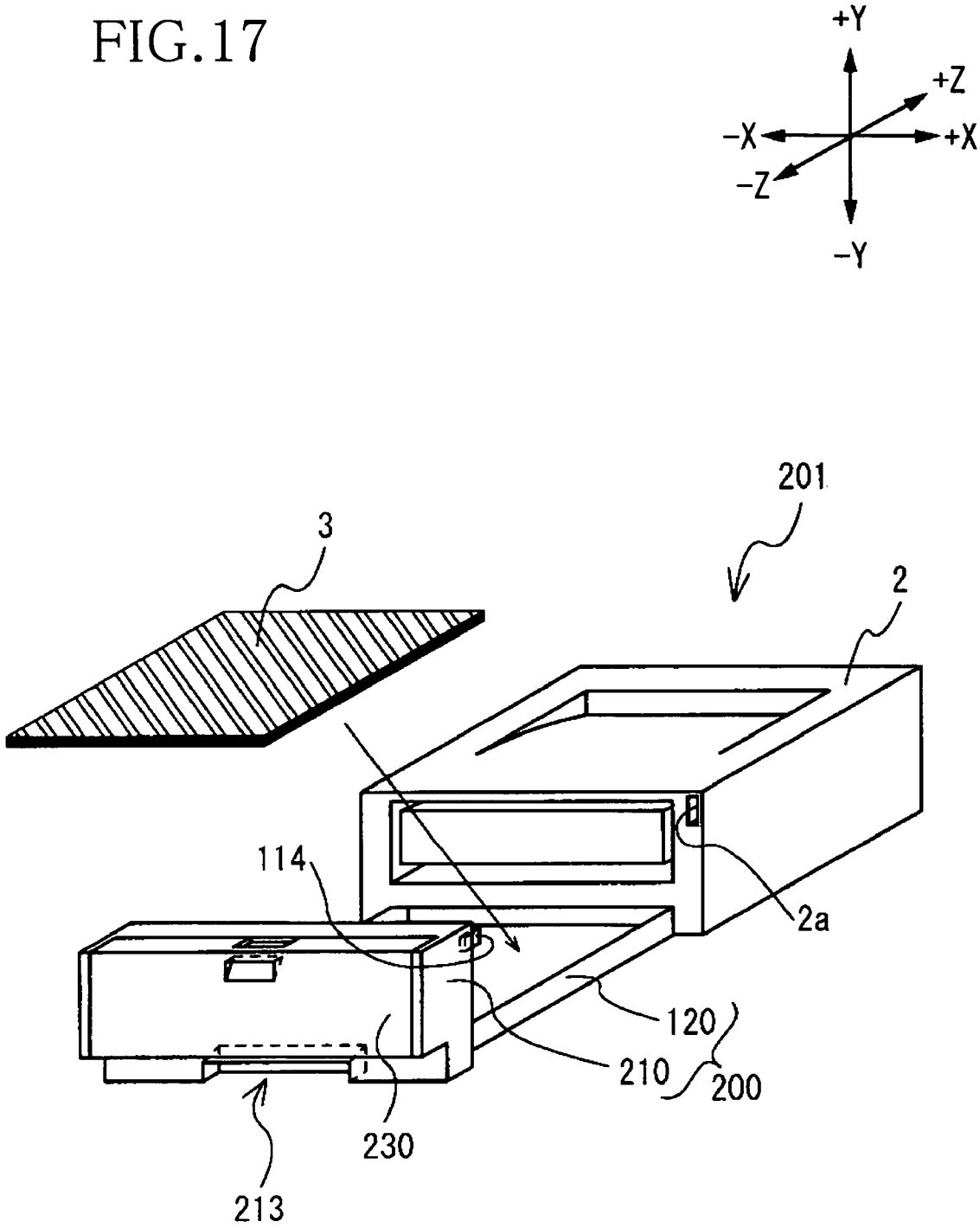
FIG. 17 is a perspective view showing the cassette with a cover 200 pulled open for the replenishment of sheets 3.
Figure 18:
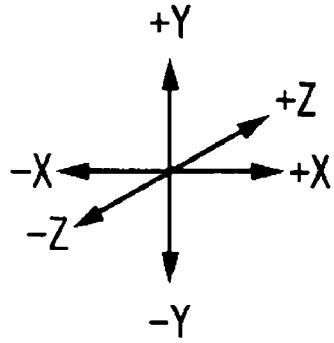
FIG. 18 is perspective view showing the cassette with a cover 200 pulled open for the attachment of the process cartridge 17.
Figure 18:
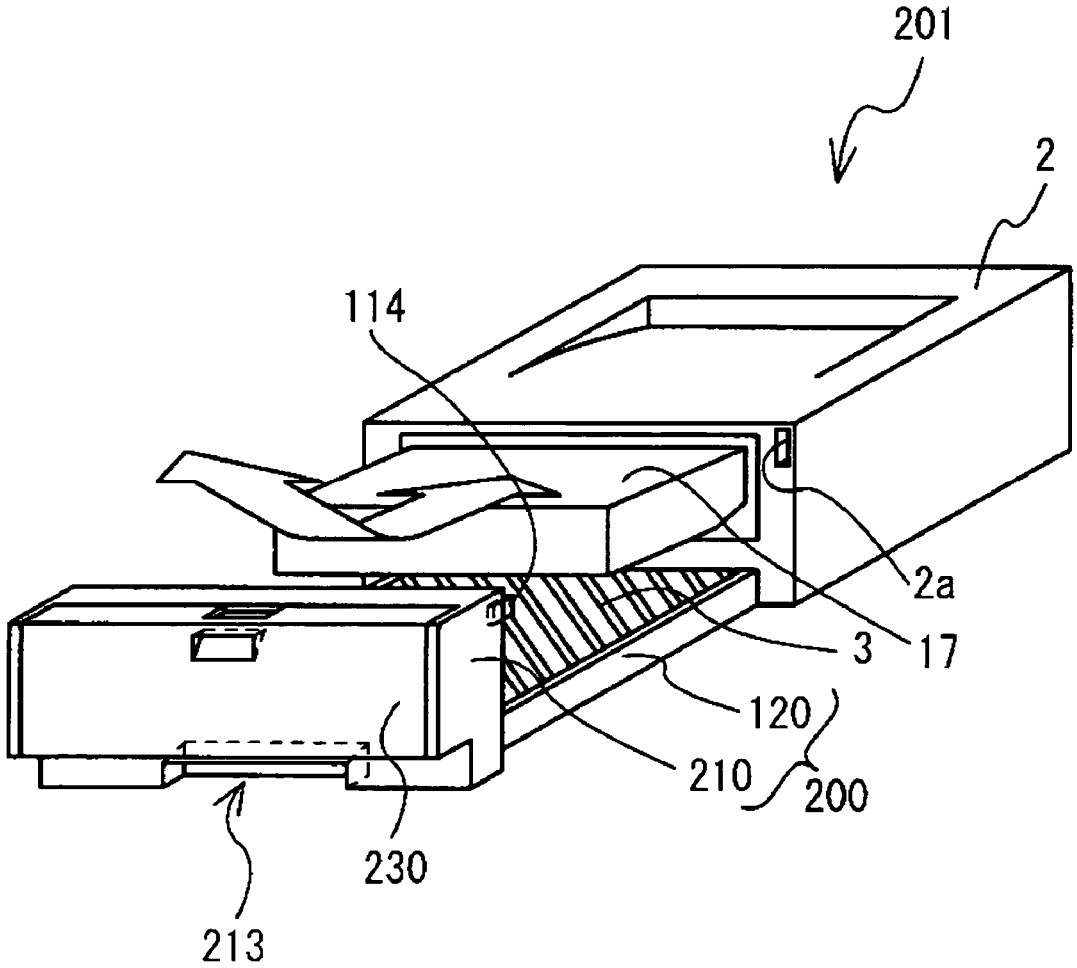
Figure 19:
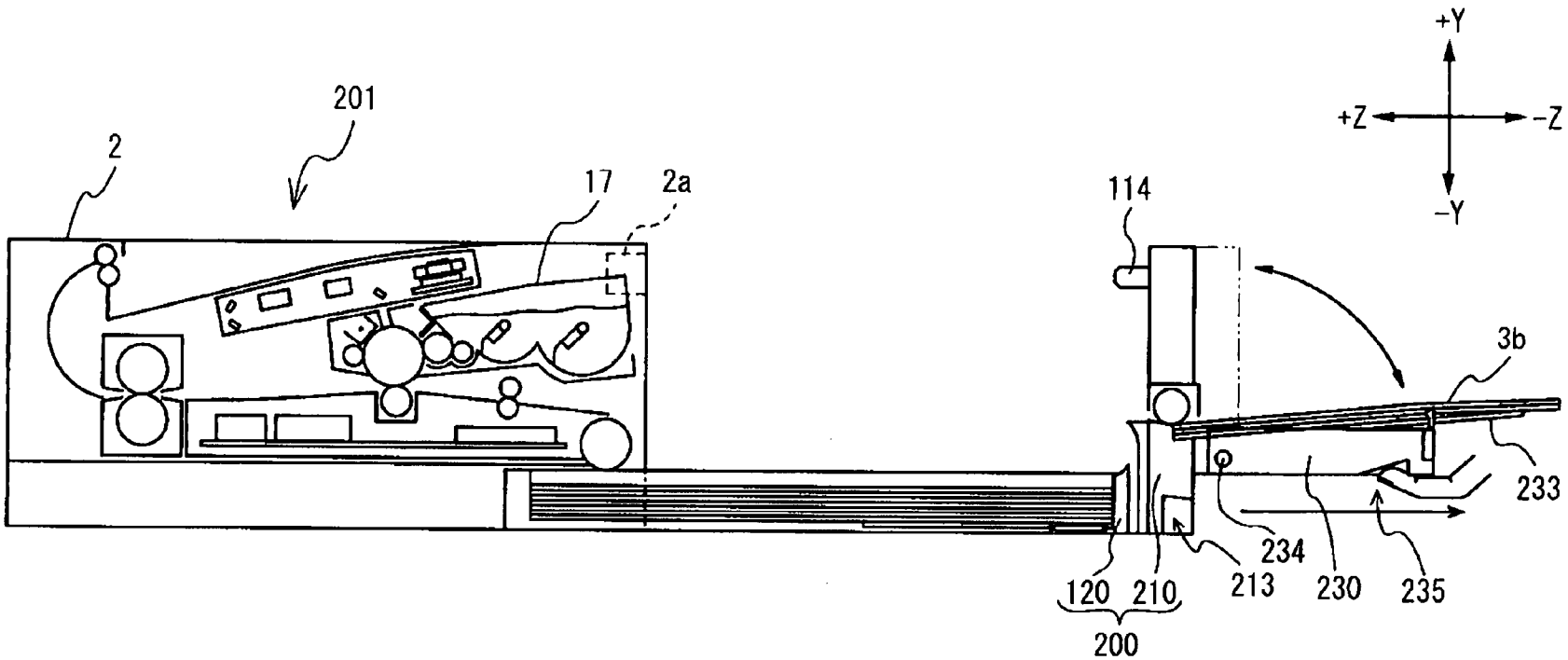
FIG. 19 is a sectional view showing a cassette with a cover 200 pulled open with the tray 230 remaining open.
Figure 20:
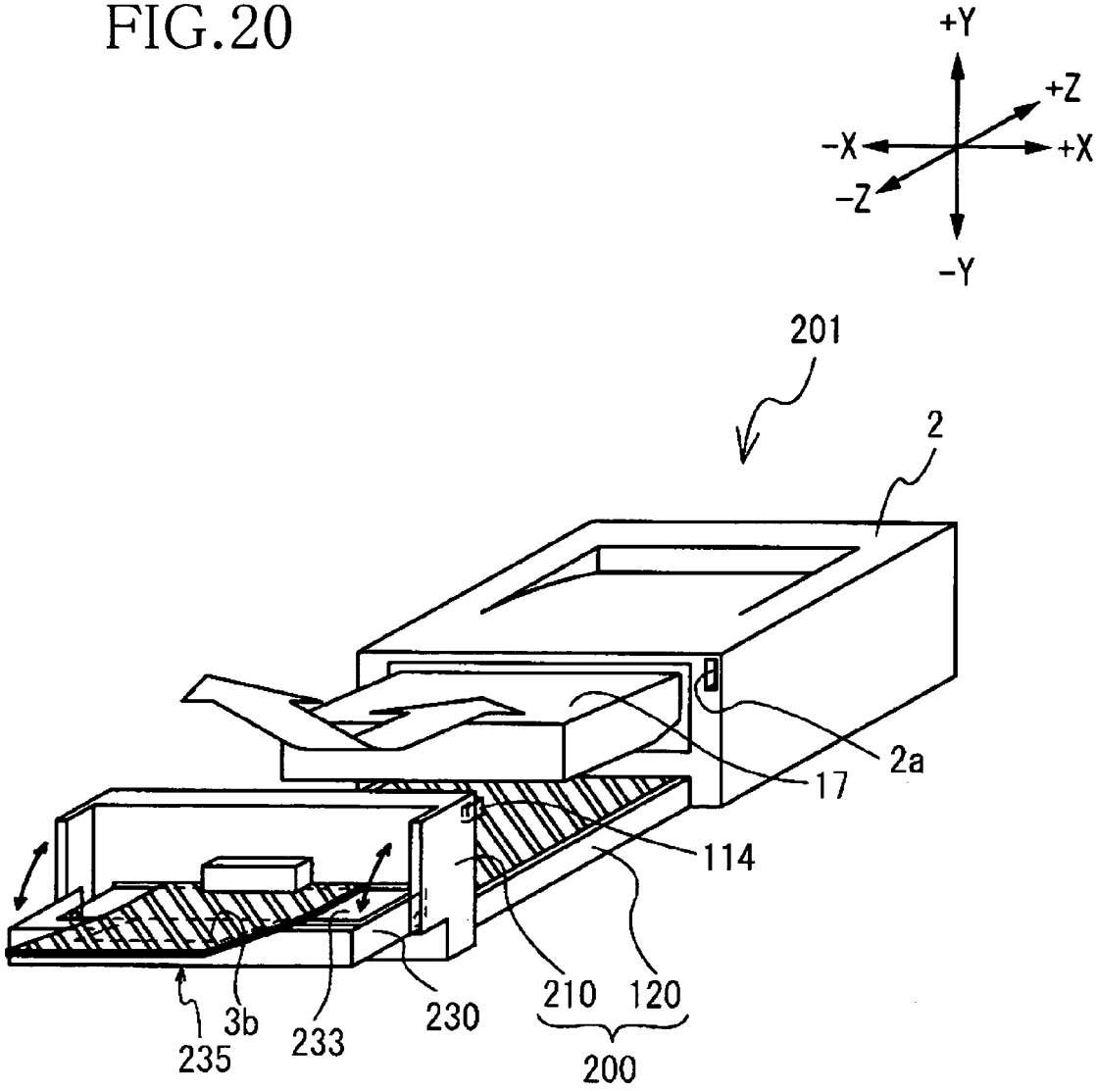
FIG. 20 is a perspective view showing a cassette with a cover 200 pulled open with the tray 230 remaining open.

With reference to FIGS. 16 to 20, replenishment of sheets 3 and insertion and removal of the process cartridge 17 in the laser printer 201 will be described. FIG. 16 is a sectional view of the laser printer 201 where the cassette with cover 200 is pulled out from the main body 2 for the replenishment of sheets 3. FIG. 17 is a perspective view of the laser printer 201 where the cassette with cover 200 is pulled out from the main body 2 for the replenishment of sheets 3. FIG. 18 is a perspective view of the laser printer 201 where the cassette with cover 200 is pulled out from the main body 2 for the insertion and removal of the process cartridge 17. FIG. 19 is a sectional view of the laser printer 201 where the cassette with cover 200 is pulled out from the main body 2 for the insertion and removal of the process cartridge 17. FIG. 20 is a perspective view of the laser printer 201 where the cassette with cover 200 is pulled out from the main body with the tray 230 open.

As shown in FIGS. 16 to 18, when the sheets 3 are put in the cassette portion 120 or the process cartridge 17 is inserted in the main body 2, the user pulls the cassette with cover 200 out from the main body 2 of the laser printer 201 in the −Z direction by the holding portion 213 provided at the lower edge of the cover portion 120. When the sheets 3 are put in the cassette portion 120, the cassette with cover 100 is pulled out from the main body 2 to expose the cassette portion 120. When the cassette with cover 200 is pulled out, the opening to the storing portion 55 for the process cartridge 17 is also released. As in the case of the above description, when the cassette with cover 200 is pulled out such as to provide a distance greater than the size of the process cartridge 17 between the cover portion 210 and the main body 2, the insertion and removal of the process cartridge 17 can be performed without interference of the cover portion 210. In addition, when the cassette with cover 200 is attached to and detached from the main body 2 as described above, the photo sensor 2*a* detects the state of the cassette with cover 200.

As shown in FIGS. 19 and 20, in the laser printer 201, it is possible to pull the cassette with cover 200 out even with the tray 230 open. When the tray 230 is closed, the cassette with cover 200 is pulled out by holding the holding portion 213. However, when the tray 230 is open, the holding portion 213 is located to the rear beneath the tray 230 and it is difficult to take a grip on the holding portion 213. However, as the holding portion 235 provided at the upper end of the front of the tray 230 is located at the forward end of the laser printer 201, there is no problem regarding the holding of the cassette with cover 200. Thus, when the user holds the holding portion 235 and pulls the cassette with cover 200 in the Z-axis direction, the cover portion 210 is pulled via the shaft 234, and the cassette portion 120, which is integral with the cover portion 210, is pulled. That is, the cassette with cover 200 can be pulled out.

Figure 21:
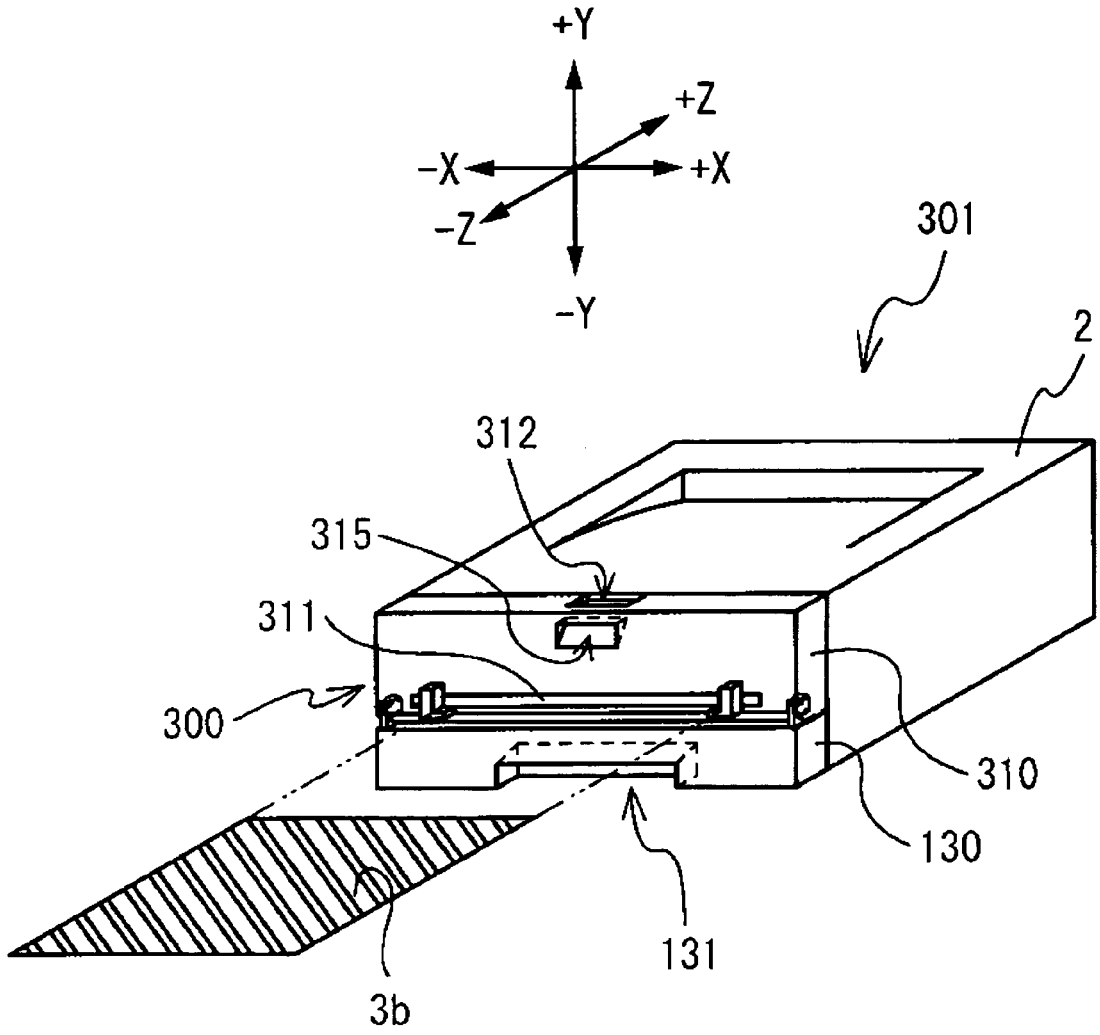
FIG. 21 is a perspective view showing an appearance of a laser printer 301 according to the invention.
Figure 22:
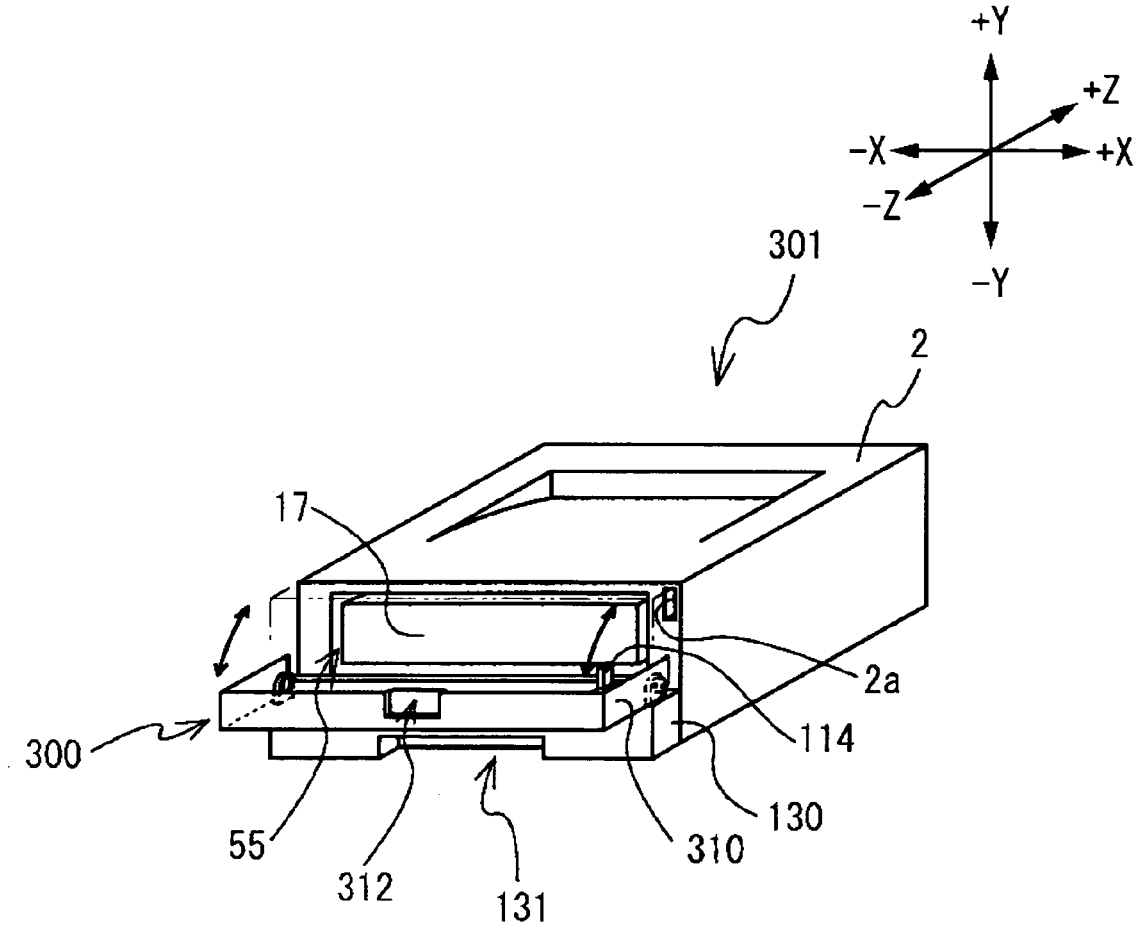
FIG. 22 is a perspective view of a cover portion 310 of the laser printer 301 opened according to the invention.
Figure 23:
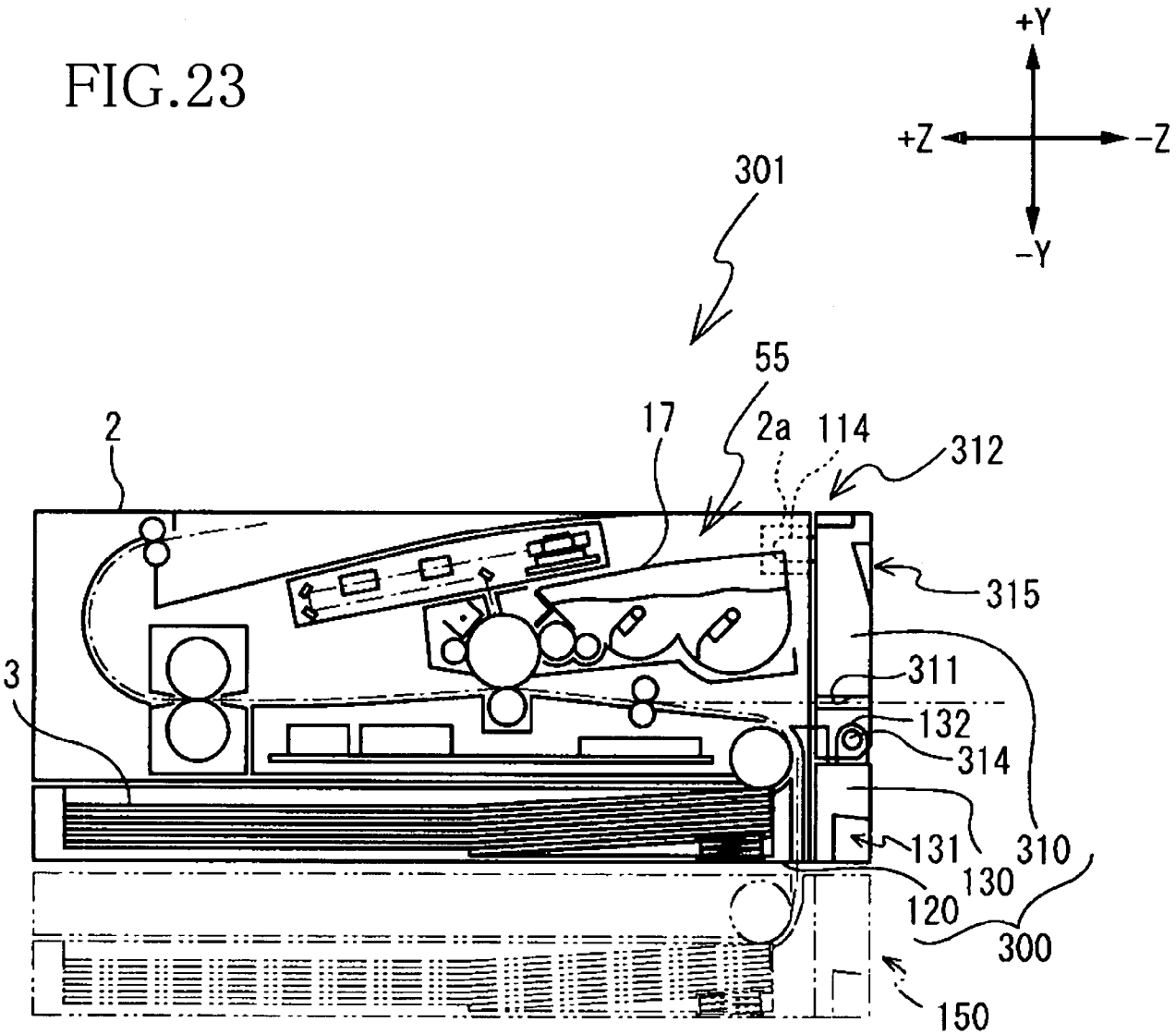
FIG. 23 is a sectional view of a general structure of the laser printer 301 according to the invention.
Figure 24:
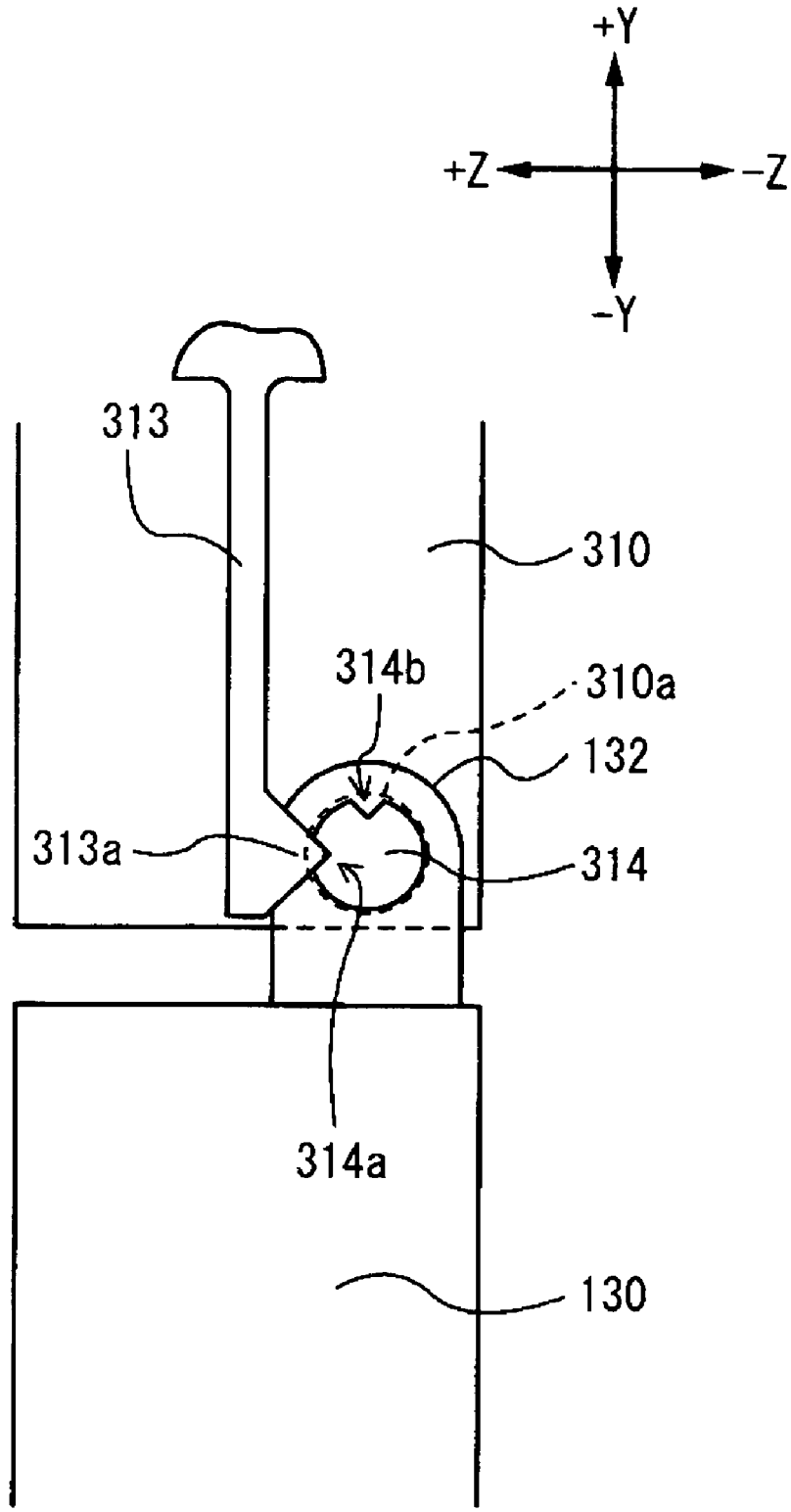
FIG. 24 is a sectional view of a locking mechanism of the cover portion 310.
Figure 25:
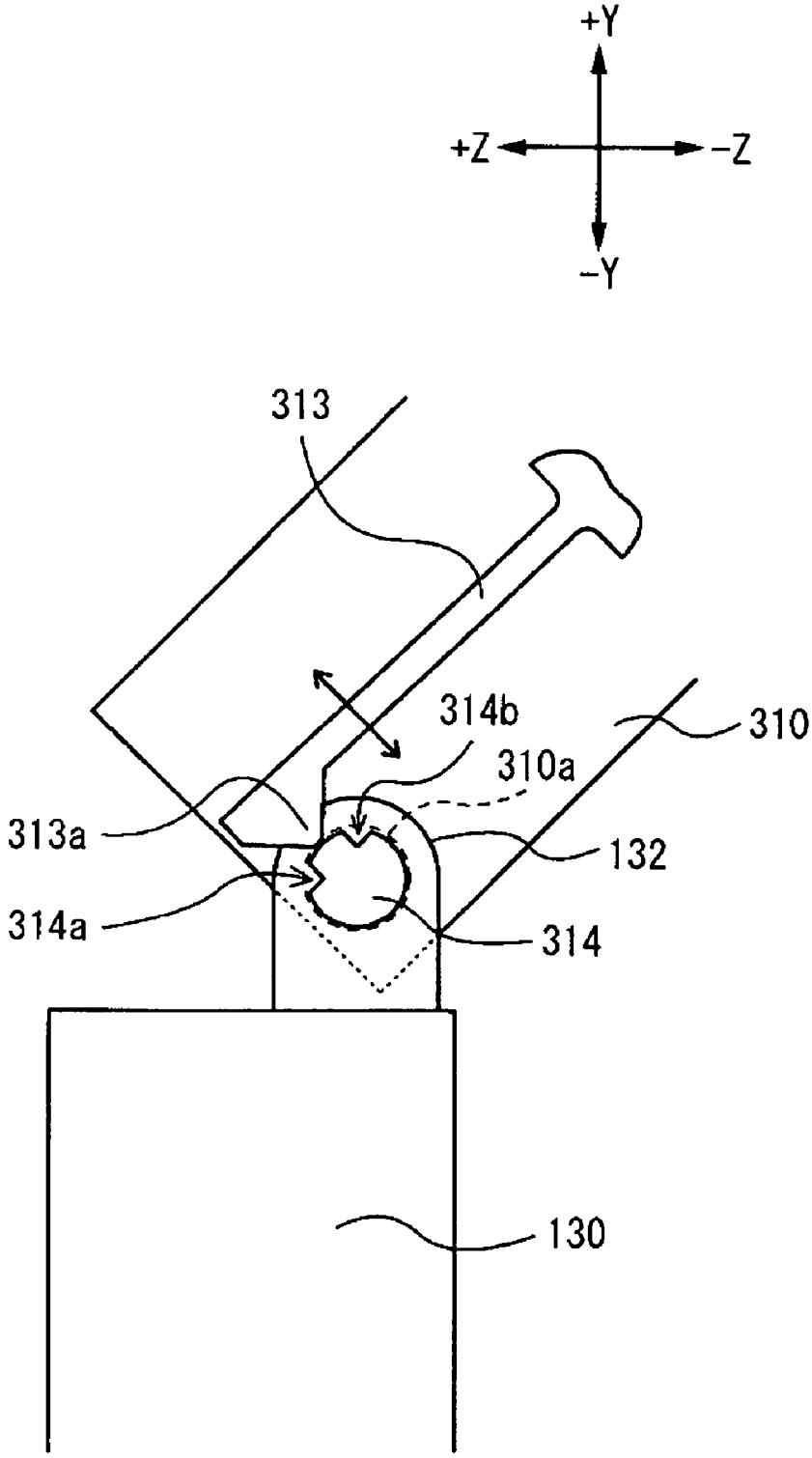
FIG. 25 is a sectional view of the locking mechanism of the cover portion 310.
Figure 26:
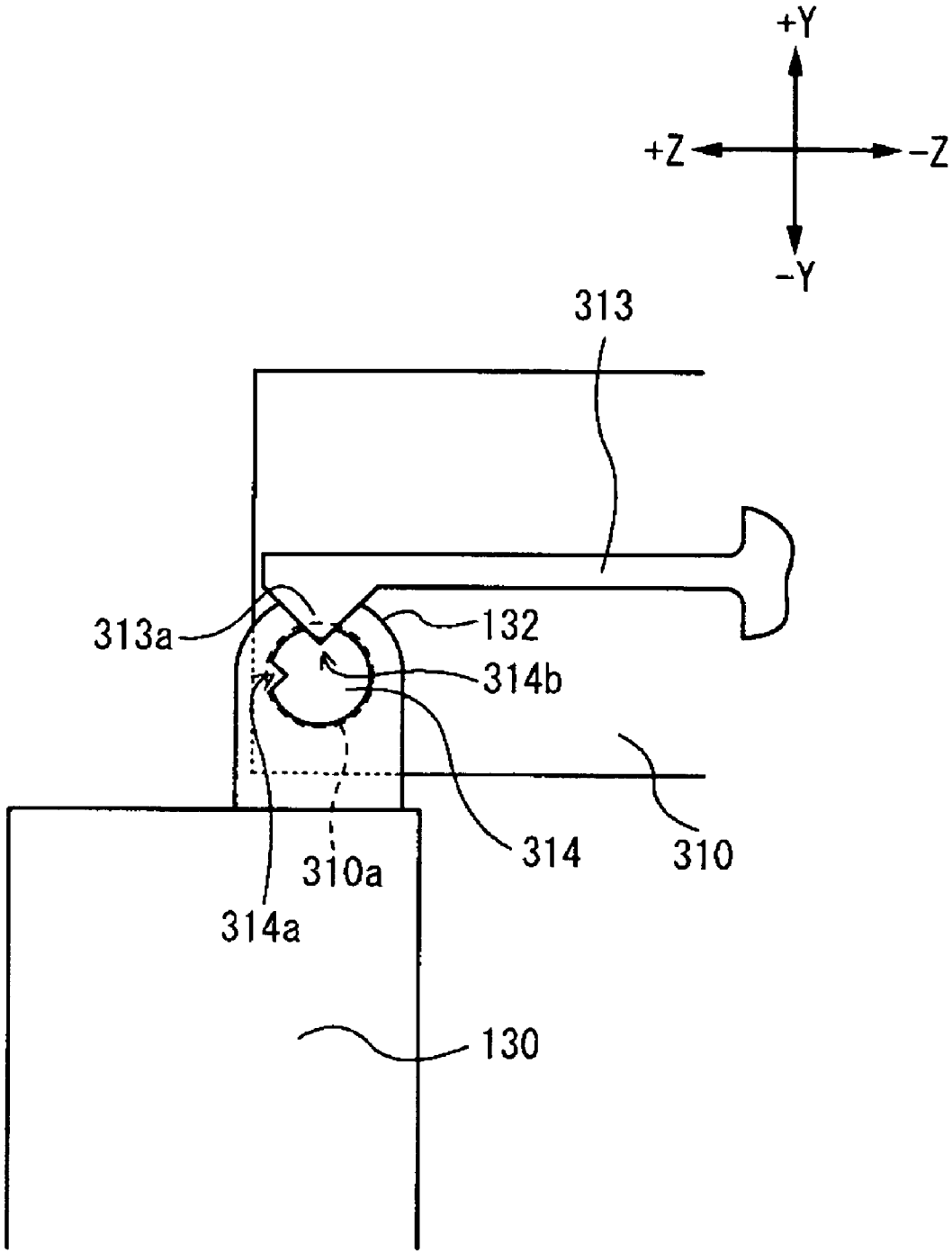
FIG. 26 is a sectional view of the locking mechanism of the cover portion 310.

A third embodiment of an image forming apparatus in which the invention is embodied will be described. First, an entire structure of a laser printer 301, which is an example of the image forming apparatus of the third embodiment, will be described with reference to FIGS. 21 to 23. FIG. 21 is a perspective view showing an appearance of the laser printer 301 according to the third embodiment. FIG. 22 is a perspective view of the laser printer 301 where a cover portion 310 is open. FIG. 23 is a sectional view showing a schematic structure of the laser printer 301. FIG. 24 is a sectional view of a locking mechanism of the cover portion 310. FIG. 25 is a sectional view of the locking mechanism of the cover portion 310. FIG. 26 is a sectional view of the locking mechanism of the cover portion 310.

As shown in FIG. 21, in the laser printer 301, the cover portion 310 that blocks the opening to the storing portion 55 (FIG. 23) is placed above a front face plate 130, which is a cosmetic plate located at the front of the cassette portion 120 (FIG. 23), which is identical to the one used in the first and second embodiments. The cover portion 310 is supported to the front face plate 130 such as to be openable and closable. When viewed from the front, a holding portion 131, which is employed for opening and closing the cassette portion 120, is provided at a central portion of a lower end of the front face plate 130. A slit opening 311, which is a long narrow opening from side to side for inserting a single sheet 3*b* for manual feed printing, is provided at a lower end portion of the cover portion 310, as with the case of the first embodiment. A holding portion 315 (described later) is provided at a central portion of an upper end of the cover portion 310. A holding portion 312 is provided at a central portion of the top surface of the cover portion 310 in alignment with the top surface of the laser printer 301 close to the holding portion 315. The holding portion 312 is designed to allow a user to take a grip when opening the cover portion 310, which pivots about a shaft 314 (FIG. 23), downward.

As shown in FIG. 22, when the cover portion 310 is open, the opening to the storing portion 55 for the process cartridge 17 is released. The shaft 314 (FIG. 23) to be engaged in a shaft hole 310*a* (FIG. 24) in the cover portion 310 is provided with a locking mechanism to prevent accidental opening and closing of the cover portion 310. The locking mechanism of the cover portion 310 will be described later.

As shown in FIG. 23, the front face plate 130 as a cosmetic plate is fixed to the front of the cassette portion 120. A length of the front face plate 130 in a top to bottom direction (the Y-axis direction) is slightly greater than a thickness of the cassette portion 120. The front face plate 130 includes supporting portions 132 protruding upwardly from both ends (which are both ends with respect to a left to right direction of the laser printer 301). The shaft 314, which is inserted into the shaft hole 310*a* (FIG. 24) of the cover portion 310, protrudes from each of the supporting portions 132. Thereby, the cover portion 310 is rotatable at an upper portion of the front face plate 130. When the user takes a grip on the holding portion 312 and moves it downward, the opening to the storing portion 55 for the process cartridge 17 is released.

For manual feed printing, a single sheet 3*b* (FIG. 21) is inserted into the slit opening 311 provided above the shaft 314 in the cover portion 310, as is the case with the slit opening 111 in the first embodiment.

When the storing portion 55 is open or closed with the movement of the cover portion 310, the open state and close state of the cover portion 310 is maintained by the locking mechanism. As shown in FIG. 24, the locking mechanism of the cover portion 310 is made up of the shaft 314 to be engaged in the shaft hole 310*a* in the cover portion 310 and a lock rod 313 fixed to the cover portion 310 at one end. The shaft 314 is provided with two notches 314*a*, 314*b*. When the cover portion 310 is closed, a protrusion 313*a* provided at the other end of the lock rod 313 is engaged in the notch 314*a*.

As shown in FIG. 25, when the cover portion 310 is opened, the engagement between the protrusion 313*a* of the lock rod 313 that is fixed to the cover portion 310 and the notch 314*a* that is moved relative to the cover portion 310 is released, the protrusion 313*a* abuts against the circumference of the shaft 314, and the lock rod 313 is flexed. As shown in FIG. 26, when the cover portion 310 is completely opened, the protrusion 313*a* of the lock rod 313 is engaged in the notch 314*b* of the shaft 314, and the flexure of the lock rod 313 is cancelled out. Using stress based on the flexure of the lock rod 313, the protrusion 313*a* of the lock rod 313 attempts to retain the engagement with the notch 314*a* or 314*b*, thereby the cover portion 310 is maintained in either of the open state or the close state.

The cassette portion 120 having the front face plate 130 and the cover portion 130 constitute a cassette with cover 300. Other mechanisms and printing operation in the laser printer 301 are similar to those in the laser printer 1, and the lower cassette 150 can be attached to the bottom of the laser printer 301.

Figure 27:
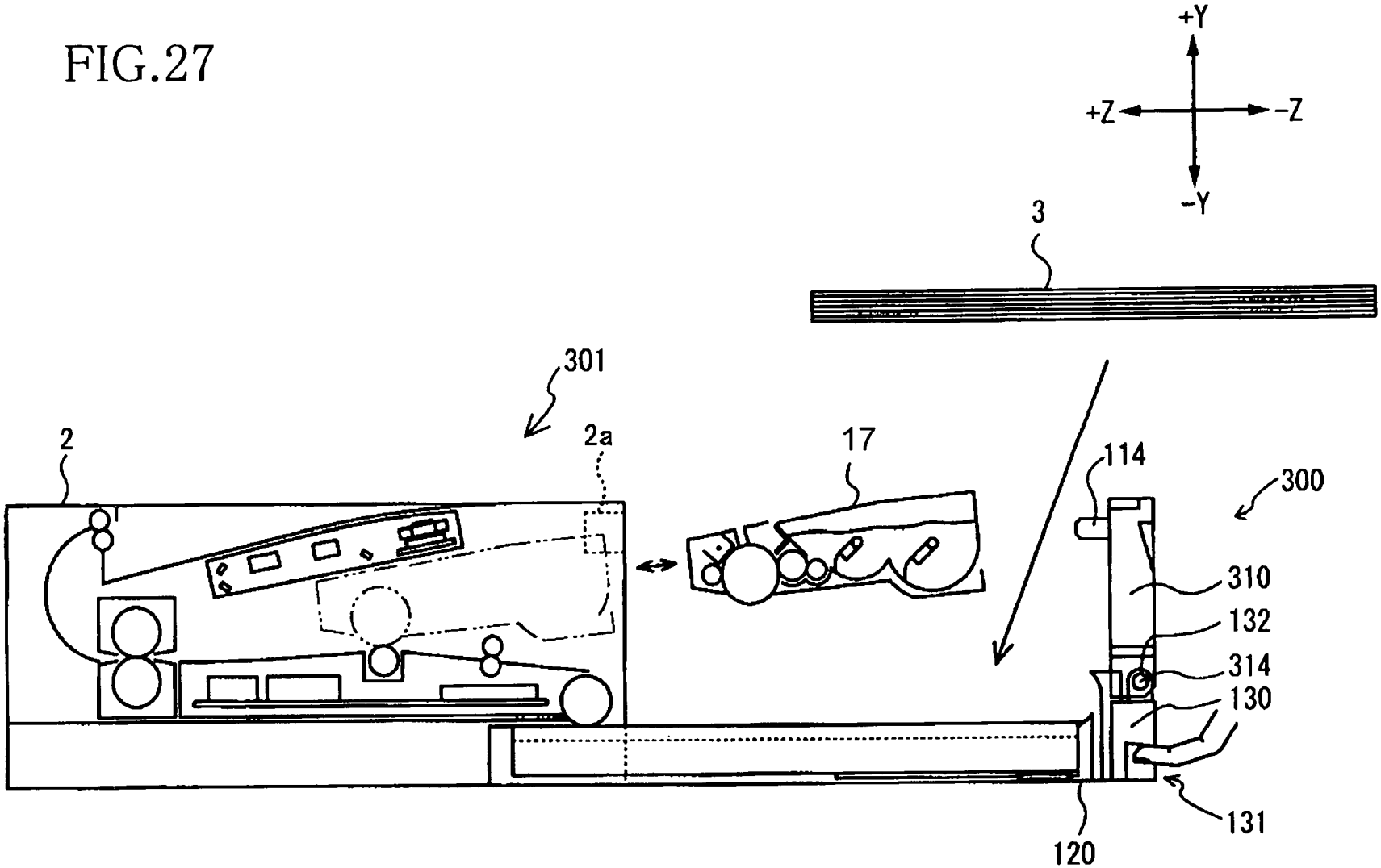
FIG. 27 is a sectional view showing a cassette with a cover 300 pulled open.
Figure 28:
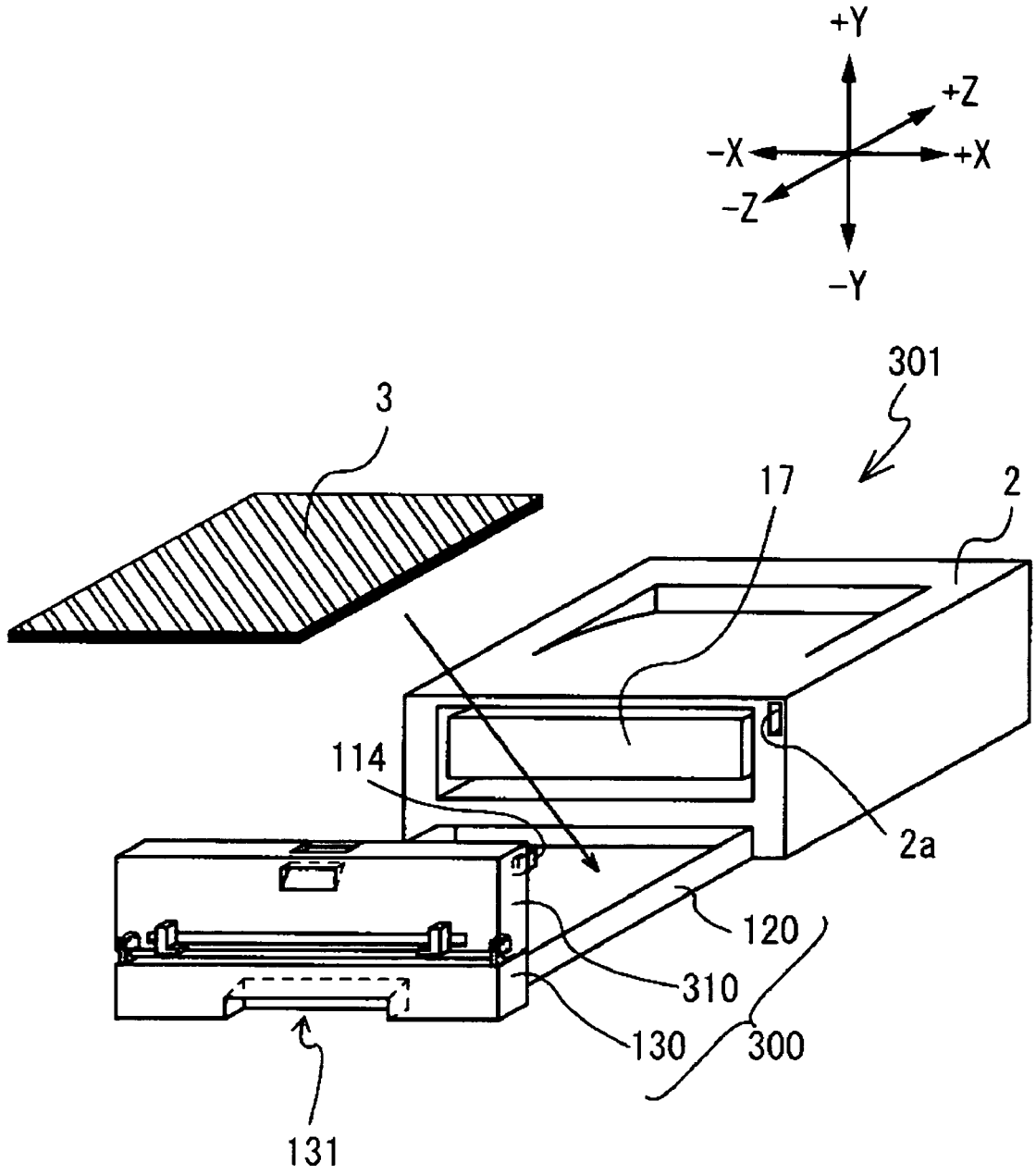
FIG. 28 is a perspective view showing the cassette with a cover 300 pulled open for the replenishment of sheets 3.
Figure 29:
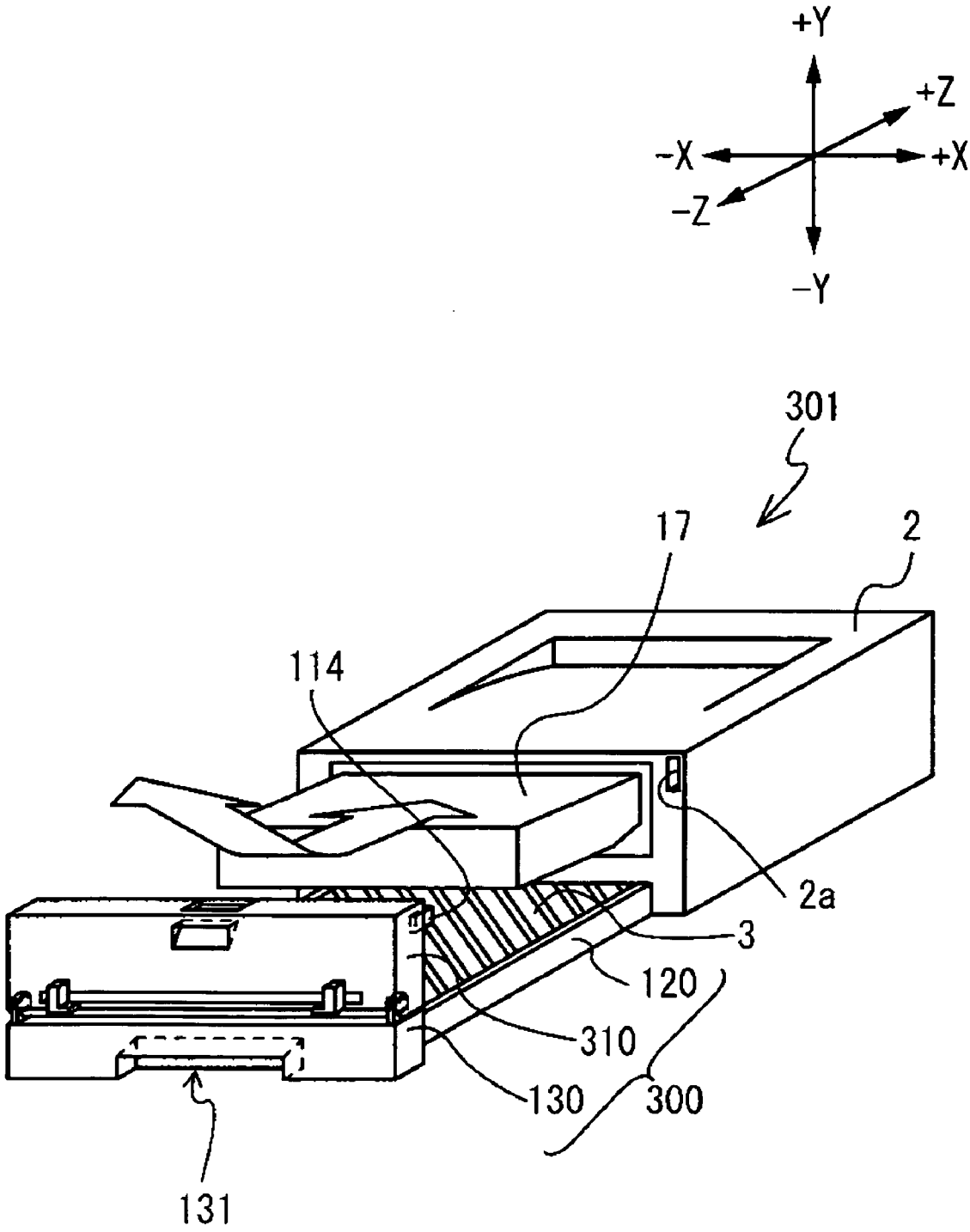
FIG. 29 is a perspective view showing the cassette with a cover 300 pulled open for the attachment of the process cartridge 17.
Figure 30:
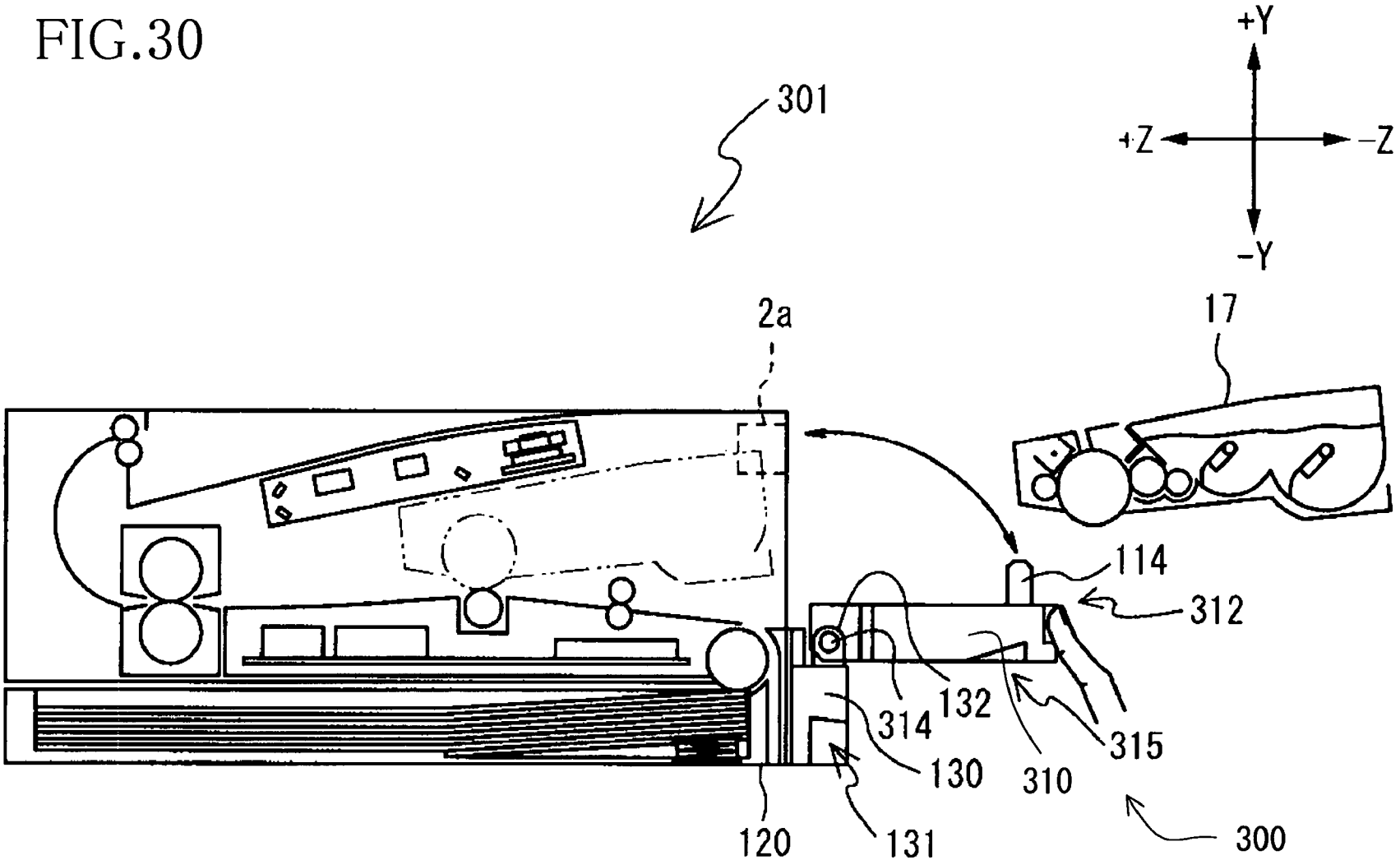
FIG. 30 is a sectional view showing the cover portion 310 opened without the cassette and with a cover 300 pulled open.
Figure 31:
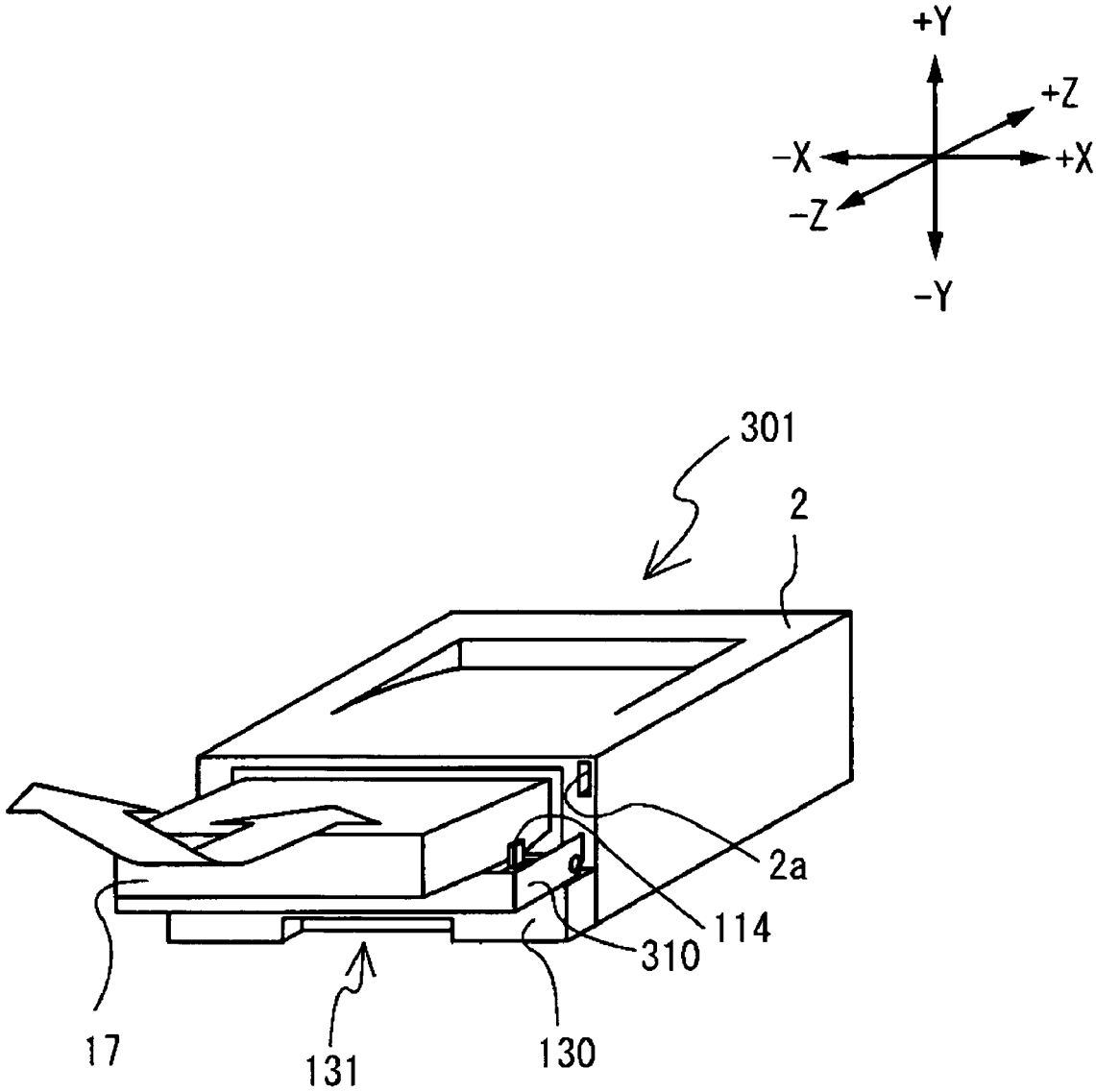
FIG. 31 is a perspective view showing the cover portion 310 opened without the cassette and with a cover 300 pulled open.
Figure 32:
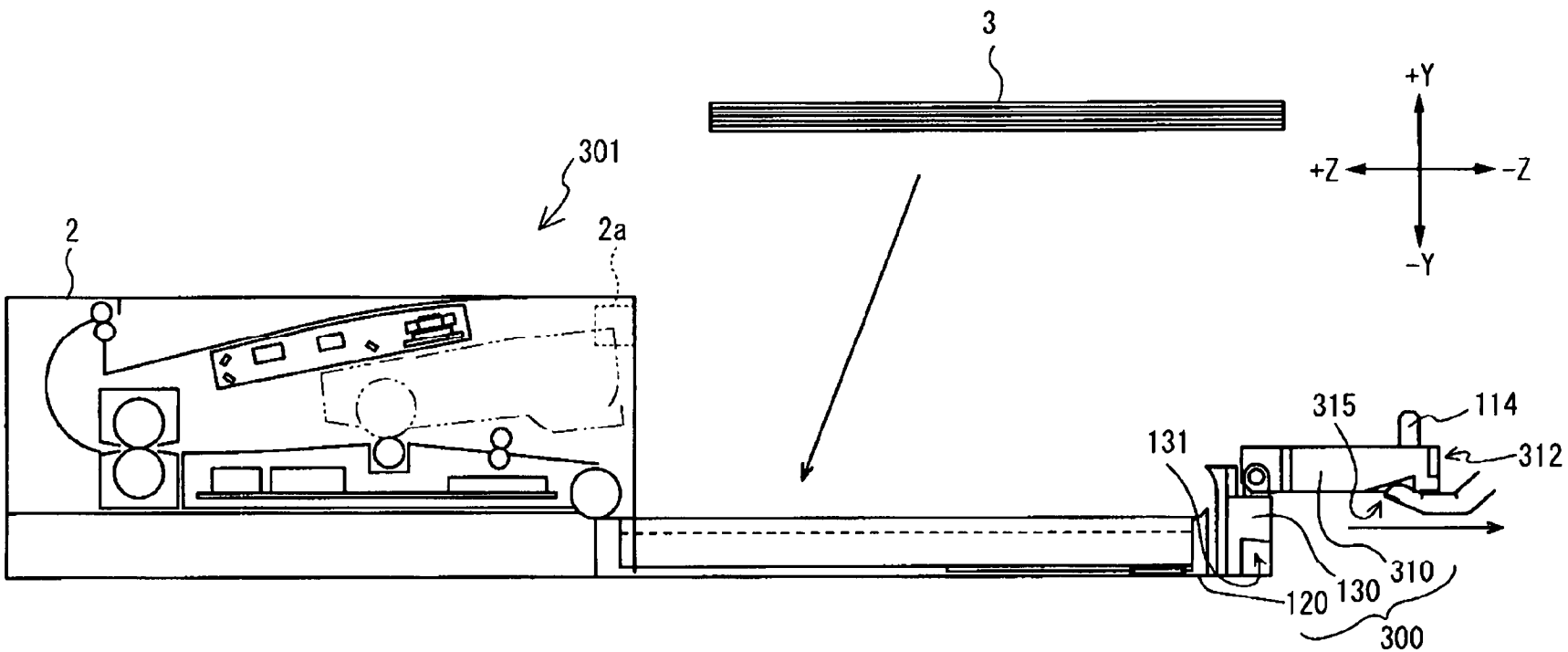
FIG. 32 is a sectional view showing the cassette with a cover 300 pulled open and with the cover portion 310 remaining open.
Figure 33:
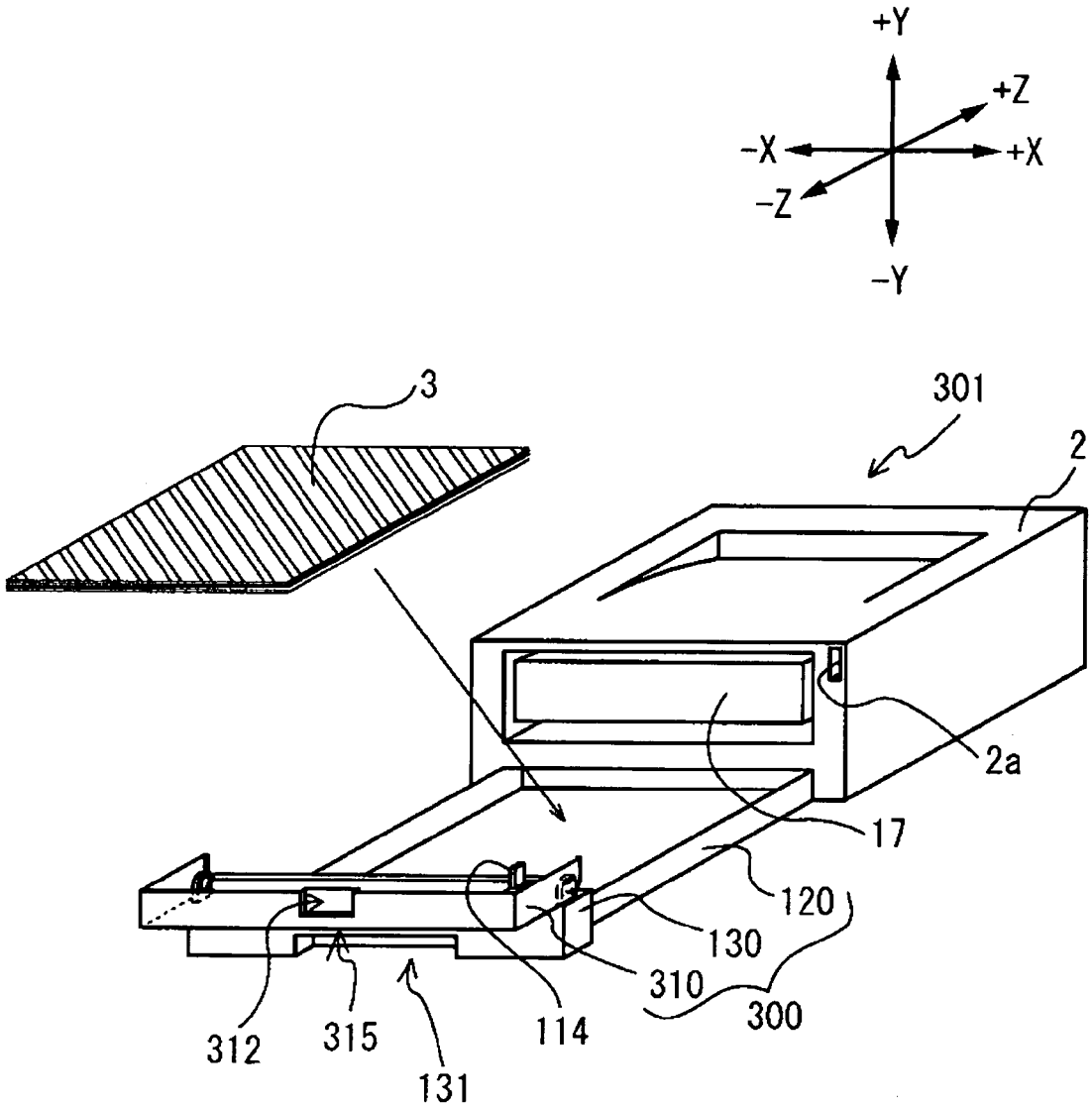
FIG. 33 is a perspective view showing the cassette with a cover 300 pulled open and with the cover portion 310 remaining open.

With reference to FIGS. 27 to 33, the replenishment of sheets 3 and insertion and removal of the process cartridge 17 in the laser printer 301 will be described. FIG. 27 is a sectional view of the laser printer 301 where the cassette with cover 300 is pulled out from the main body 2 for the replenishment of sheets 3. FIG. 28 is a perspective view of the laser printer 301 where the cassette with cover 300 is pulled out from the main body 2 for the replenishment of sheets 3. FIG. 29 is a perspective view of the laser printer 301 where the cassette with cover 300 is pulled out from the main body 2 for the insertion and removal of the process cartridge 17. FIG. 30 is a sectional view of the laser printer 301 where the cover portion 310 is open with the cassette with cover 300 not pulled out from the main body 2. FIG. 31 is a perspective view of the laser printer 301 where the cover portion 310 is open with the cassette with cover 300 not pulled out from the main body 2. FIG. 32 is a sectional view of the laser printer 301 where the cassette with cover 300 is pulled out from the main body 2 with the cover portion 310 open. FIG. 33 is a perspective view of the laser printer 301 where the cassette with cover 300 is pulled out from the main body 2 with the cover portion 310 open.

As shown in FIGS. 27 to 29, when the sheets 3 are replenished in the cassette portion 120 or the process cartridge 17 is removed from or inserted into the main body 2, the user pulls the cassette with cover 300 out from the main body 2 of the laser printer 301 in the −Z direction by the holding portion 131 provided at the lower edge of the front face plate 130. When the cassette with cover 300 is pulled out, the cover portion 310 never falls at its free end because the positional state of the cover portion 310 is maintained by the locking mechanism. Thus, if the cassette with cover 300 is attached to or detached from the main body 2 with its upright position kept, the photo sensor 2*a* detects that the cover portion 310 is in the open state or close state.

As shown in FIGS. 30 and 31, the laser printer 301 is structured such that the process cartridge 17 can be inserted in or removed from the main body 2 only by opening the cover portion 310 without having to pull the cassette with cover 300 out from the main body 2. When the user takes a grip on the holding portion 312 of the cover portion 310 and rotates the cover portion 310 downward, the cover portion 310, which is rotatable about the shaft 314, is open, and the opening to the storing portion 55 is released. With this state, the user can insert or remove the process cartridge 17 in or from the main body 2. When the cover portion 310 is open, a component of force in the Z-axis direction that is required to maintain the cover portion 310 is set smaller than a component of force in the Z-axis direction of the cassette holding power against the cassette with cover 300, which is positioned and temporarily fixed in the main body 2 by the cassette portion 120. In other words, the cassette with cover 300 will not be opened nor closed by the opening and closing of the cover portion 310.

In the laser printer 301, the cassette with cover 300 can be pulled out form the main body 2 even with the cover portion 310 open, as shown in FIGS. 32 and 33. For example, the user may replenish sheets 3 after the insertion and removal of the process cartridge 17. At this time, by holding the holding portion 315 and pulling in the −Z direction, the cassette with cover 300 is pulled out from the main body 2 so that the cassette portion 120 is exposed. Thus, the cassette with cover 300 can be pulled out from the main body 2 without using the holding portion 131 which is located to the rear beneath the cover portion 310. As should be appreciated, gripping the holding portion 131 when the cover portion 310 is open is difficult because the cover portion 310 is positioned over the holding portion 131 as shown in FIGS. 30 and 32.

Figure 34:
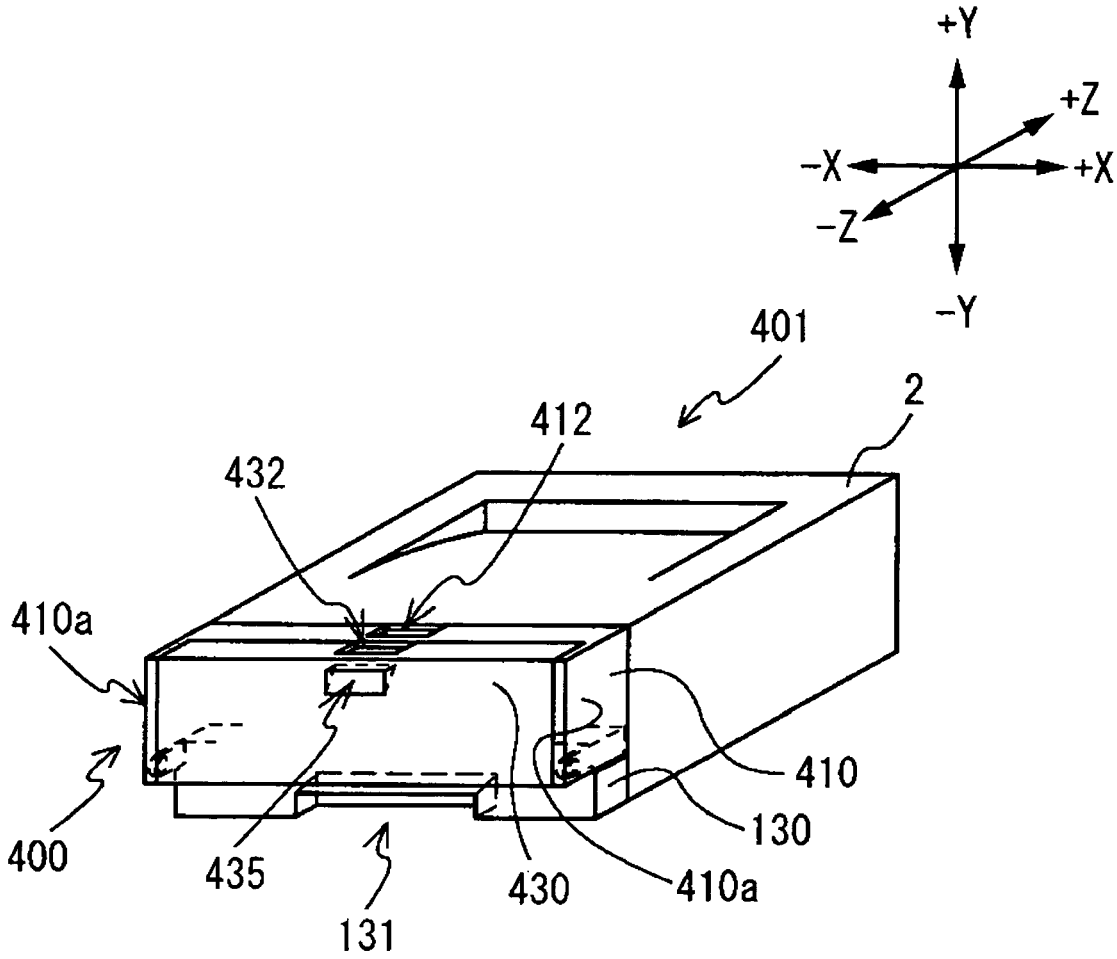
FIG. 34 is a perspective view showing an appearance of a laser printer 401 according to invention.
Figure 35:
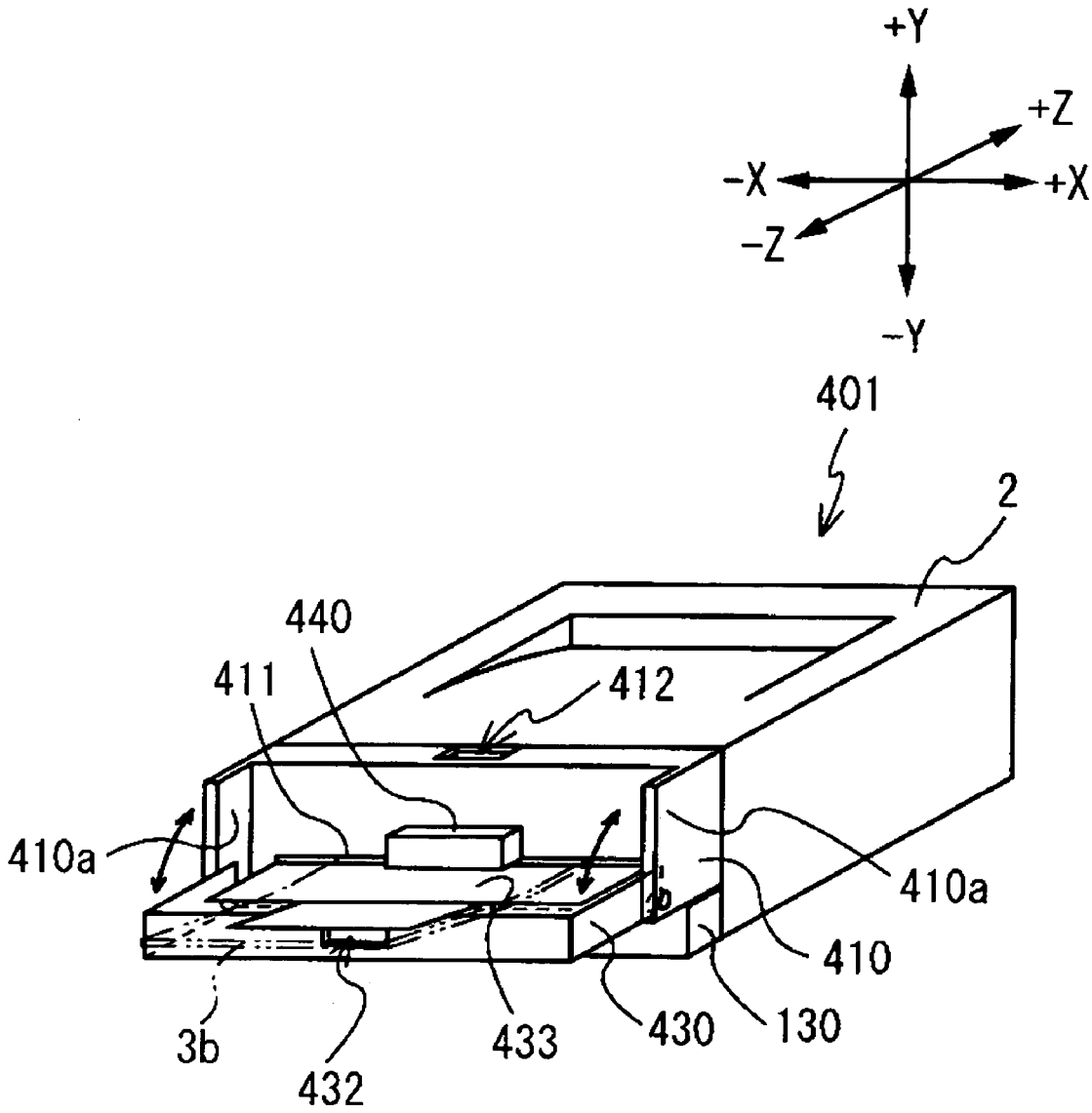
FIG. 35 is a perspective view showing a tray 430 of the laser printer 401 opened according to the invention.
Figure 36:
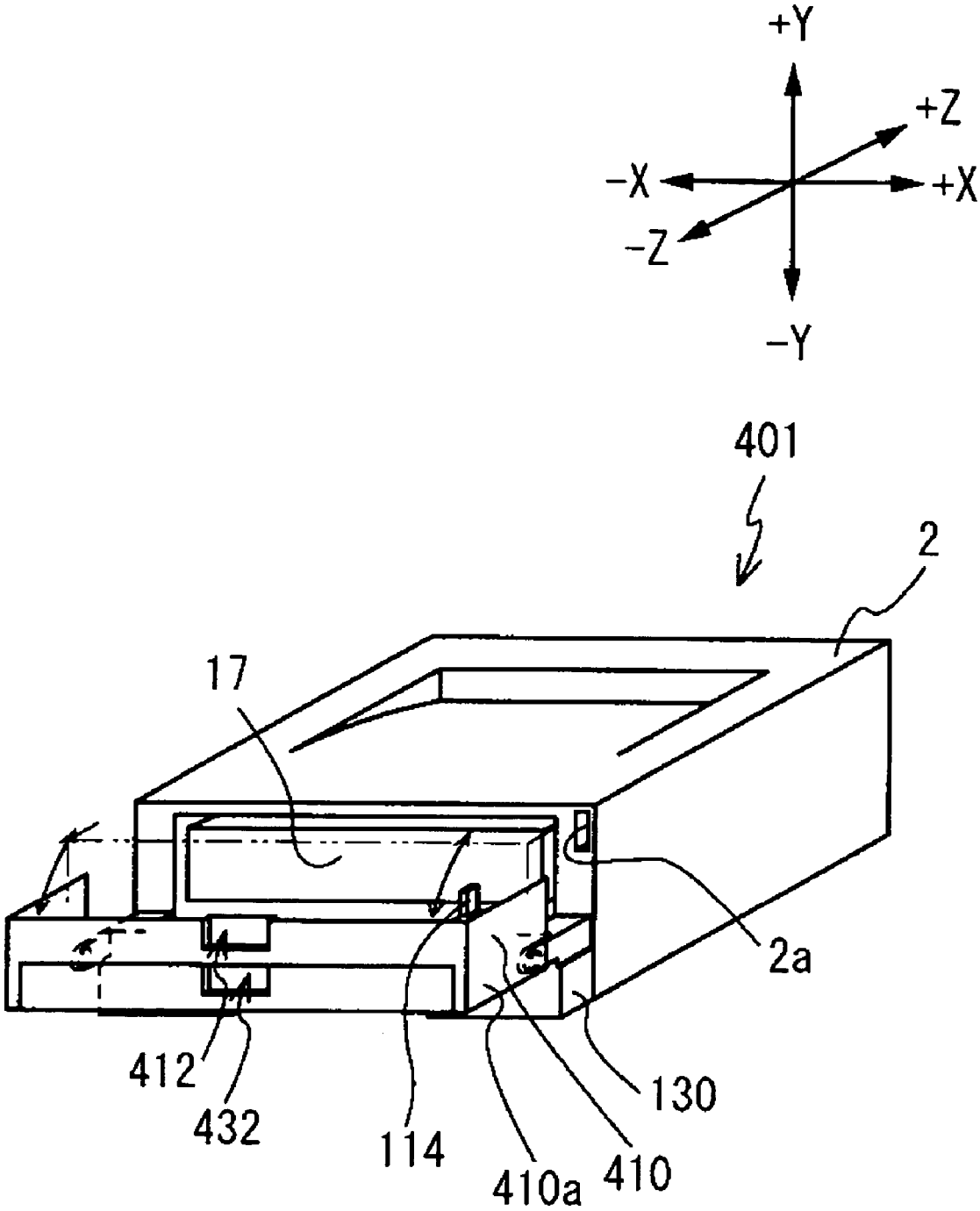
FIG. 36 is a perspective view showing a cover portion 410 of the laser printer 401 opened according to the invention.
Figure 37:
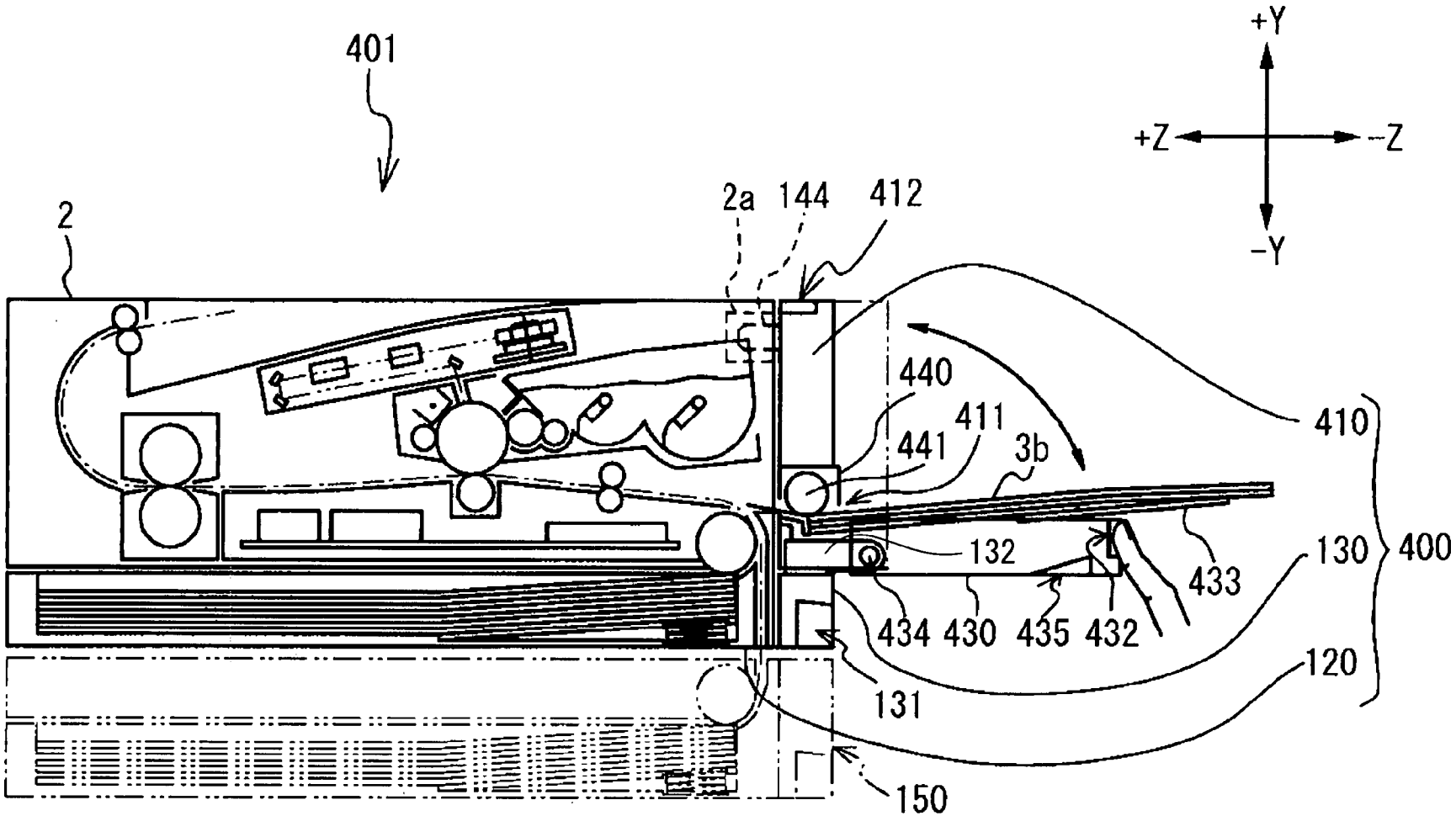
FIG. 37 is a sectional view of a general structure of the laser printer 401 according to the invention.

A fourth embodiment of an image forming apparatus in which the invention is embodied will be described. First, an entire structure of a laser printer 401, which is an example of the image forming apparatus of the third embodiment, will be described with reference to FIGS. 34 to 37. FIG. 34 is a perspective view showing an appearance of the laser printer 401 according to the fourth embodiment. FIG. 35 is a perspective view of the laser printer 401 where a tray 430 is open. FIG. 36 is a perspective view of the laser printer 401 where a cover portion 410 is open. FIG. 37 is a sectional view of a schematic structure of the laser printer 401.

As shown in FIG. 34, the laser printer 401 includes the cover portion 410, which is structurally identical to the cover portion 310 of the laser printer 301 in the third embodiment, the openable tray 430, and a paper feed unit 440 (FIG. 35). The holding portion 131, which is employed for pulling the cassette portion 120 in and out, is provided at a central portion of a lower end of the front face plate 130 when viewed from the front.

Sidewalls of the cover portion 410 in a sideways direction (X-axis direction), which are supported to the front face plate 130 as in the case with the cover portion 310, are provided as tray holding portions 410*a* extending frontward. The tray 430 in the closed state is held between the tray holding portions 410*a* such that its front is substantially parallel to the front of the cover portion 410. A holding portion 435 (described later) is provided at a central portion of the upper end of the tray 430. A holding portion 432 is provided at a central portion of the top surface of the tray 430 in alignment with the top surface of the laser printer 401 close to the holding portion 435. The holding portion 432 is designed to allow a user to take a grip to open the tray 430 pivoted about a shaft 434 (FIG. 37), downward. A similar holding portion 412 is provided at the top surface of the cover portion 410.

As shown in FIG. 35, when the tray 430 is open, a slot 411 opening in the cover portion 410 is exposed. A tray 433 is provided inside the tray 430. The tray 433 is an extendable tray to place a few sheets 3*b* for single-sheet manual feed thereon. The paper feed unit 440 is provided at a central portion above the slot 433.

As shown in FIG. 36, a rotation axis of the cover portion 410 is coaxial with shafts 434 (FIG. 37) of the rotation axis of the tray 430. When the cover portion 410 is opened, the opening to the storing portion 55 for the process cartridge 17 is released. When the holding portion 412 is held and moved downward at its free end, the cover portion 410 is moved downward at its free end with the tray 430 and opened. The tray 430 is provided with a locking mechanism (not shown) identical to the one used in the tray 230 in the second embodiment. The cover portion 410 is provided with a locking mechanism (not shown) identical to the one used in the third embodiment, for the shaft 434 (FIG. 37). Thus, the cover portion 410 and the tray 430 are individually openable and individually maintained in the open or close state.

When the tray 430 and the cover portion 410 are opened, a component of force in the Z-axis direction where the locking mechanism will maintain the current state is set smaller than a component of force in the Z-axis direction of the cassette holding power against the cassette with cover 400, which is positioned and temporarily fixed in the main body 2 by the cassette portion 120. In other words, the cassette with cover 400 will not be opened nor closed by the opening and closing of the tray 430 or the cover portion 410.

If the locking mechanism is structured such that a power required to open the tray 430 is set smaller than a power required to open the cover portion 410, the cover portion 410 will not be opened nor closed by the opening and closing of the tray 430.

As shown in FIG. 37, the front face plate 130 serving as a cosmetic plate is fixed at the front of the cassette portion 120, as has been described. On both sides of the upper part of the front face plate 130, provided are the supporting portions 132 from which shafts 434 for the cover portion 410 and the tray 430 protrude. With this structure, the cover portion 410 and the tray 430 are individually rotatable, and unaffected by each other. Even when strain is applied to the shafts 434 while one of them is opened or closed, the other one is not affected.

When the cover portion 410 is open, the opening to the storing portion 55 for the process cartridge 17 is released. The holding portion 412 is located at the free end of the cover portion 410 such that it is easy for the user to apply force for opening the cover portion 410. As with the case of the cover portion 410, the tray 430 is provided with the holding portion 432 at its free end, thereby it is easy to open. With the tray 430 open, the tray 433, which is stored inside the tray 430, is pulled in the −Z direction for development, so that the slot 411 opening in the cover portion 410 and the tray 433 are connected. The paper feed unit 440 is provided above the slot 411, and during printing, the sheets 3*a* placed on the tray 433 are fed one by one by the paper feed roller 441 via the slot 411 toward the image forming part, as is the case with the second embodiment.

The cover portion 120 having the front face plate 130 and the cover portion 410 having the tray 430 constitute a cassette with cover 400. A drive force to drive the paper feed roller 441 is transmitted from the main body 2 side. A driving force transmission mechanism therefore will be described later. Other mechanisms and printing operation in the laser printer 401 are similar to those in the laser printer 1, and similarly the lower cassette 150 can be attached to the bottom of the laser printer 201.

Figure 38:
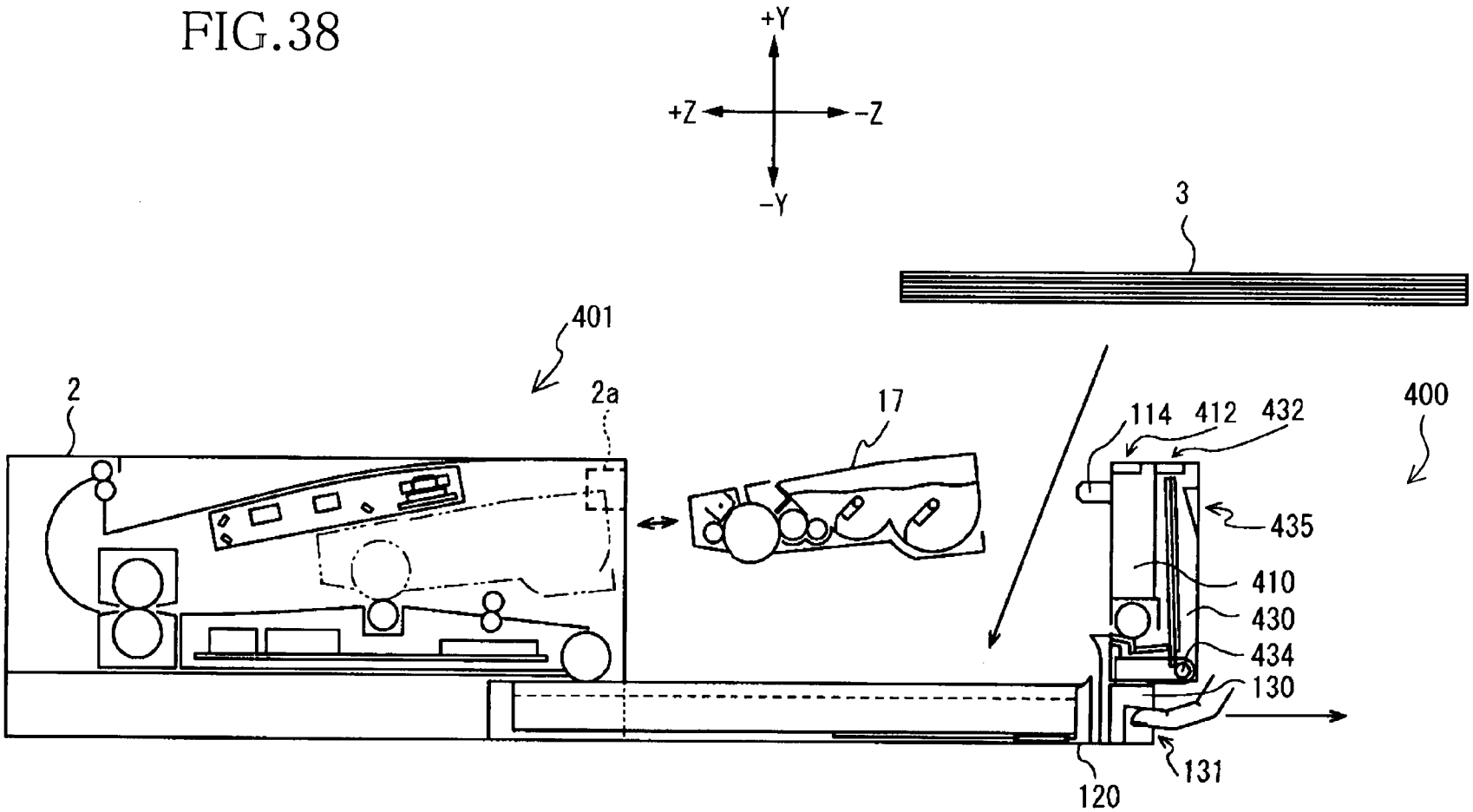
FIG. 38 is a sectional view showing a cassette with a cover 400 pulled open.
Figure 39:
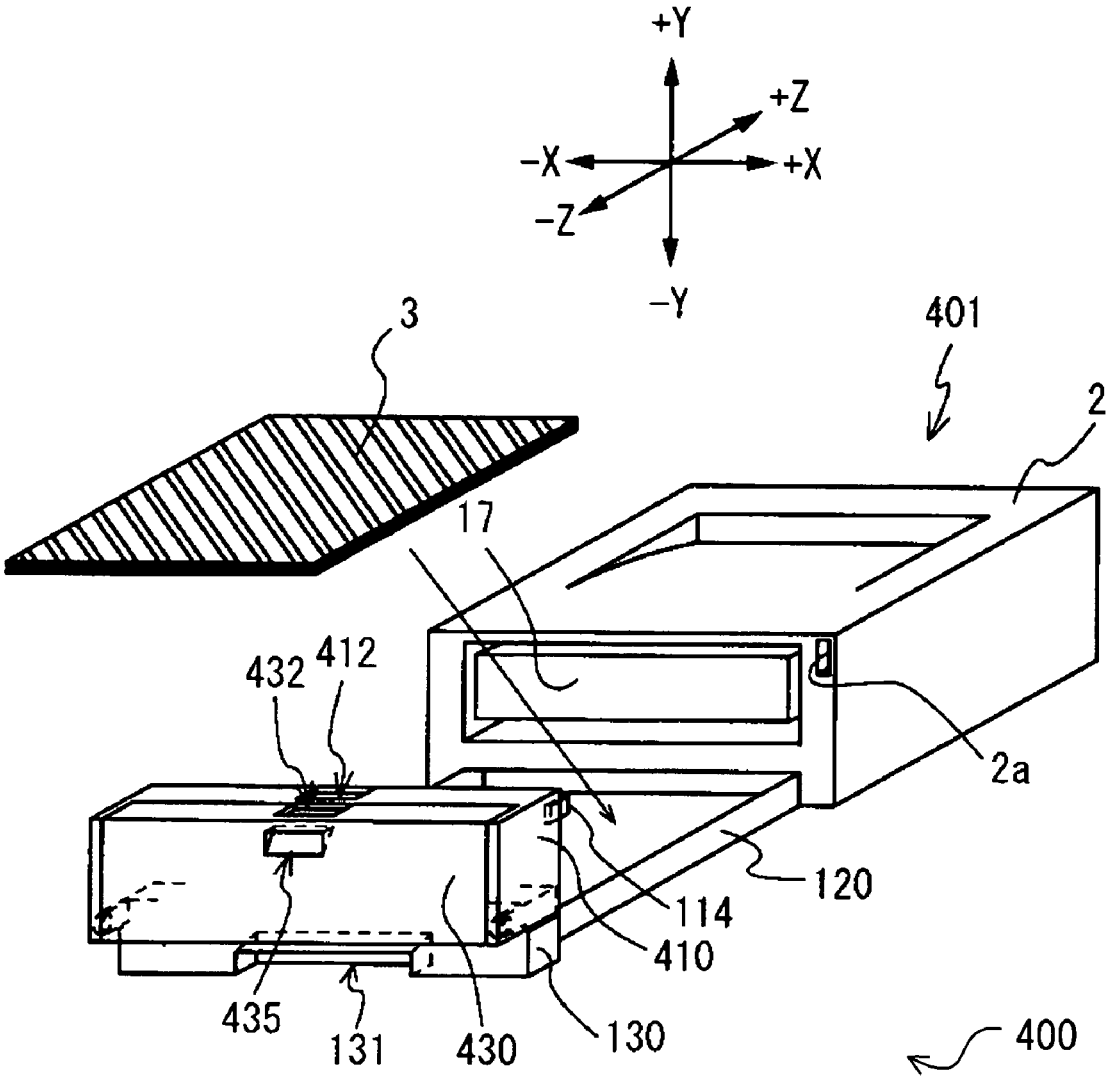
FIG. 39 is a perspective view showing the cassette with a cover 400 pulled open for the replenishment of sheets 3.
Figure 40:
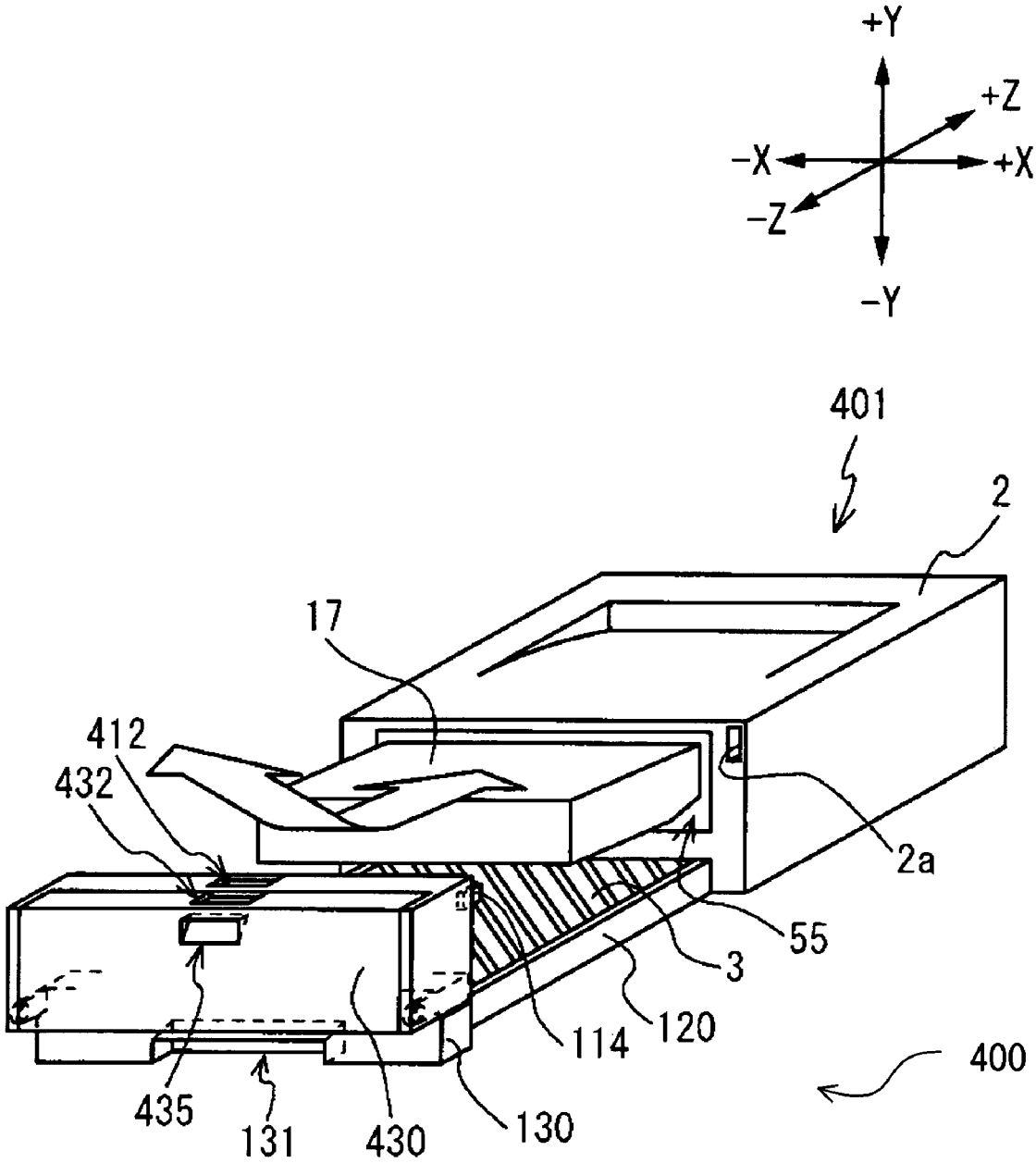
FIG. 40 is a perspective view showing the cassette with a cover 400 pulled open for the attachment of the process cartridge 17.
Figure 41:
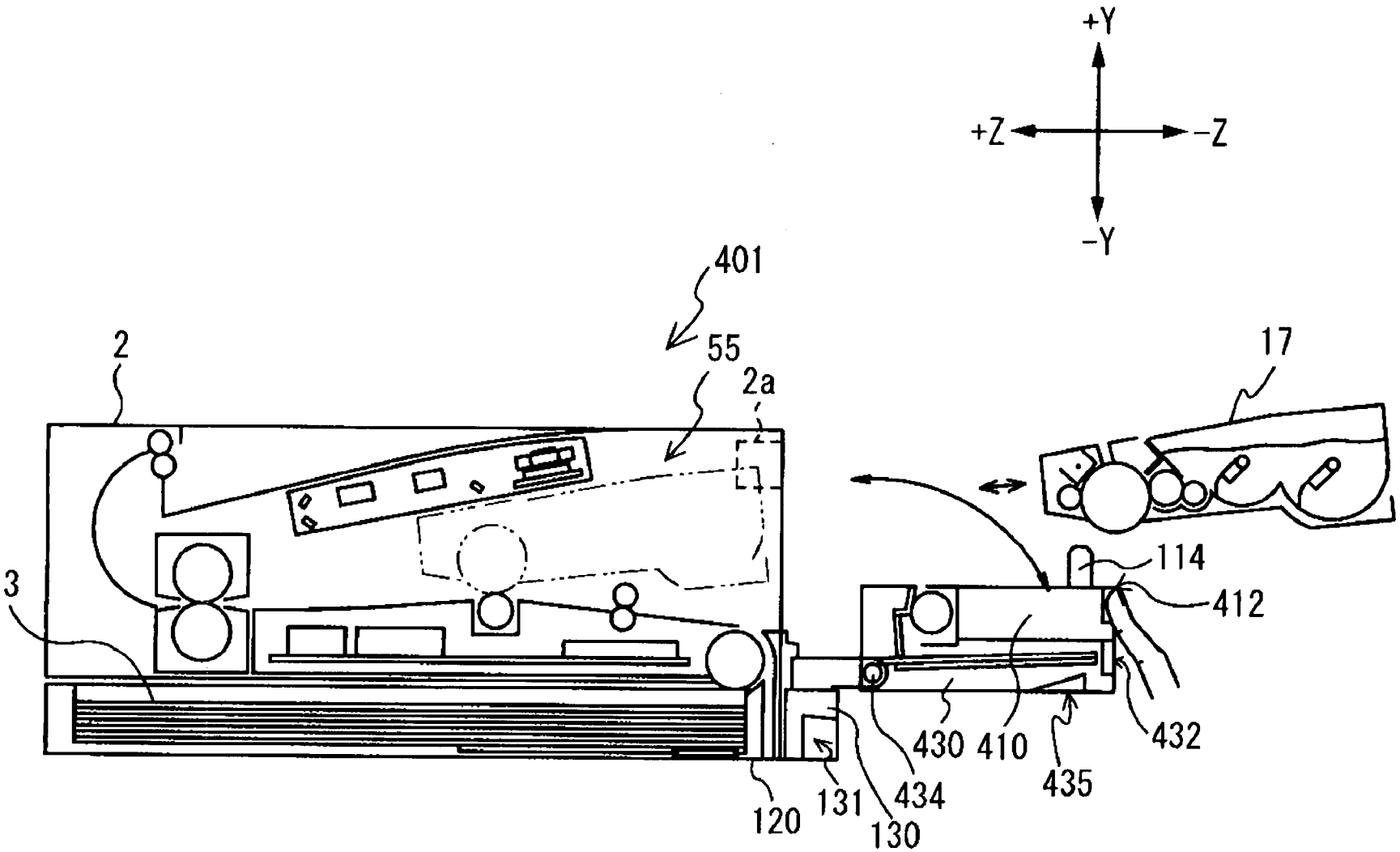
FIG. 41 is a sectional view showing the cover portion 410 opened without the cassette and with a cover 400 pulled open.
Figure 42:
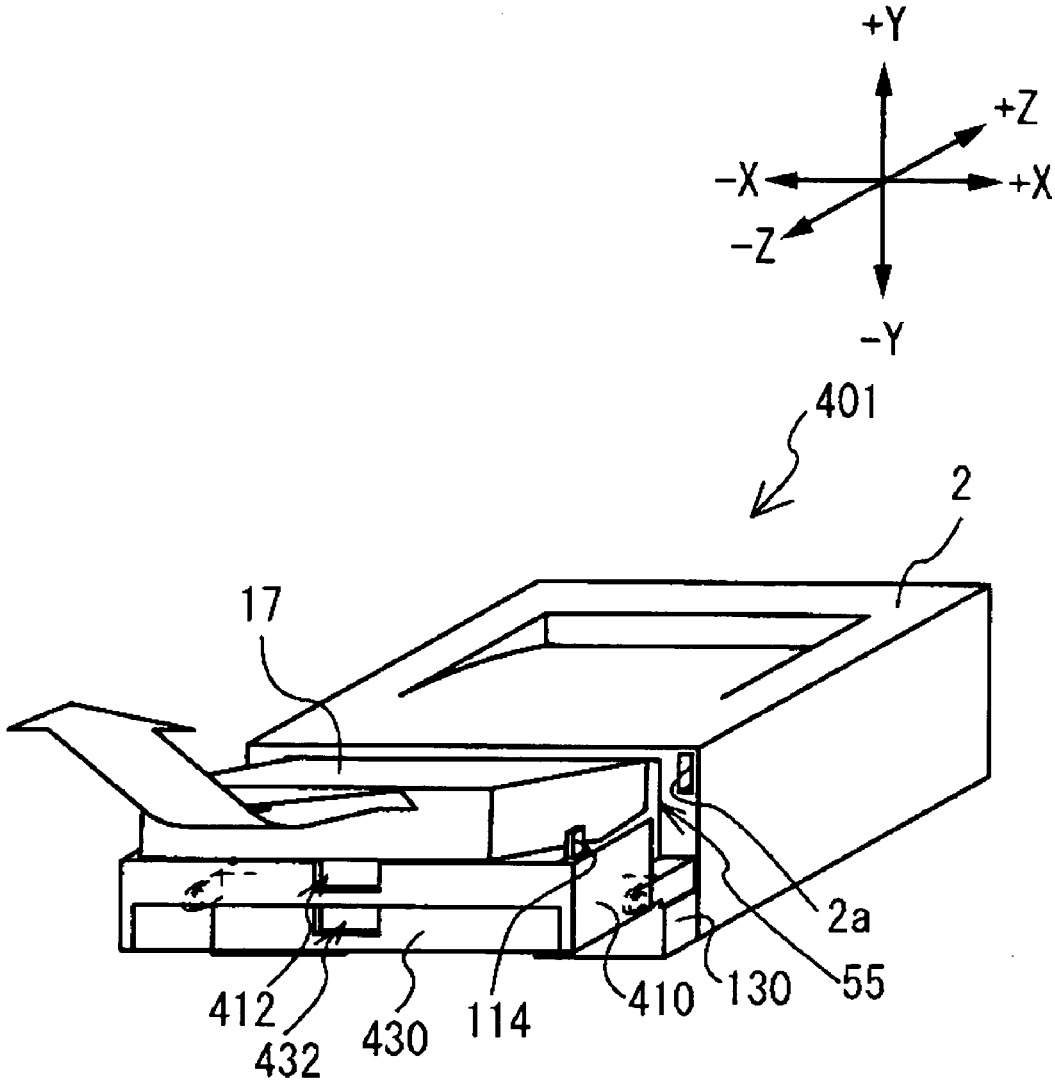
FIG. 42 is a perspective view showing the cover portion 410 opened without the cassette and with a cover 400 pulled open.
Figure 43:
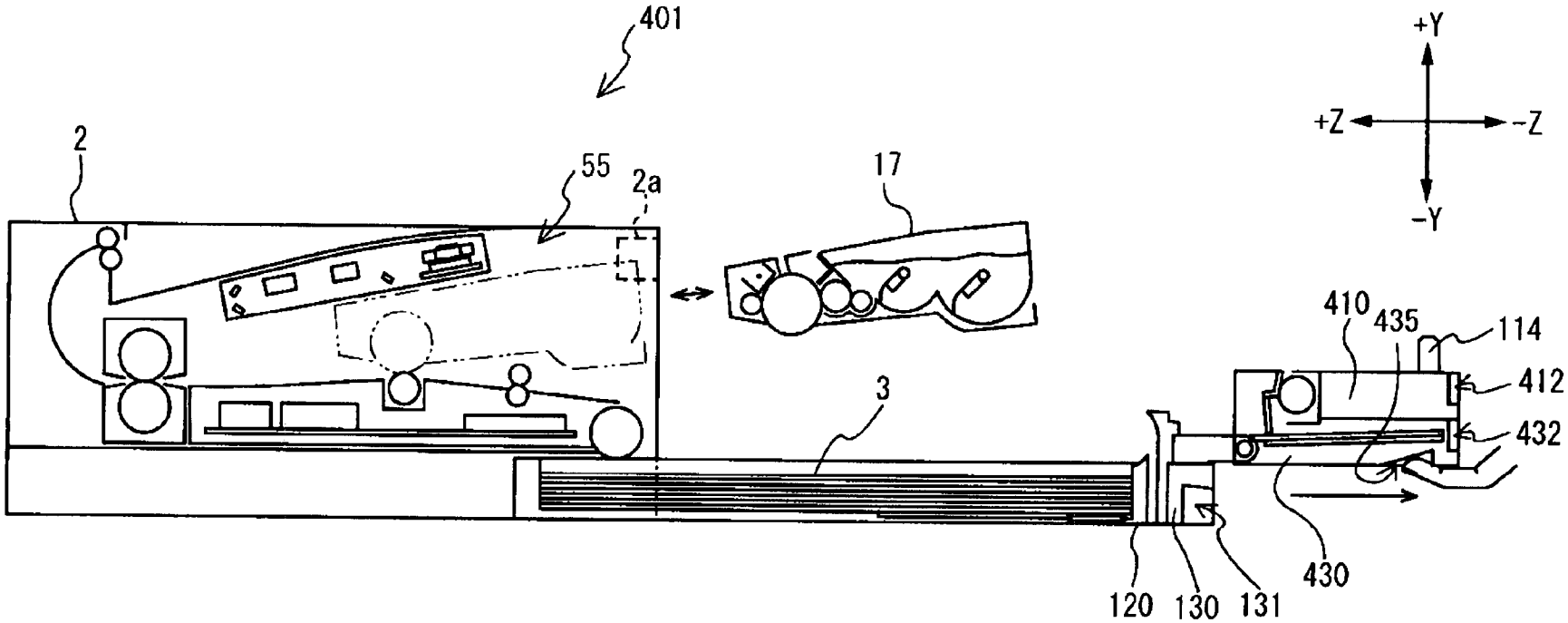
FIG. 43 is a sectional view showing the cassette with a cover 400 pulled open and with the cover portion 410 remaining open.
Figure 44:
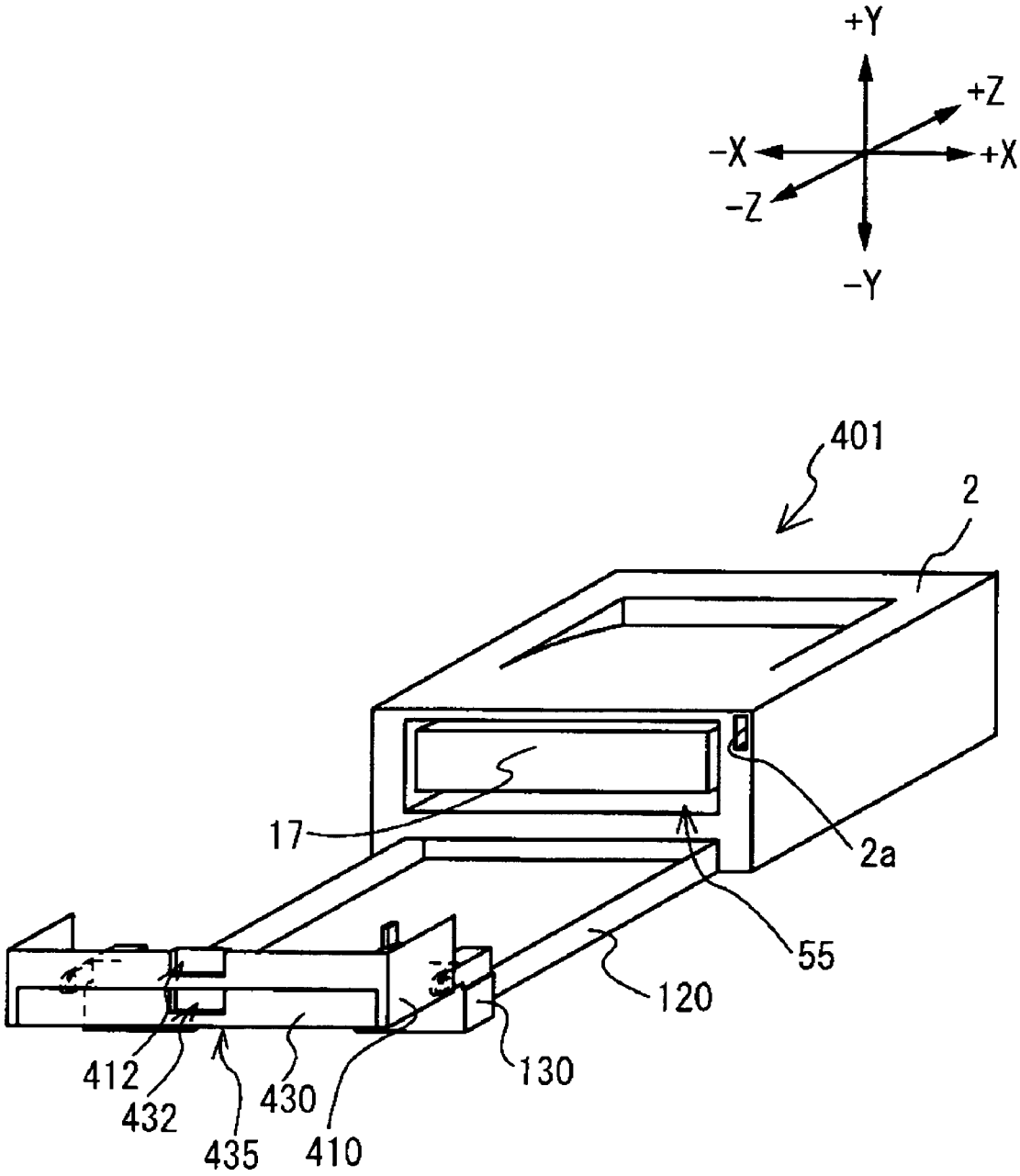
FIG. 44 is a perspective view showing the cassette with a cover 400 pulled open and with the cover portion 410 remaining open.
Figure 45:
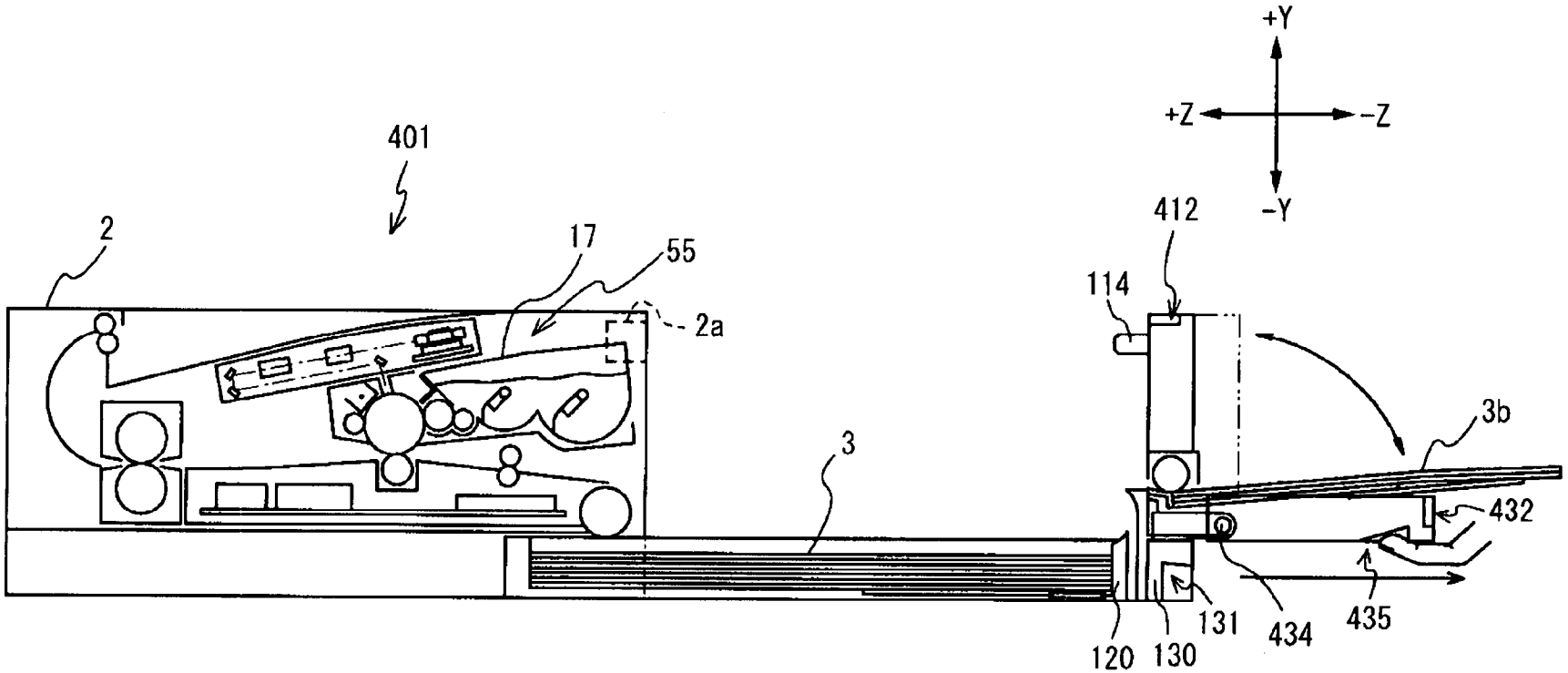
FIG. 45 is a sectional view showing the cassette with a cover 400 pulled open and with the tray 430 remaining open.
Figure 46:
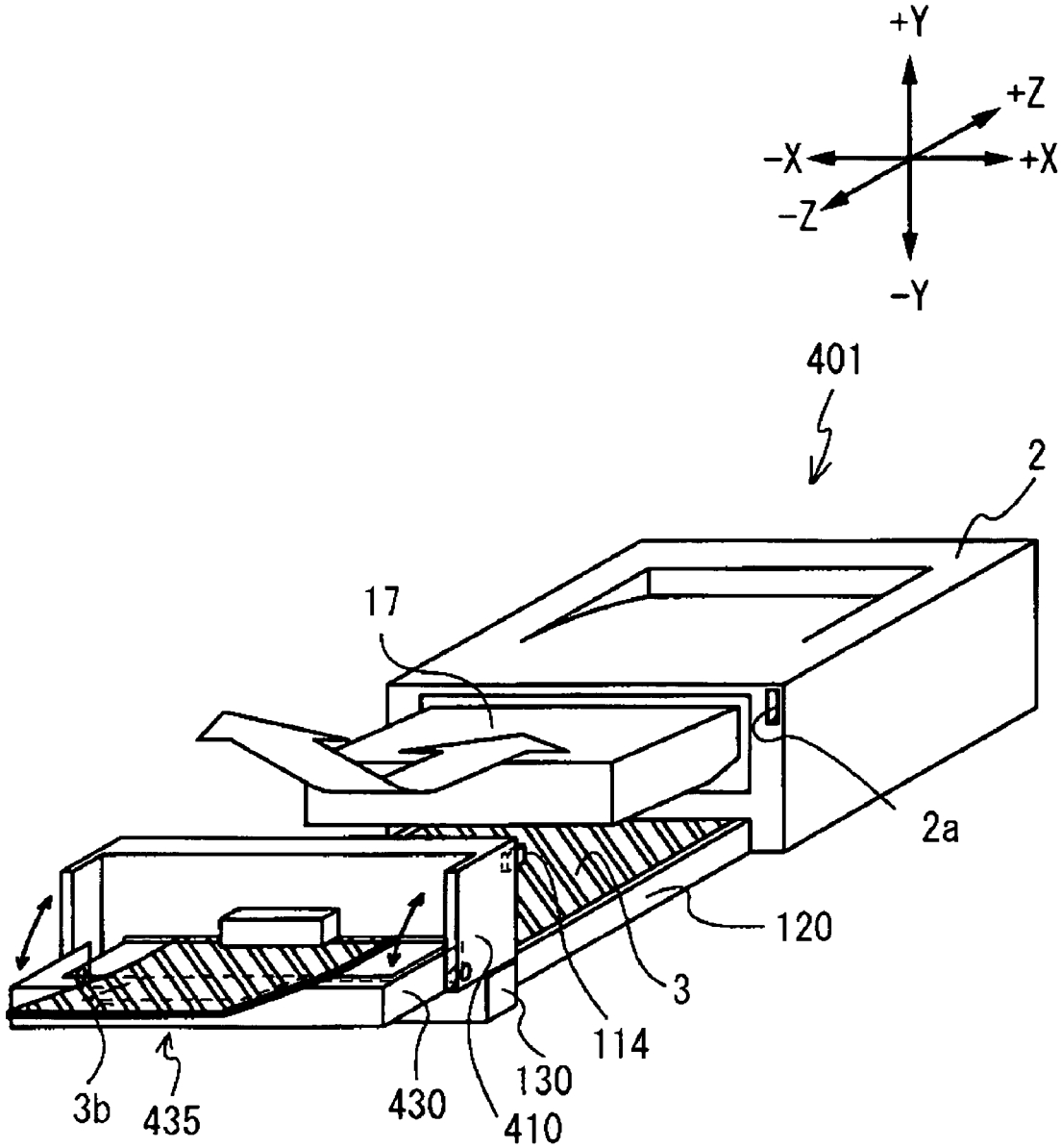
FIG. 46 is a perspective view showing the cassette with a cover 400 pulled open and with the tray 430 remaining open.

With reference to FIGS. 38 to 46, the replenishment of sheets 3 and insertion and removal of the process cartridge 17 in the laser printer 401 will be described. FIG. 38 is a sectional view of the laser printer 401 where the cassette with cover 400 is pulled out from the main body 2. FIG. 39 is a perspective view of the laser printer 401 where the cassette with cover 400 is pulled out from the main body 2 for the replenishment of sheets 3. FIG. 40 is a perspective view of the laser printer 401 where the cassette with cover 400 is pulled out from the main body 2 for the insertion and removal of the process cartridge 17. FIG. 41 is a sectional view of the laser printer 401 where the cover portion 410 is open without pulling the cassette with cover 400 out. FIG. 42 is a perspective view of the laser printer 401 where the cover portion 410 is open without pulling the cassette with cover 400 out. FIG. 43 is a sectional view of the laser printer 401 where the cassette with cover 400 is pulled out from the main body 2 with the cover portion 410 open. FIG. 44 is a perspective view of the laser printer 401 where the cassette with cover 400 is pulled out from the main body 2 with the cover portion 410 open. FIG. 45 is a sectional view of the laser printer 401 where the cassette with cover 400 is pulled out from the main body 2 with the tray 430 open. FIG. 46 is a perspective view of the laser printer 401 where the cassette with cover 400 is pulled out from the main body 2 with the tray 430 open.

As shown in FIGS. 38 to 40, when the sheets 3 are put in the cassette portion 120 or the process cartridge 17 is inserted in the main body 2, as with the case of the third embodiment, the cassette with cover 400 is pulled out from the main body 2 of the laser printer 401 in the −Z direction by the holding portion 131 provided at the lower edge of the front face plate 130. When the cassette with cover 400 is pulled out, the cover portion 410 and the tray 430 never fall at their free ends because the positional states of the cover portion 410 and the tray 430 are maintained by their respective locking mechanisms. Thus, when the cassette with cover 400 is attached to or detached from the main body 2 with its upright position kept, the photo sensor 2*a* detects that the cassette with cover 400 is in the open state or close state.

As shown in FIGS. 41 and 42, as is the case with the third embodiment, the laser printer 401 is structured such that the process cartridge 17 can be inserted in or removed from the main body 2 only by opening the cover portion 410 without having to pull the cassette with cover 400 out from the main body 2. The cover portion 410 is opened when the holding portion 412 is held and moved downward at its free end.

As shown in FIGS. 43 and 44, as is the case with the third embodiment, the laser printer 401 is structured such that the cassette with cover 400 can be pulled out with the cover portion 410 open. Thus, even during the insertion and removal of the process cartridge 17, the sheets 3 can be easily replenished only by holding the holding portion 435 and pulling the cassette with cover 400 out from the main body 2.

As shown in FIGS. 45 and 46, as is the case with the second embodiment, the laser printer 401 is structured such as to facilitate the replenishment of sheets 3 and the insertion and removal of the process cartridge 17 without having to close the tray 430 even when the tray 430 remains extended for single-sheet manual feed printing with the sheets 3 placed thereon.

The laser printers 201 and 401 in the second and fourth embodiments are provided with the paper feed unit 240 and 440, respectively. The force to drive the paper feed rollers 241, 441 is transmitted from a drive source provided in the main body 2 via power transmission parts such as gears, and the paper feed units 240 and 440 are driven. However, since the cassettes with covers 200 and 400 are each pulled in and out from the main body 2, the transmission of the driving force is performed, for example, when gears provided in the cassettes with covers 200 and 400 are engaged with gears connected to a drive motor which is a drive source provided in the main body 2. The following will describe a driving force transmission mechanism for transmitting the driving force.

Figure 47:
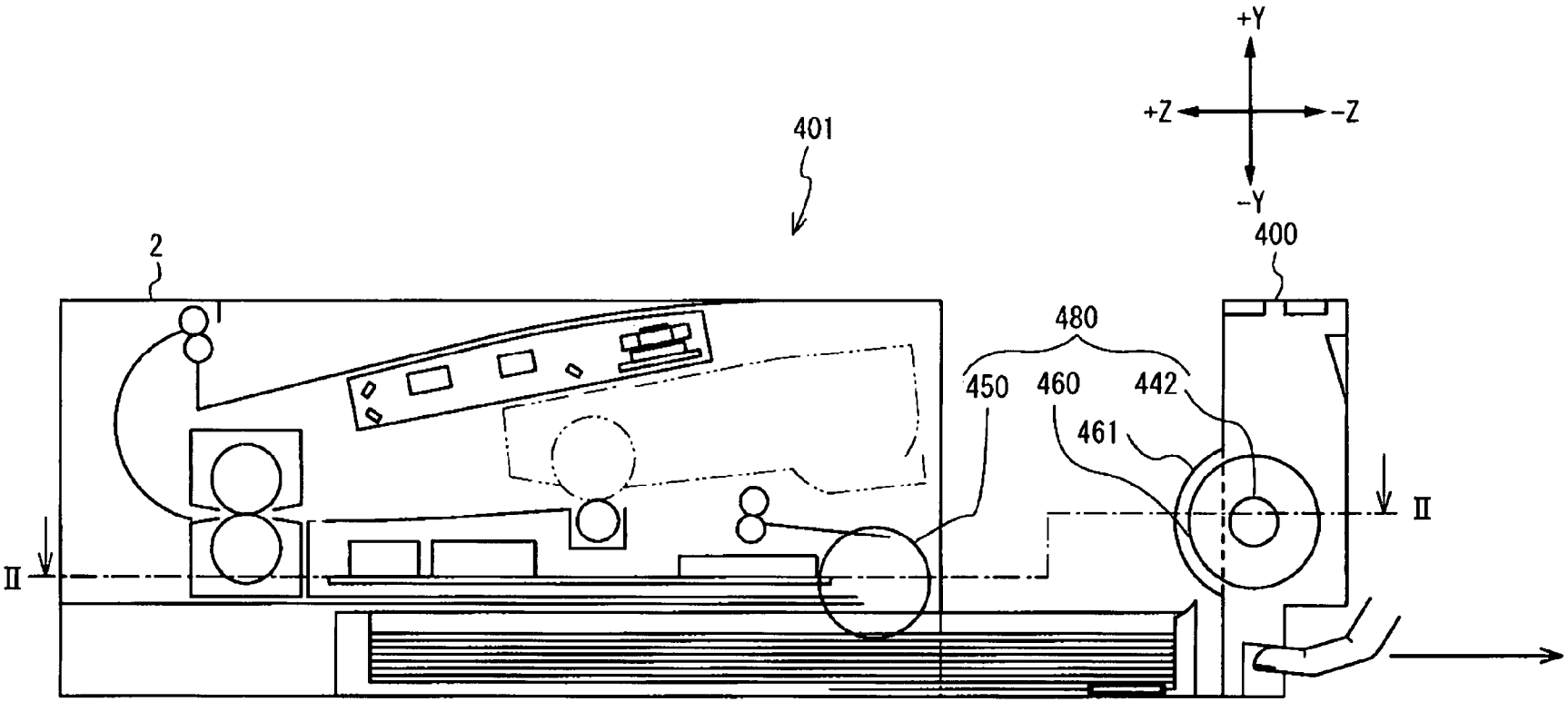
FIG. 47 is a sectional view of a general structure of the laser printer 401.
Figure 48:
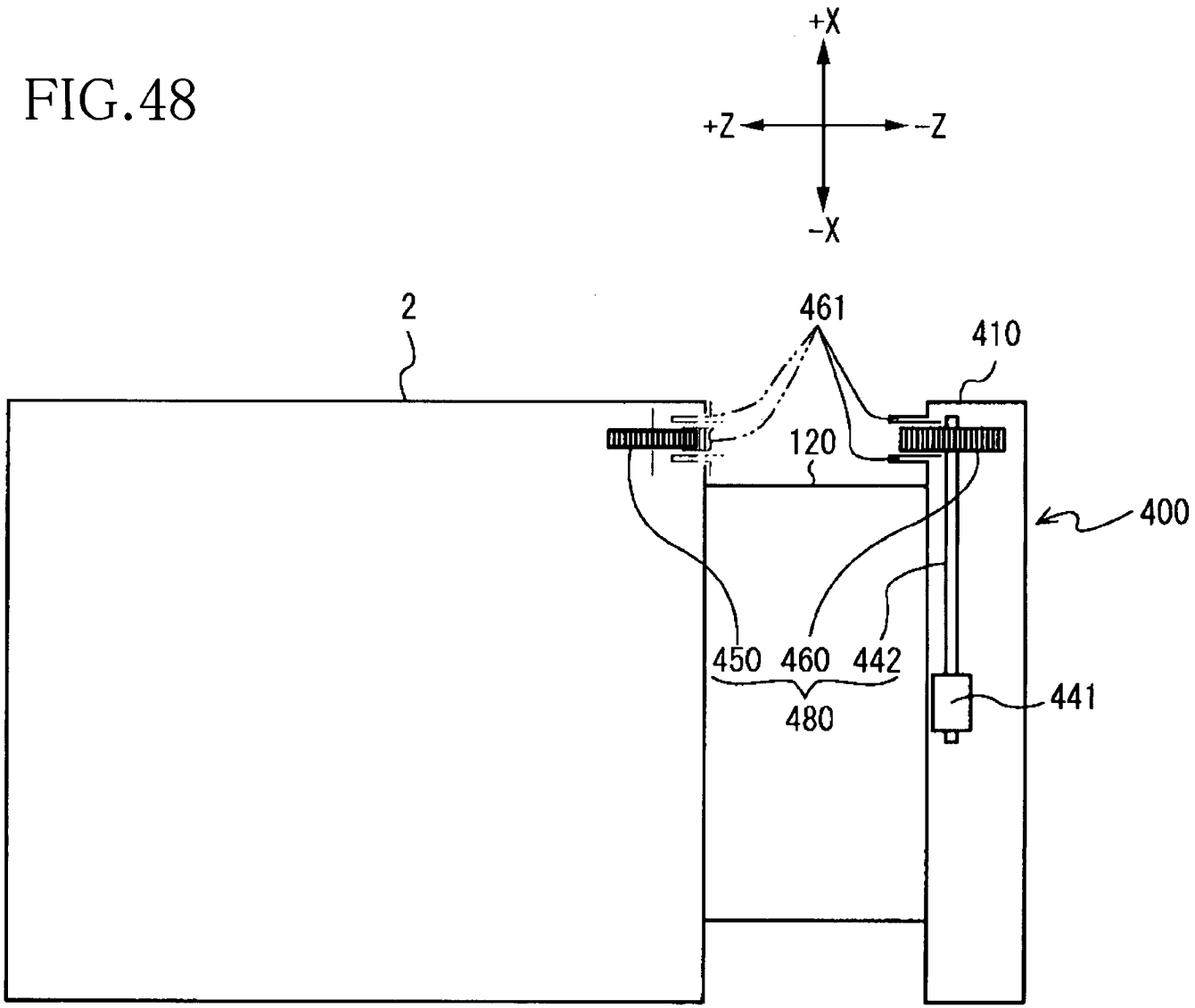
FIG. 48 is a sectional view being taken along a dash dot line II—II in FIG. 47, viewed in the direction of appended arrows.
Figure 49:
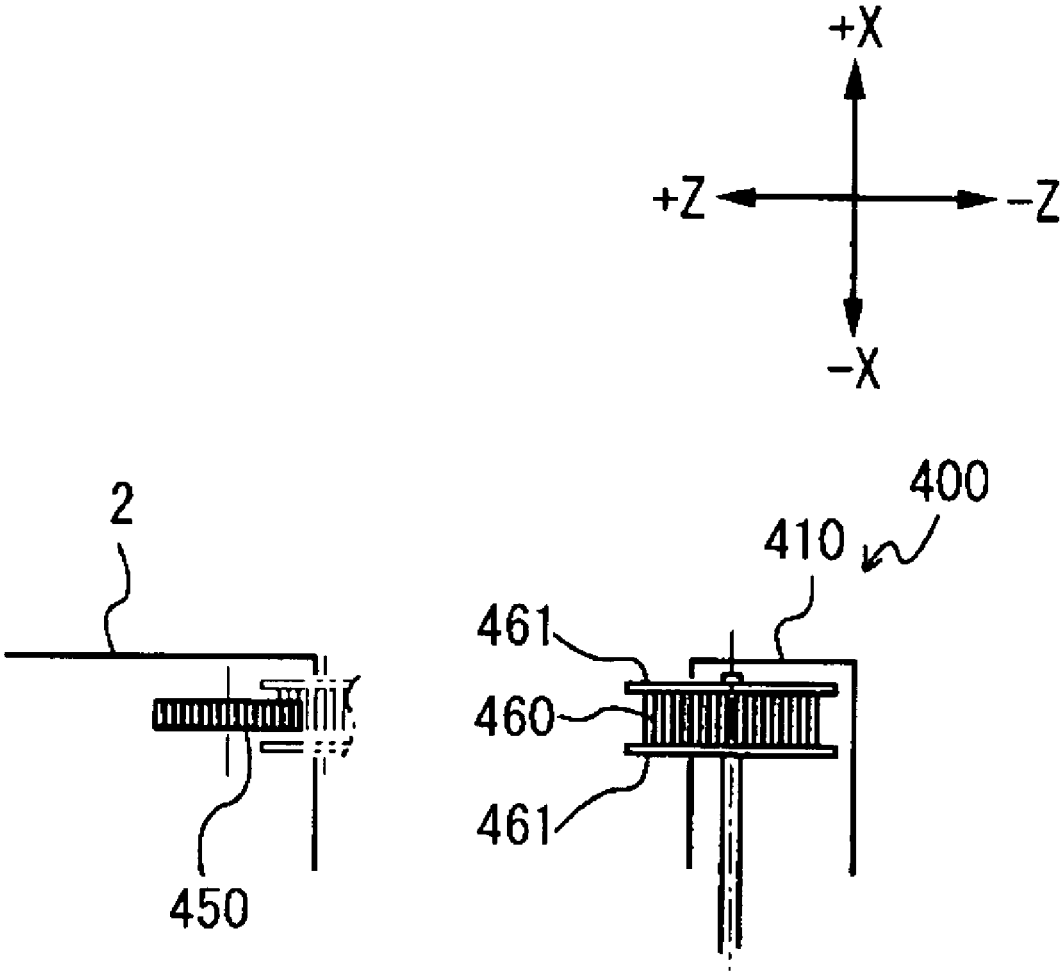
FIG. 49 is a sectional view showing a modification of a driving force transmission mechanism, being taken along a dash dot line II—II in FIG. 47, viewed in the direction of appended arrows.

FIG. 47 is a sectional view showing a schematic structure of the laser printer 401. FIG. 48 is a sectional view along a dash dot line II—II of FIG. 47. FIG. 49 shows a modification of a driving force transmission mechanism viewed from the arrowed direction on the dash dot line II—II of FIG. 47. As a driving force transmission mechanism in the laser printer 201 is structurally the same as that in the laser printer 401, description will be made taking the laser printer 401 as an example.

As shown in FIG. 47, the driving force transmission mechanism is comprised of a driving force transmission unit 480 that includes a gear 450 provided in the main body 2, a gear 460 provided in the cassette with cover 400, and a shaft 442 connected to the paper feed roller 441 (FIG. 48). The gear 450 is a gear arranged at a disposal end of a plurality of gears engaged with a drive motor (not shown) of the laser printer 401. As shown in FIG. 48, the gear 460 is provided in the cassette with cover 400, the shaft 442 that is the rotation shaft of the gear 460 is the rotation shaft of the paper feed roller 441, and the paper feed roller 441 is rotated with the rotation of the gear 460. The gear 450 is located at an end portion of the front of the main body 2 on the +X direction side. The gear 460 is located inside the cover portion 410 at a position corresponding to the gear 450 when the cassette with cover 400 is inserted in the main body 2.

When the cassette with cover 400 is inserted into the main body 2, the gears 450 and 460 are engaged. When the gear 450 is driven by rotating the driving motor, the driving force is transmitted to the gear 460, and the gear 460 is rotated. With rotation of the gear 460, the shaft 442 is rotated and the paper feed roller 441 is also rotated. The force transmitted from the gear 450 to the gear 460 does not act in a direction in which the cover portion 410 is opened, that is, the −Z direction. Granted that the force transmitted from the gear 450 to the gear 460 acts in the −Z direction, the force is set small enough for a force required to open the cover portion 410.

Since the gears 450 and 460 are exposed when the cassette with cover 400 is separated from the main body 2, the user may accidentally touch gear teeth. As such, the gears may be damaged or the fingers of the user may be smeared with dirt. To prevent these problems, the gear 450 is located inside from the outer wall of the main body 2, and the gear 460 is located such as to protrude from the cover portion 410 facing toward the gear 450, so that they are engaged when the cassette with cover 400 is inserted in the main body 2. To prevent damage to the gear 460, protective members 461 with a circumference slightly larger than that of the gear 460 are disposed parallel to a circular flat surfaces of the gear 460 and above and under the gear 460 such as to sandwich the gear 460 from both sides with respect to the axial direction. The protective members 461 protrude from the wall surface of the cover portion 410.

With this structure, when the gears 450 and 460 are not engaged, the user may be less prone to touch the gears 450 and 460 because the gear 450 is located in the inside of the wall surface of the main body 2 and the gear 460 is sandwiched between the protective members 461. Thus, damage to the teeth of the gears 450 and 460 and adhesion of dirt on the fingers can be prevented.

Effects similar to those brought about by the above structures can be appreciated by attaching the protective members 461 directly to both sides of the gear 460 as shown in FIG. 49. Alternatively, the protective members 461 may be attached to the gear 450. Furthermore, a drive motor (not shown) that drives the paper feed roller 41 may be provided in the cover portion 410 such that a controller (not shown) outputs a control current of the drive motor, a contact in the cover portion 410 and a contact in the main body 2 are connected when the cassette with cover 400 is inserted into the main body 2, and the current is supplied to the drive motor via the contacts.

As described above, in the laser printer 1 of the first embodiment, replenishment of the sheets 3 and insertion and removal of the process cartridge 17 can be made only by setting the cassette with cover 100 in the pulled-out state. When the user replenishes sheets or removes the process cartridge 17 from the laser printer 1, the operation is the same with respect to the laser printer 1, thereby enhancing the ease of use of the laser printer 1. If the cassette portion 120 and the cover portion 110I are discrete parts like a conventional laser printer, two sensors are required for detecting open/close states of both the cassette portion 120 and the cover portion 110. However, in the cassette with cover 100, only the photo sensor 2*a* is used to detect the open/close states of both the cassette portion 120 and the cover portion 110. Furthermore, a mechanism to open and close the cover portion 110 independently can be omitted, and manufacturing costs can be reduced.

When a paper jam occurs at the passage opening 121 or in the conveying path 40*a*, the cassette portion 120 or the process cartridge 17 needs removing from the laser printer 1 to clear the paper jam. However, either case can be solved with the removal and insertion of the cassette with cover 100. Further, as shown in FIG. 9, when the process cartridge 17 is removed from the laser printer 1 with the cassette with cover 100 fully pulled out, the convey path 40*a* can be seen via the storing portion 55 from outside of the main body 2, and a jammed sheet can be easily cleared.

The process cartridge 17 is moved in the storing portion 55 in substantially a horizontal direction, which is substantially parallel to the direction where the cassette portion 120 is pulled and returned. In other words, as the process cartridge 17 and the cassette portion 120 are not moved in a direction of thickness of the main body 2, there is no need to provide a space for movement in such a direction in the main body 2, as a result, the size of the main body 2 can be reduced in the direction of thickness. When the process cartridge 17 that is moved in the storing portion 55 in the substantially horizontal direction is removed from the storing portion 55, it is moved in a direction opposite to the sheet feed direction where a sheet 3 is fed in the convey path 40*b*. If a sheet 3 is jammed in the convey path 40*b*, for example, friction from the process cartridge 17 is applied to the sheet 3 when the process cartridge 17 is removed, and the sheet 3 is moved to a direction where it is slightly returned from the sheet feed direction. Thus, the sheet 3 can be easily cleared even when it is caught in any place of the convey path 40*b*.

In the laser printer 201 of the second embodiment, in addition to the effects brought about by the first embodiment, the cassette with cover 200 can be released even with the tray 230 open.

In the laser printer 301 of the third embodiment, in addition to the effects brought about by the first embodiment, by simply opening the cover portion 310, the process cartridge 17 can be removed from or inserted in the laser printer 301 without having to pull the cassette with cover 300 out. Further, the cassette with cover 301 can be released even with the cover portion 310 open.

In the laser printer 401 of the fourth embodiment, in addition to the effects brought about by the first and third embodiments, the cassette with cover 400 can be released by simply holding the holding portion 435 even with the tray 430 and the cover portion 410 open.

While the invention has been described in conjunction with specific embodiments thereof, it is evident that many alternative, modifications and variations may be apparent to those skilled in the art. Accordingly, the preferred embodiments of the invention as set forth herein are intended to be illustrative, not limiting. Various changes may be made without departing from the spirit and scope of the invention as defined in the following claims. For example, the photo sensor 2*a* may be replaced with a sensor other than the photo sensor. Instead of the shutter plate 114, a protrusion may be provided for use with a switch such that the switch is turned on or off in contact with the tip of the protrusion. The flexure applied to each locking mechanism may be produced by the use of an urging member such as a spring or the flexure of a part.

In the third and fourth embodiments, the cover portions 310, 410 are fixed by each locking mechanism. Each locking mechanism may be replaced with a member that fixedly locks, for example, a release button that is pressed to release the lock. Each holding portion may be located in any place, and a plurality of holding portions may be provided at each open/close portion.

In the laser printers 1, 301 of the first and third embodiments, a member such as a cover may be provided such as to hide the slit openings 111, 311 when manual feed printing is not performed. In the laser printer 301 of the third embodiment, the slit opening 311 may not be provided in the cover portion 310, through the use of a clearance between the cover portion 310 and the front face plate 130.

The laser printers 1, 201, 301, and 401 of the first to fourth embodiments may be structured as a copier or a multifunction apparatus by mounting an image reading apparatus that can read images thereon. For example, if an image reading apparatus 501 is mounted on the laser printer 1 as shown in FIG. 50, the functions of the laser printer 1 will not be impaired because only the discharge paper tray 46 is provided on the top of the laser printer 1.

Figure 50:
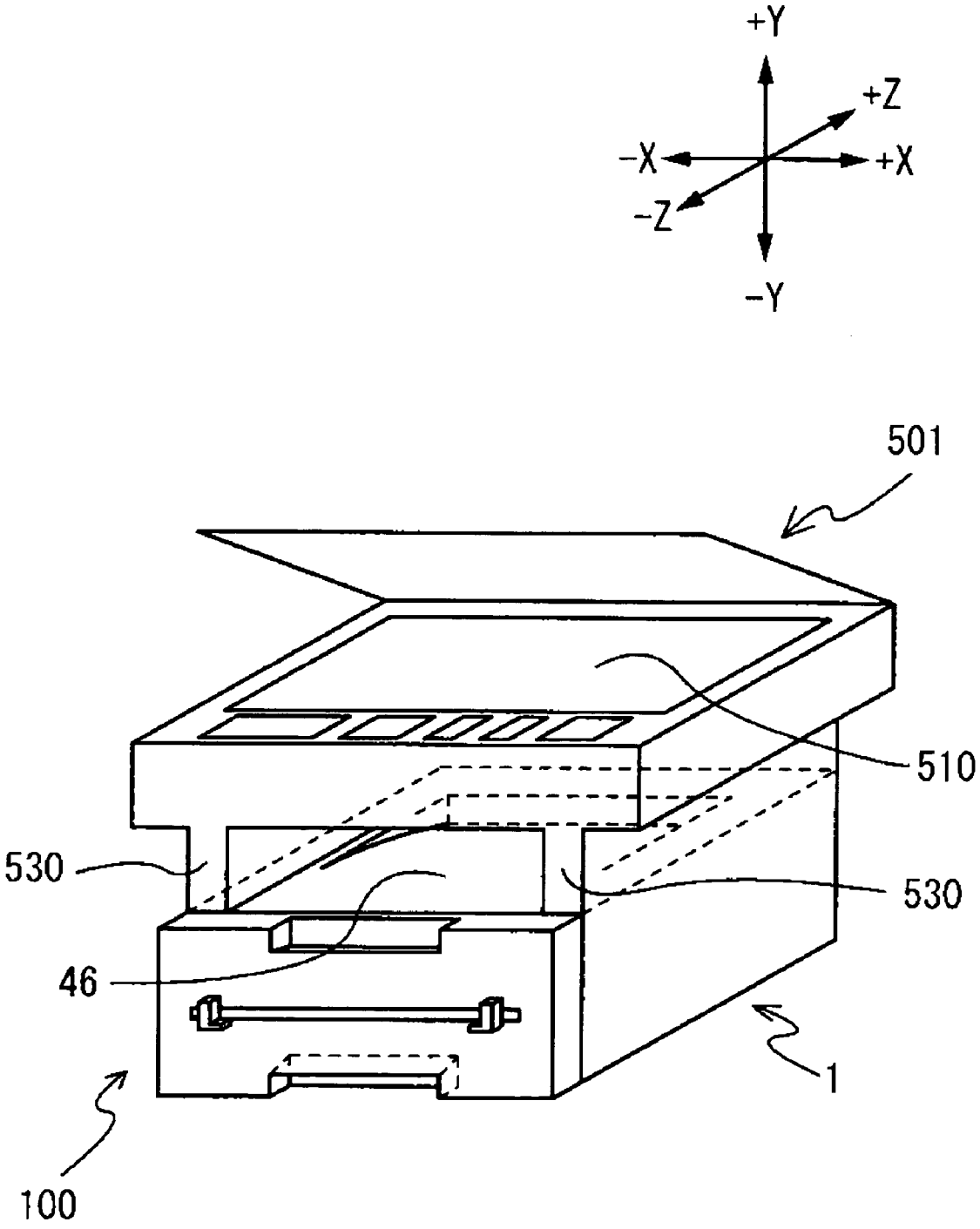
FIG. 50 is a perspective view of the laser printer 1 mounting an image reading apparatus 501 thereon.

For example, as shown in FIG. 50, spacer walls 530 are provided on the top of the laser printer 1 except for the discharge paper tray 46 and the cassette with cover 100 to fix the image reading apparatus 501 thereon. As an example of the image reading apparatus 501, a known flatbed scanner can be used. In such a scanner, a document to be scanned is placed down on a flat glass plate 510 and irradiated with a beam, an intensity of its reflection light is read by a line-type charged coupled device (CCD) sensor in which a plurality of CCDs are arranged, and converted into digital data.

Figure 51:
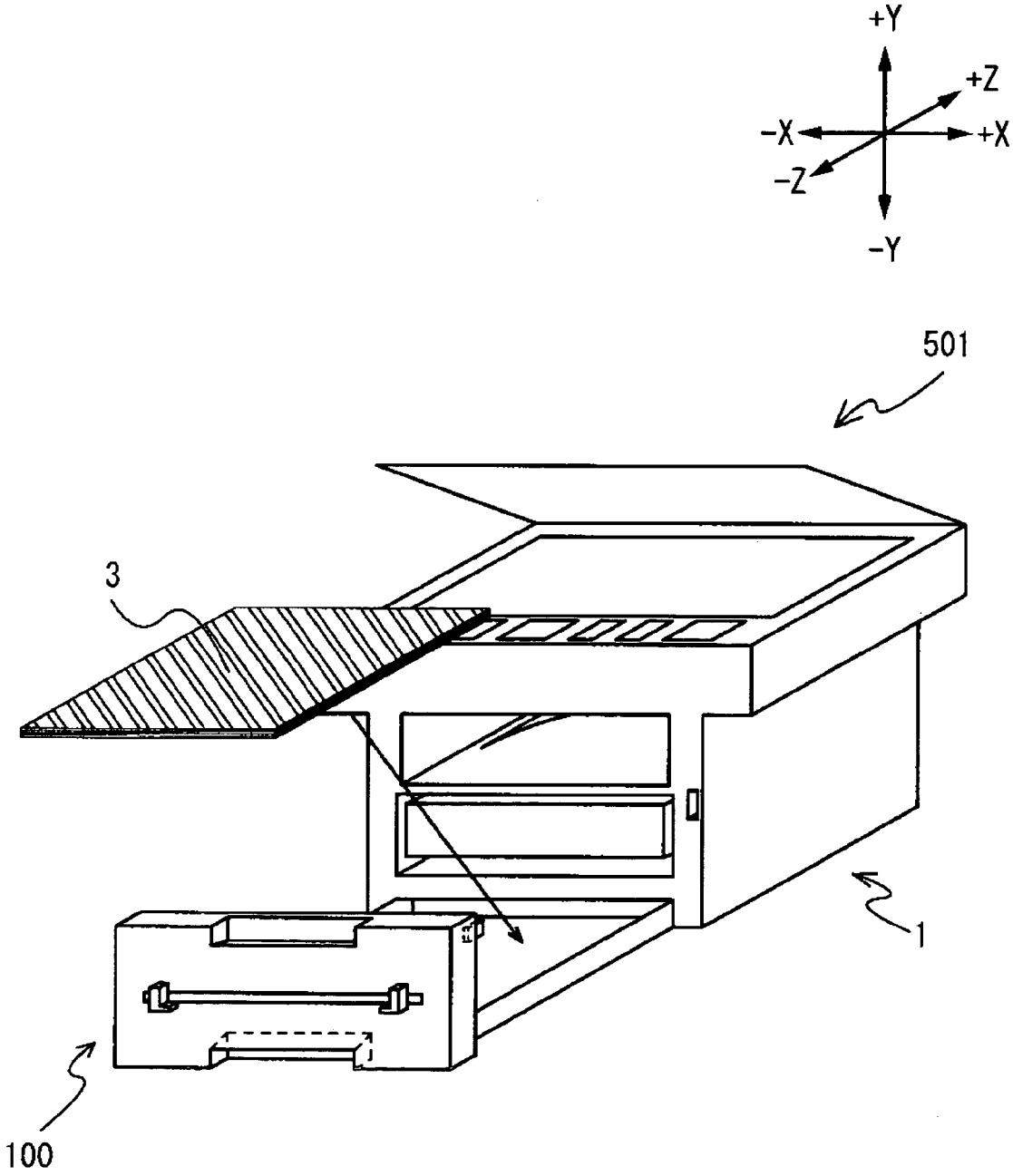
FIG. 51 is a perspective view of the laser printer 1 mounting the image reading apparatus 501 for the replenishment of sheets 3.
Figure 52:
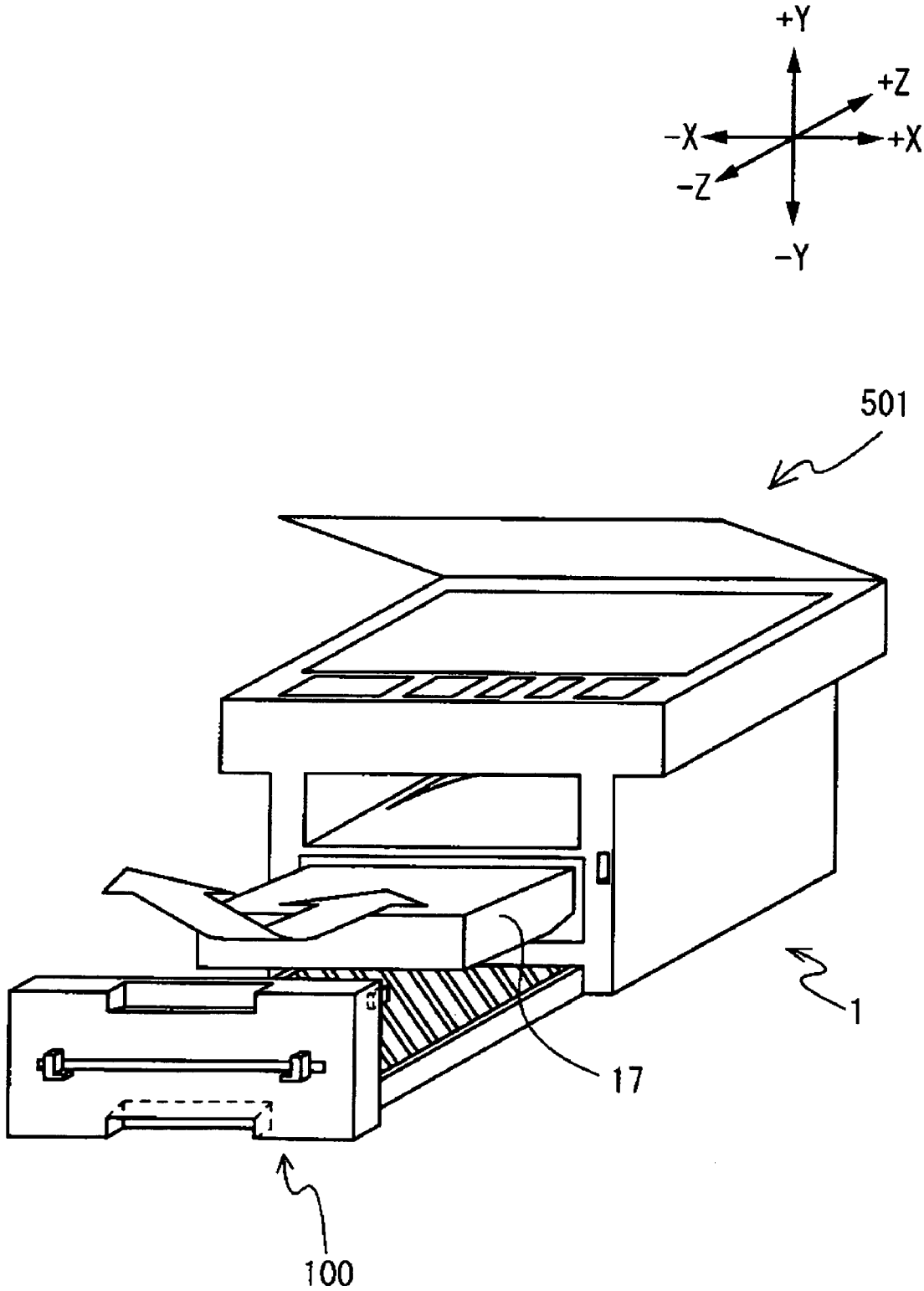
FIG. 52 is a perspective view showing that the process cartridge 17 is attached to or detached from the laser printer 1 and mounting the image reading apparatus 501.

As shown in FIGS. 51 and 52, in the laser printer 1, the cassette with cover 100 can be pulled out from and inserted into the laser printer 1 from the front for replenishment of sheets 3 and removal of the process cartridge 17. Thus, even if the image reading apparatus 501 is mounted on the laser printer 1, it does not affect the pulling out of the cassette with cover 100. When a printed sheet 3 is ejected to the discharge paper tray 46, the user can take the sheet 3 from the front of the laser printer 1.

In the laser printer 1, the cassette with cover 100 and the process cartridge 17 are pulled out and inserted into the laser printer 1 substantially parallel to each other and in substantially a horizontal direction. That is, as the cassette with cover 100 and the process cartridge 17 are not moved from or into the laser printer 1 in a direction of thickness of the laser printer 1, there is no need to provide a space for movement in such a direction, as a result, the laser printer 1 can be can be made low profile. Thus, the size of the laser printer 1 can be reduced as a whole even with the image reading apparatus 501 mounted thereon.

In the above embodiments, the process cartridge 17 is made up of the drum cartridge 17*a* and the developing cartridge 17*b*, however, may be a process cartridge in which a drum cartridge and a developing cartridge are combined. The developing cartridge 17*b* is detachably attached to the drum cartridge 17*a*. Instead, a drum cartridge and a developing cartridge may be provided detachably to the main body 2 independently.

The developing cartridge 17*b* and the developing roller 31 may be separated from each other such that the developing cartridge 17*b* and the developing roller 31 are detachable to the main body 2, independently.

What is claimed is:

1. An image forming apparatus, comprising:

a main body with a first opening and a second opening;

an accommodating portion formed at the main body, wherein the first opening is in communication with the accommodating portion;

an exchange unit that is detachably attached to the accommodating portion through the first opening;

a cassette accommodating portion formed at the main body, wherein the second opening is in communication with the cassette accommodating portion; and a cassette that is accommodated at the cassette accommodating portion and is movable relative to the main body between a first position and a second position, wherein the cassette further comprises:

a holding portion that holds a recording medium therein; and a cover portion that conceals the first opening when the cassette is at the first position.

2. The image forming apparatus according to claim 1, wherein the cover portion perpendicularly extends from the holding portion.

3. The image forming apparatus according to claim 2, wherein the cover portion is formed with the holding portion integrally.

4. The image forming apparatus according to claim 1, wherein the exchange unit includes a photosensitive member, a charging device, a developing device and a developer container.

5. The image forming apparatus according to claim 4, wherein the exchange unit further comprises a transfer roller.

6. The image forming apparatus according to claim 1, wherein when the cassette is positioned at the second position, the cover portion reveals the first opening.

7. The image forming apparatus according to claim 6, wherein the cassette is detachable from the cassette accommodating portion, and both the first opening and the second opening are revealed when the cassette is detached from the cassette accommodating portion.

8. The image forming apparatus according to claim 1, wherein both the first opening and the second opening face a common direction relative to the main body.

9. The image forming apparatus according to claim 8, further comprising:

an image scanning device provided above the main body.

10. The image forming apparatus according to claim 1, further comprising:

a feed path that extends from the holding portion.

11. The image forming apparatus according to claim 10, wherein at least part of the feed path communicates with an exterior of the main body through the first opening when the cassette is at the second position.

12. The image forming apparatus according to claim 10, wherein at least part of the feed path extends parallel with a direction in which the exchange unit is attached to the accommodating portion.

13. The image forming apparatus according to claim 12, further comprising:

a first supply device that is adjacent to the second opening and that transports the recording medium from the holding portion to the feed path.

14. The image forming apparatus according to claim 1, wherein the cassette further comprises:

a slit opening that communicates with the feed path.

15. The image forming apparatus according to claim 14, wherein the slit opening is formed at the cover portion.

16. The image forming apparatus according to claim 15, wherein the cover portion perpendicularly extends from the holding portion.

17. The image forming apparatus according to claim 15, wherein the cassette further comprises:

a cover that is provided at the cover portion and that is movable between an open position and a closed position, the cover revealing the slit opening when the cover is at the open position and concealing the slit opening when the cover is at the closed position.

18. The image forming apparatus according to claim 17, further comprising:

a second supply device that feeds the recording medium through the opening to the feed path.

19. The image forming apparatus according to claim 18, wherein the second supply device is provided at the cover portion.

20. The image forming apparatus according to claim 19, wherein the second supply device feeds the recording medium placed on the cover when the cover is at the open position.

21. The image forming apparatus according to claim 20, further comprising:

a first transmitting device, provided at the main case, that transmits a driving power to the second supplying device.

22. The image forming apparatus according to claim 21, wherein the cassette further comprises:

a second transmitting device, provided at the cover portion, that communicates with the first transmitting device and that transmits the driving power to the second supplying device.

23. The image forming apparatus according to claim 22, wherein both the first transmitting device and the second transmitting include a circular gear with a predetermined diameter.

24. The image forming apparatus according to claim 23, wherein at least one of the first transmitting device or the second transmitting device further comprises:

a protection element, formed in a disc shape, that is attached to the gear with a diameter of the protection element being larger than the diameter of the gear.

25. The image forming apparatus according to claim 17, wherein the cassette further comprises:

a lock formed with the cover; and an engagement provided at the cover portion, wherein the lock is engaged with the engagement when the cover is at the closed position.

26. The image forming apparatus according to claim 17, wherein the cassette further comprises:

a first holding portion, formed at the cover, that is used to move the cover to the open position.

27. The image forming apparatus according to claim 26, wherein the cassette further comprises:

a second holding portion, formed at the cover, that is used to move the cassette to the second position when the cover is at the open position.

28. The image forming apparatus according to claim 26, wherein the cassette further comprises a third recess formed at a bottom surface of the cover.

29. The image forming apparatus according to claim 17, wherein the cassette further comprises:

a first recess formed at a top surface of the cover.

30. The image forming apparatus according to claim 29, wherein the cassette further comprises:

a second recess formed at an outer surface of the cover adjacent to the top surface of the cover.

31. The image forming apparatus according to claim 1, wherein the cassette further comprises:

a support portion, provided at the cover portion, that supports the cover portion such that the cover portion is movable between an open position and a closed position.

32. The image forming apparatus according to claim 31, wherein the support portion is a shaft.

33. The image forming apparatus according to claim 31, wherein when the cover portion is at the closed portion, the cover portion is perpendicular to the holding portion.

34. The image forming apparatus according to claim 33, wherein when the cover portion is at the open position, the cover portion is parallel to the holding portion.

35. The image forming apparatus according to claim 31, wherein the first opening is revealed when the cover portion is at the open position.

36. The image forming apparatus according to claim 31, wherein the cassette further comprises:

a first holding portion, formed at the cover portion, that is used to move the cover portion to the open position.

37. The image forming apparatus according to claim 36, wherein the cassette further comprises:

a second holding portion, formed at the cover portion, that is used to move the cassette to the second position when the cover portion is at the open position.

38. The image forming apparatus according to claim 37, wherein the cassette further comprises:

a lock part that keeps the cover portion at the open position and the closed position.

39. The image forming apparatus according to claim 38, wherein the cassette further comprises:

a slit opening that communicates with the feed path.

40. The image forming apparatus according to claim 39, wherein the cassette further comprises:

a cover that is provided at the cover portion and that is movable between an open position and a closed position, the cover revealing the slit opening when the cover is at the open position and concealing the slit opening when the cover is at the closed position.

41. The image forming apparatus according to claim 40, further comprising:

a second supply device that feeds a recording medium through the opening to the feed path.

42. The image forming apparatus according to claim 41, wherein the second supply device is provided at the cover portion.

43. The image forming apparatus according to claim 42, wherein the second supply device feeds the recording medium placed on the cover when the cover is at the open position.

44. The image forming apparatus according to claim 43, further comprising:

a first transmitting device, provided at the main case, that transmits a driving power to the second supply device.

45. The image forming apparatus according to claim 44, wherein the cassette further comprises:

a second transmitting device, provided at the cover portion, that communicates with the first transmitting device and that transmits the driving power to the second supplying device.

46. The image forming apparatus according to claim 45, wherein both the first transmitting device and the second transmitting include a circular gear with a predetermined diameter.

47. The image forming apparatus according to claim 46, wherein at least one of the first transmitting device or the second transmitting device further comprises:

a protection element, formed in a disc shape, that is attached to the gear, with a diameter of the protection element being larger than the diameter of the gear.

48. The image forming apparatus according to claim 40, wherein the cassette further comprises:

a lock piece formed with the cover; and an engagement piece provided at the cover portion, wherein the lock piece is engaged with the engagement piece when the cover is at the closed position.

49. The image forming apparatus according to claim 37, wherein the cassette further comprises:

a shaft formed at the cover portion, that is used to move the cover portion between the open position and the closed position; and a lever that engages the shaft and that maintains the cover portion in the open position or the closed position.

50. The image forming apparatus according to claim 31, wherein the cassette further comprises:

a first recess formed at a top surface of the cover.

51. The image forming apparatus according to claim 50, wherein the cassette further comprises:

a second recess formed at an outer surface of the cover adjacent to the top surface of the cover.

52. The image forming apparatus according to claim 1, further comprising:

a sensor that detects whether the cover portion of the cassette is at the second position.

53. The image forming apparatus according to claim 1, wherein when the cassette is at the second position, the distance between an inner surface of the cover portion and the outer surface of the main body is greater than a length of the exchange unit.

54. An image forming apparatus, comprising:

a main body with a first opening and a second opening;

a process cartridge that is detachably attached to the main body and that passes through the first opening; and a cassette that is movable between a first position and a second position relative to the second opening of the main body, wherein an outer wall of the cassette conceals the first opening when the cassette is at the first position.

* * * * *